US007470447B2

(12) United States Patent
Maruyama et al.

(10) Patent No.: US 7,470,447 B2
(45) Date of Patent: Dec. 30, 2008

(54) METHOD AND DEVICE FOR DISCHARGING FLUID

(75) Inventors: Teruo Maruyama, Hirakata (JP); Takashi Inoue, Higashiosaka (JP); Ryoji Hyuga, Moriguchi (JP)

(73) Assignee: Panasonic Corporation, Osaka (JP)

( * ) Notice: Subject to any disclaimer, the term of this patent is extended or adjusted under 35 U.S.C. 154(b) by 1134 days.

(21) Appl. No.: 10/776,278

(22) Filed: Feb. 12, 2004

(65) Prior Publication Data

US 2004/0228970 A1 Nov. 18, 2004

(30) Foreign Application Priority Data

Feb. 14, 2003 (JP) ..... 2003-036434

(51) Int. Cl.
*B05D 5/06* (2006.01)

(52) U.S. Cl. ..... 427/64; 427/67; 427/427.1; 427/427.2; 427/427.6

(58) Field of Classification Search ..... 427/64, 427/67, 427.1, 427.2, 427.6
See application file for complete search history.

(56) References Cited

U.S. PATENT DOCUMENTS

| | | | | |
|---|---|---|---|---|
| 6,063,339 | A * | 5/2000 | Tisone et al. | 422/67 |
| 6,558,127 | B2 | 5/2003 | Maruyama et al. | |
| 6,679,685 | B2 | 1/2004 | Maruyama et al. | |
| 6,679,985 | B2 * | 1/2004 | Kim et al. | 205/658 |
| 2002/0017238 | A1 * | 2/2002 | Shinozaki et al. | 118/668 |
| 2002/0025260 | A1 * | 2/2002 | Maruyama | 417/322 |
| 2004/0081759 | A1 * | 4/2004 | Maruyama et al. | 427/256 |
| 2004/0084549 | A1 * | 5/2004 | Maruyama et al. | 239/4 |
| 2004/0118865 | A1 | 6/2004 | Maruyama et al. | |

FOREIGN PATENT DOCUMENTS

| | | |
|---|---|---|
| JP | 2000-167467 | 6/2000 |
| JP | 2002-1192 | 1/2002 |
| JP | 2002-301414 | 10/2002 |
| JP | 2004-141866 | 5/2004 |

* cited by examiner

*Primary Examiner*—Binh X Tran
(74) *Attorney, Agent, or Firm*—Wenderoth, Lind & Ponack, L.L.P.

(57) ABSTRACT

Fluid discharge device and method for intermittently discharging and feeding fluid in a constant amount with high speed and high precision, the fluid exemplified by various kinds of liquids such as adhesives, solder paste, fluorescent materials, electrode materials, greases, paints, hot melts, chemicals, foods and the like in production processes in the fields of electronic components, household electrical appliances, displays, and the like. By providing a fluid supply device for supplying the fluid to two surfaces that are moved relative to each other along a direction of a gap, a continuous flow supplied from the fluid supply device is converted into an intermittent flow by utilizing a pressure change due to a change in the gap of the relatively moving surfaces, while the intermittent discharge amount per dot is controlled by the rotational speed of the fluid supply device.

20 Claims, 26 Drawing Sheets

208
217
218
212
210
215

208
217
218
210
212
214
215
hr1
hr2
219

208
217
218
212
210
219
215

208
217
218
210
212
219
215

208
217
210
212
219
215

METHOD AND DEVICE FOR DISCHARGING FLUID

BACKGROUND OF THE INVENTION

The present invention relates to a fluid discharge method and a fluid discharge device required in such technical fields as information/precision equipment, machine tools, and FA (Factory Automation), or in various production processes of semiconductors, liquid crystals, displays, surface mounting, and the like.

For liquid discharge devices (liquid dispensers), which have hitherto been used in various fields, there has arisen a growing demand for a technique of feeding and controlling very small amounts of fluid material with high precision and high stability, against the background of recent years' needs for smaller-size electronic components and higher recording density. For example, in the fields of plasma displays, CRTs, organic EL, or other displays, there has been a great demand for direct patterning of fluorescent material or electrode material on the panel surface without any mask instead of conventional screen printing, photolithography, or other like methods.

Issues of dispensers for those purposes can be summarized as follows:

① Scale-down of discharge amount,

② Higher accuracy of discharge amount, and

③ Reduction of discharge time.

The machining accuracy in machining work has been moving from micron into submicron orders. Whereas submicron machining is commonly used in the field of semiconductor and electronic components, the demand for ultraprecision machining has been rapidly increasing also in the field of machining work that has been making progress along with mechatronics. In recent years, along with the introduction of the ultraprecision machining technique, electromagnetostriction devices typified by ultra-magnetostriction devices and piezoelectric devices have been coming to be applied to micro actuators.

With these electromagnetostriction devices used as the generation source for fluid pressure, there have been devised injection devices for injecting very small amounts of droplets at high speed in various fields.

For example, a method of injecting one arbitrary droplet with an ultra-magnetostriction device is disclosed in Japanese unexamined patent publication No. 2000-167467. Referring to FIG. 35, reference numeral 502 denotes a cylinder made of a nonmagnetic material such as glass pipe or stainless pipe. At one end portion of this cylinder 502 is formed an injection nozzle 504 having a liquid storage portion 503 and a minute injection port. Inside the cylinder 502, an actuator 505 made of a bar-shaped ultra-magnetostriction material is accommodated so as to be movable. A piston 506 is contactably and separably provided at an end portion of the actuator 505 suited for the injection nozzle 504.

Between the other end portion of the actuator 505 and a stopper 507 of the one end portion of the cylinder 502, a spring 508 is interposed so that the actuator 505 is biased by the spring 508 so as to be moved forward. Also, a coil 509 is wound at a position near the piston 506 on the outer periphery of the cylinder 502.

In an injection device having the above construction, a current is instantaneously passed through the coil 509 so that an instantaneous magnetic field acts on the ultra-magnetostriction material, by which an instantaneous transient displacement due to an elastic wave is generated at an axial end portion of the ultra-magnetostriction material. By the action, it is described, the liquid filled in the cylinder 502 can be injected from the nozzle 504 as one minute droplet.

As a fluid discharge device, conventionally, such a dispenser employing an air pulse system as shown in FIG. 36 has been widely used, and this technique is introduced, for example, in "Jidoka-Gijutsu (Mechanical Automation), Vol. 25, No. 7, '93."

A dispenser of this system applies a constant amount of air supplied from a constant-pressure source into the interior 601 of a vessel (cylinder) 600 in a pulsed manner and then discharges from a nozzle 602 a certain amount of liquid corresponding to a pressure increase in the cylinder 600.

In the field of circuit formation, or in the fields of electrodes, ribs, and fluorescent-screen formation of PDP, CRT, or other image tubes, and manufacturing processes of liquid crystals, optical disks, or the like, where higher precision and higher micro-fineness have been increasingly demanded for those fields in recent years, the fluid material to be microfinely discharged is high-viscosity powder and granular materials in many cases.

It is the greatest issue how those powder and granular materials containing fine particles can be discharged onto the object substrate at high speed and high precision and without causing clogging of flow passages and moreover with high reliability.

With regard to the fluorescent material-layer forming process of plasma display panels as an example, issues of the prior art are described below.

[1] Issues of the screen printing method and the photolithography method

[2] Issues in direct patterning of a fluorescent material layer by a conventional dispenser technique First, issue [1] is explained.

(1-1) Construction of Plasma Display Panel

FIG. 34 shows an example of the construction of a plasma display panel (hereinafter, referred to as PDP). The PDP is composed roughly of a front side plate 800 and a rear side plate 801. A plurality of sets of linear transparent electrodes 803 are formed on a first substrate 802, which is a transparent substrate forming the front side plate 800. Also, on a second substrate 804 forming the rear side plate 801, a plurality of sets of linear electrodes 805 are provided parallel to one another so as to be perpendicular to the linear transparent electrodes. These two substrates are opposed to each other with interposition of barrier ribs 806 on which the fluorescent material layer is formed, and then discharge gas is sealed into the barrier ribs 806. When a voltage not lower than the threshold is applied to between the electrodes of the two substrates, electric discharge occurs at the positions where the electrodes perpendicularly cross each other, causing discharge gas to emit light, where the light emission can be observed through the transparent first substrate 802.

Then, controlling the discharge positions (discharge points) allows an image to be displayed on the first substrate side. For color display by PDP, fluorescent materials which emit light of desired colors by ultraviolet rays radiated upon discharge at individual discharge points are formed at positions corresponding to the discharge points (partition walls of barrier ribs), respectively. For full-color display, fluorescent materials for R, G, and B, respectively, are formed.

The constitution of the front side plate 800 and the rear side plate 801 is explained in more detail.

As to the front side plate 800, a plurality of sets of linear transparent electrodes 803, each one set comprising two electrodes, are formed from ITO or the like, parallel to each another, on the inner surface side of the first substrate 802 formed of a transparent substrate such as a glass substrate. Bus electrodes 807 for reducing the line resistance value are formed on the inner-side surfaces of these linear transparent electrodes 803. A dielectric layer 808 for covering those transparent electrodes 803 and bus electrodes 807 is formed all over the inner surface of the front side plate 800, and a MgO layer 809 serving as a protective layer is formed all over the surface of the dielectric layer 808.

On the other hand, on the inner surface side of the second substrate 804 of the rear side plate 801, a plurality of linear address electrodes 805 which perpendicularly cross the linear transparent electrodes 803 of the front side plate 800 are formed in parallel from silver material or the like. Also, a dielectric layer 810 for covering those address electrodes 805 is formed all over the inner surface of the rear side plate. On the dielectric layer 810, the address electrodes 805 are isolated and moreover the barrier ribs (partition walls) 806 of a specified height are formed so as to protrude between the individual address electrodes 805 for the purpose of maintaining the gap distance between the front side plate 800 and the rear side plate 801 constant.

With these barrier ribs 806, cells 811 are formed along the individual address electrodes 805, and fluorescent materials 812 of respective R, G, and B colors are formed one by one in the inner surfaces of the cells 811. The PDP in cell structure comes in two types, one in which such discharge points as shown in FIG. 34 are provided one in each one independent cell and the other in which the discharge points are partitioned by partition walls on an array basis (not shown). In recent years, the "independent cell system" has been drawing attention as a system that allows performance improvement of PDPs.

The reason for this is that enclosing the cell with four-side barrier ribs in a waffle-like state makes it possible to prevent optical leakage between adjoining cells as well as to increase the area of the light emitter. As a result, the luminous efficiency and the emission amount (brightness) are increased so that a high-contrast image can be implemented, which is regarded as a characteristic of the "independent cell system".

The fluorescent material layer formed on the cell wall surfaces is deposited generally to a thickness of about 10-40 μm with a view to a better coloring property. For the formation of the R, G, and B fluorescent material layers, a fluorescent-material coating liquid is filled into each cell and thereafter dried, thereby removing volatile components removed, by which a thick fluorescent material is formed on the cell inner surface while a space for filling with discharge gas is formed at the same time. In order to form such a thick-film fluorescent-material pattern, the coating material containing a fluorescent material is prepared as a reduced-in-solvent-quantity paste fluid (fluorescer-member use paste) having a high viscosity of several thousands of mPa·s to several tens of thousands of mPa·s and, conventionally, applied to the substrate by screen printing or photolithography.

(1-2) Issues of the Conventional Screen Printing Method

With the conventional screen printing method adopted, a large-scaled screen size would cause a large elongation of the screen plate due to tensile force, making it harder to achieve high-precision alignment of the screen printing plate for the whole screen. Also, in filling with the fluorescent material, the material might be placed even on the top portions of the partition walls, which would lead to crosstalk between barrier ribs as a problem in the case of the "independent cell system". As a result of this, it has been necessary to take measures such as introduction of a polishing process for removing the material deposited on the top portions of the partition walls. Further, since the amount of filled fluorescent material varies depending on the difference in squeegee pressure, pressure control therefor is extremely subtle work, which largely depends on the degree of the skill of the operator. Thus, it is quite hard to obtain a constant filling amount for every independent cell over the entire rear side plate.

(1-3) Issues of Conventional Photolithography

Conventional photolithography has had the following issues. In this method, a photosensitive fluorescent-material paste is press-fitted into the cells between the ribs, and then only the photosensitive composition that has been press-fitted into specified cells is left through the exposure and development processes. Thereafter, through a baking process, organic matters in the photosensitive composition are dissipated, by which a fluorescent material-layer pattern is formed. In this method, in which the paste in use contains fluorescent-material powder so that the method is low in sensitivity to ultraviolet rays, there has been difficulty in obtaining a 10 μm or more film thickness of the fluorescent material layer. Thus, the method has had an issue that enough brightness cannot be obtained.

Also, in the case where photolithography is adopted, exposure and development processes are essential for each color. However, since the fluorescent material is contained in the paste coating layer at high concentration, the loss of the fluorescent material due to the development removal is so large that the effective utilization ratio of the fluorescent material is a little less than 30% at most. Thus, there has been a large issue in terms of cost. [2] Issues in direct patterning of a fluorescent material layer by a conventional dispenser technique Conventionally, an attempt is made that discharging of the imaging tube is performed by using an air nozzle-type dispenser (FIG. 36) which is widely used in the fields of circuit mounting and the like. Since continuous discharge with high-viscosity fluid at high speed is difficult to do with the air nozzle-type dispenser, fine particles are diluted with a low-viscosity fluid before being discharged. In the case of fluorescent-material discharge on PDP, CRT, or other image tubes, the particle size of fine particles is 3 to 9 μm as an example and their specific gravity is about 4 to 5. In this case, there has been an issue that when the fluid flow is stopped, the fine particles would be immediately deposited inside the flow passage due to the weight of a single particle.

Furthermore, a dispenser of the air type has had a drawback of poor responsivity. This drawback is due to the compressibility of air entrapped in the cylinder as well as to the nozzle resistance during the passage of air through narrow gaps. That is, in the case of the air type, the time constant of the fluid circuit that depends on cylinder volume and nozzle resistance is such a large one that a time delay of about 0.07 to 0.1 second has to be allowed for after an input pulse is applied until the fluid is started being discharged and further transferred onto the substrate.

The discharge device using as the drive source a piezoelectric material or ultra-magnetostriction material as described before in FIG. 35 is a proposal targeted for discharge of fluid containing no powder, and it is predicted to be difficult to respond to the aforementioned challenge related to the discharge process of powder and granular materials. Also, in the case where a fluid is discharged by using instantaneous transient displacement due to elastic waves, the liquid storage portion 503 has to be normally filled with the fluid without gaps, where the volume is constant. There is no description as to how the fluid is supplied to the liquid storage portion 503 in order to replenish the fluid that is consumed on and on as time elapses.

There has been development being made for applying ink jet type dispensers, which have been widely used as consumer printers, to discharge devices for industrial use. The ink jet type dispensers, for which the viscosity of the fluid is limited to 10 to 50 mPa·s from the restrictions of drive method and structure, are incapable of treating high-viscosity fluids.

In order to draw a fine pattern by using an ink jet type dispenser, there has been developed a low-viscosity nano-paste in which particles having a mean particle size of about 5 nm and covered with a dispersant are independently dispersed. Now a case is assumed where the fluorescent material layer is formed on the inner walls of the barrier ribs (partition walls) of the PDP as described above by using this nano-paste. However, in the process of filling the fluorescent-material-use-coating liquid into the cells and then drying it, a reduced-in-solvent-quantity paste fluid having a high viscosity is conventionally used as the coating material containing fluorescent material in order to deposit a fluorescent material layer thick to a thickness of about 10-40 μm as described above. With a low-viscosity nano-paste, which is only capable of providing a lean content of fluorescent material, the absolute quantity of the fluorescent material lacks so that the fluorescent material layer of a specified thickness could not be formed.

Also, whereas fluorescent-material fine particles whose particle size is on the order of several microns are generally regarded as optimal for the display to obtain high brightness, it is also a large issue for ink jet type dispensers that the fluorescent-material particle size cannot be easily changed as it stands.

In summary of the above discussions, there cannot be found, for the present, any engineering method having a capability of substituting for the screen printing method and the photolithography method, for example, a direct patterning method that implements the formation of the fluorescent material layer for the independent cells of PDPs.

In order to meet recent years' various requests related to the minute-flow-rate discharge of fluid and powder and granular materials, the present inventor has proposed and applied for a patent for a discharge method for controlling the discharge amount, "Fluid Feeding Device and Fluid Feeding Method" (Japanese unexamined patent publication No. 2002-1192) (U.S. Pat. No. 6,558,127), in which, with relative linear motion and rotational motion between a piston and a cylinder, fluid conveying means is implemented by the rotational motion while a relative gap between the fixed side and the rotating side is changed by using the linear motion.

Further, the inventor has already proposed an intermittent discharge method and device which utilizes a squeeze effect which is generated by abruptly changing the gap between a piston end face and its relatively moving surface on the basis of a theoretical analysis performed on the dispenser structure disclosed in the foregoing proposal (Japanese unexamined patent publication No. 2002-301414)(U.S. Pat. No. 6,679,685).

As a result of following stricter theoretical analysis, the present inventor has found that devising a combination of pump characteristics and piston makes it possible to obtain a generated pressure (secondary squeeze pressure) equal to or higher than the squeeze effect even with a sufficiently wide gap between the piston end face and its relatively moving surface. The present inventor has already proposed an ultra-high-speed intermittent discharge device which, it is claimed as implementable, is easy to handle in practical use, high in flow-rate precision and high in reliability to powder and granular materials on the basis that only simple control of the gap of the piston end face is required and the total discharge amount per dot can be set by the pump rotating speed by virtue of the above-described effect (Japanese patent application No. 2003-341003 which was published as Unexamined Japanese Patent Publication No. 2004-141866) (U.S. patent application Ser. No. 10/673,495).

In the present invention, as a result of further research under strict comparisons with experimental results, it has been found on the basal steps of the above-described proposals that the compressibility of the fluid has a large effect on the generation of the squeeze pressure. Here is proposed a head structure that implements high-speed intermittent, high-speed continuous discharge on the basis of the findings obtained from analytical results derived in consideration of the compressibility.

BRIEF SUMMARY OF THE INVENTION

In accomplishing these and other aspects, according to a first aspect of the present invention, there is provided a fluid discharge method for intermittently discharging fluid by feeding the fluid fed from a fluid supply device to a gap defined between opposed relatively moving surfaces of two members while keeping the two members moving relative to each other along a direction of the gap, and by utilizing a pressure change caused by changing the gap so that the fluid is intermittently discharged through a discharge port communicating with the gap, wherein the opposed relatively moving surfaces of the two members are provided in n sets, where n is an integer not less than 1, and wherein given a total volume $V_1$ ($mm^3$) of the n sets of opposed relatively moving surfaces, a total volume $V_2$ ($mm^3$) of flow passages that connect the n sets of opposed relatively moving surfaces and the fluid supply device to each other, an absolute value $X_{st}$ (mm) of a stroke of the n sets of relatively moving surfaces that move relative to each other, a time $T_{st}$ (sec) required for the n sets of relatively moving surfaces to move by the stroke $X_{st}$, a fluid internal resistance $R_S$ (kgsec/$mm^5$) of the fluid supply device, a fluid resistance $R_n$ (kgsec/$mm^5$) of the discharge port, a modulus of elasticity of volume K (kg/$mm^2$) of the fluid, an effective area $S_P$ ($mm^2$) of the relatively moving surfaces, and a sum $P_{s0}$ (kg/$mm^2$) of a maximum pressure of the fluid supply device and an auxiliary pressure for introducing the fluid into the fluid supply device, if it is defined that $V_S=V_1+V_2$ and that a time constant T and an intermittent interception control parameter $II_c$ are $$T = \frac{R_s R_n}{R_n + nR_S}\frac{V_s}{K} \text{ and}$$

$$II_c = \frac{R_s S_p X_{st}\left(1 - e^{-\frac{T_{st}}{T}}\right)}{2P_{s0}T_{st}},$$

respectively, then it holds that $II_c>1$.

According to a second aspect of the present invention, there is provided the fluid discharge method according to the first aspect, wherein $$P_{s0} + \frac{S_p X_{st} K}{2V_s} > 0.2$$

According to a third aspect of the present invention, there is provided a fluid discharge method for continuously discharging fluid by feeding the fluid fed from a fluid supply device to a gap defined between opposed relatively moving surfaces of two members that move relative to each other along a direction of the gap so that the fluid is continuously discharged through a discharge port communicating with the gap, wherein the opposed relatively moving surfaces of the two members are provided in n sets, where n is an integer not less than 1, and wherein given a total volume $V_1$ ($mm^3$) of the n sets of opposed relatively moving surfaces, a total volume $V_2$ ($mm^3$) of flow passages that connect the n sets of opposed relatively moving surfaces and the fluid supply device to each other, an absolute value $X_{st}$ (mm) of a stroke of the n sets of relatively moving surfaces that move relative to each other, a time $T_{st}$ (sec) required for the n sets of relatively moving surfaces to move by the stroke $X_{st}$, a fluid internal resistance $R_S$ (kgsec/$mm^5$) of the fluid supply device, a fluid resistance $R_n$ (kgsec/$mm^5$) of the discharge port, a modulus of elasticity of volume K (kg/$mm^2$) of the fluid, an effective area $S_P$ ($mm^2$) of the relatively moving surfaces, and a sum $P_{s0}$ (kg/$mm^2$) of a maximum pressure and an auxiliary pressure of the fluid supply device, if it is defined that $V_S=V_1+V_2$ and that a time constant T and a continuous interception control parameter $CI_c$ are $$T = \frac{R_s R_n}{R_n + nR_S}\frac{V_s}{K} \text{ and}$$

$$CI_c = \frac{R_s S_p X_{st}\left(1 - e^{-\frac{T_{st}}{T}}\right)}{P_{s0} T_{st}},$$

respectively, then it holds that $CI_c>1$.

According to a fourth aspect of the present invention, there is provided a fluid discharge method for continuously or intermittently discharging fluid by feeding the fluid fed from a fluid supply device to a gap defined between opposed relatively moving surfaces of two members that move relative to each other along a direction of the gap so that the fluid is continuously or intermittently discharged through a discharge port communicating with the gap, wherein the two members that move relative to each other in the gap direction are provided in n sets, where n is an integer not less than 1, and wherein given a total volume $V_1$ ($mm^3$) of the n sets of relatively moving surfaces, a total volume $V_2$ ($mm^3$) of flow passages that connect the n sets of relatively moving surfaces and the fluid supply device to each other, a fluid internal resistance $R_S$ (kgsec/$mm^5$) of the fluid supply device, a fluid resistance $R_n$ (kgsec/$mm^5$) of the discharge port, a fluid resistance $R_P$ (kgsec/$mm^5$) of radial flow passages that connect the discharge port and outer peripheries of the relatively moving surfaces to each other, and a modulus of elasticity of volume K (kg/$mm^2$) of the fluid, and if it is defined that $V_S=V_1+V_2$ and that a time constant T is $$T = \frac{R_s R_n}{R_n + R_P + nR_S}\frac{V_s}{K},$$

then it holds that T≦30 msec.

According to a fifth aspect of the present invention, there is provided the fluid discharge method according to the first aspect, wherein in a multi-head for feeding the fluid fed from the single fluid supply device to the gaps between the plural opposed relatively moving surfaces in which n≧3, the mutually generally parallel flow passages are formed so as to lead from a common flow passage arranged on a way between the fluid supply device and the plural opposed relatively moving surfaces so as to communicate with the fluid supply device on its upper stream side and communicate with the individual relatively moving surfaces on its lower stream side in such a manner that fluid resistances of the individual flow passages are equal to one another.

According to a sixth aspect of the present invention, there is provided the fluid discharge method according to the first aspect, wherein in a multi-head for feeding the fluid fed from the single fluid supply device to the gaps between the plural opposed relatively moving surfaces in which n≧3, at least one of the flow passages is formed in a bent configuration so that fluid resistances of the individual flow passages are equal to one another.

According to a seventh aspect of the present invention, there is provided the fluid discharge method according to the first aspect, wherein an axial drive device for relatively moving the opposed relatively moving surfaces is implemented by using an electro-magnetostriction element, and T≦30 msec.

According to an eighth aspect of the present invention, there is provided the fluid discharge method according to the seventh aspect, wherein the discharge fluid is intermittently flown and discharged onto a substrate, which is a discharge target, with a cycle period $T_P$=0.1 to 30 msec in a state that viscosity μ of the of the discharge fluid is μ>100 mPa·s, the diameter ϕd of the powder material contained in the discharge fluid is ϕd<50 μm, the flow passages between the relatively moving members keep mechanically completely contactless during the discharge process, and a gap H between a discharge nozzle serving as the discharge port and the discharge-target substrate is H≧0.5 mm.

According to a ninth aspect of the present invention, there is provided the fluid discharge method according to the first aspect, wherein a continuous flow supplied from the fluid supply device is converted into an intermittent flow by utilizing the pressure change due to a change in the gap of the relatively moving surfaces, and wherein an intermittent discharge amount per dot is controlled by setting of pressure and flow-rate characteristics of the fluid supply device.

According to a 10th aspect of the present invention, there is provided the fluid discharge method according to the ninth aspect, wherein the fluid supply device is a pump which allows the flow rate to be changed by its rotating speed.

According to an 11th aspect of the present invention, there is provided the fluid discharge method according to the 10th aspect, wherein the fluid supply device is a thread groove pump.

According to a 12th aspect of the present invention, there is provided the fluid discharge method according to the first aspect, wherein the flow rate for each one shot is set by changing the rotating speed of the fluid supply device.

According to a 13th aspect of the present invention, there is provided the fluid discharge method according to the first aspect, wherein the axial drive device is a resonant oscillator.

According to a 14th aspect of the present invention, there is provided the fluid discharge method according to the first aspect, wherein while a discharge nozzle serving as the discharge port and a discharge-target substrate are kept moving relative to each other, the fluid of an equal discharge amount per dot is intermittently discharged periodically by taking advantage of the discharge-target surface's geometrical symmetry.

According to a 15th aspect of the present invention, there is provided the fluid discharge method according to the first aspect, wherein the discharge-target surface is a display panel.

According to a 16th aspect of the present invention, there is provided the fluid discharge method according to the first aspect, the method being a method for forming a fluorescent material layer of a plasma display panel, wherein while a dispenser having a discharge nozzle serving as the discharge port is kept moving relative to a discharge-target substrate on which independent ribs surrounded by barrier ribs are geometrically symmetrically formed, fluorescent material paste as the fluid is intermittently discharged from the discharge nozzle so that the fluorescent material paste is discharged into interiors of the independent cells successively, whereby a fluorescent material layer is formed.

According to a 17th aspect of the present invention, there is provided the fluid discharge method according to the first aspect, wherein if a volume of a flow passage that connects the fluid supply device and one piston forming the gap of the relatively moving surfaces is $V_{2S}$, then it holds that $10<V_{2S}<80\ mm^3$.

According to an 18th aspect of the present invention, there is provided the fluid discharge method according to the first aspect, wherein if a setting range of a minimum value or mean value $h_0$ of the gap over which discharge amount per dot $Q_s$ is largely affected by a size of the minimum value or mean value $h_0$ of the gap is $0<h_0<h_x$, and if a setting range of $h_0$ over which the discharge amount per dot $Q_s$ is approximately equal despite changes in the gap $h_0$ is $h_0>h_x$, then the fluid is intermittently discharged with the gap set within a range of $h_0>h_x$.

According to a 19th aspect of the present invention, there is provided the fluid discharge method according to the 18th aspect, wherein $h_x$ is an intersection point between an envelope of a discharge amount $Q_s$ curve against $h_0$ in a region of $0<h_0<h_x$ and $Q_s=Q_{se}$ at $h_0\rightarrow\infty$.

According to a 20th aspect of the present invention, there is provided the fluid discharge method according to the first aspect, wherein if a minimum value or mean value of the gap of the relatively moving surfaces is $h_0$, then $h_0>0.05$ mm.

According to a 21st aspect of the present invention, there is provided a fluid discharge apparatus comprising:

two members which have n sets of opposed relatively moving surfaces for moving relative to each other along a direction of a gap formed between the n sets of opposed relatively moving surfaces; and a fluid supply device for feeding fluid via a suction port to between those n sets of opposed relatively moving surfaces, with a discharge port provided at any one of the relatively moving surfaces, wherein n is an integer not less than 1, and wherein given a total volume $V_1$ ($mm^3$) between the n sets of opposed relatively moving surfaces, a total volume $V_2$ ($mm^3$) of flow passages that connect the gap between the n sets of relatively moving surfaces and the fluid supply device to each other, a fluid internal resistance $R_S$ ($kgsec/mm^5$) of the fluid supply device, a fluid resistance $R_n$ ($kgsec/mm^5$) of the discharge port, a fluid resistance $R_P$ ($kgsec/mm^5$) of a radial flow passage that connects the discharge port and outer peripheries of the relatively moving surfaces to each other, and a modulus of elasticity of volume K ($kg/mm^2$) of the fluid, if it is defined that $V_S=V_1+V_2$ and that a time constant T is $$T = \frac{R_S R_n}{R_n + R_P + R_S}\frac{V_s}{K},$$

then it holds that $T\leqq 0.03$.

According to a 22nd aspect of the present invention, there is provided a fluid discharge apparatus, comprising: an axial drive device for giving an axial-direction relative displacement between a shaft and a housing, with a discharge chamber defined by a shaft end face and the housing; and a fluid supply device for supplying fluid to the discharge chamber, with a flow passage for communicating the discharge chamber and the fluid supply device with each other, and with a suction port formed in the fluid supply device, and with a discharge port for communicating the discharge chamber and outside with each other, wherein an opening area of the flow passage formed between the shaft and the housing is changed by an axial-direction relative move of the shaft and the housing, and the opening area becomes smaller at a discharge end stage than that at a suction end stage.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1A:
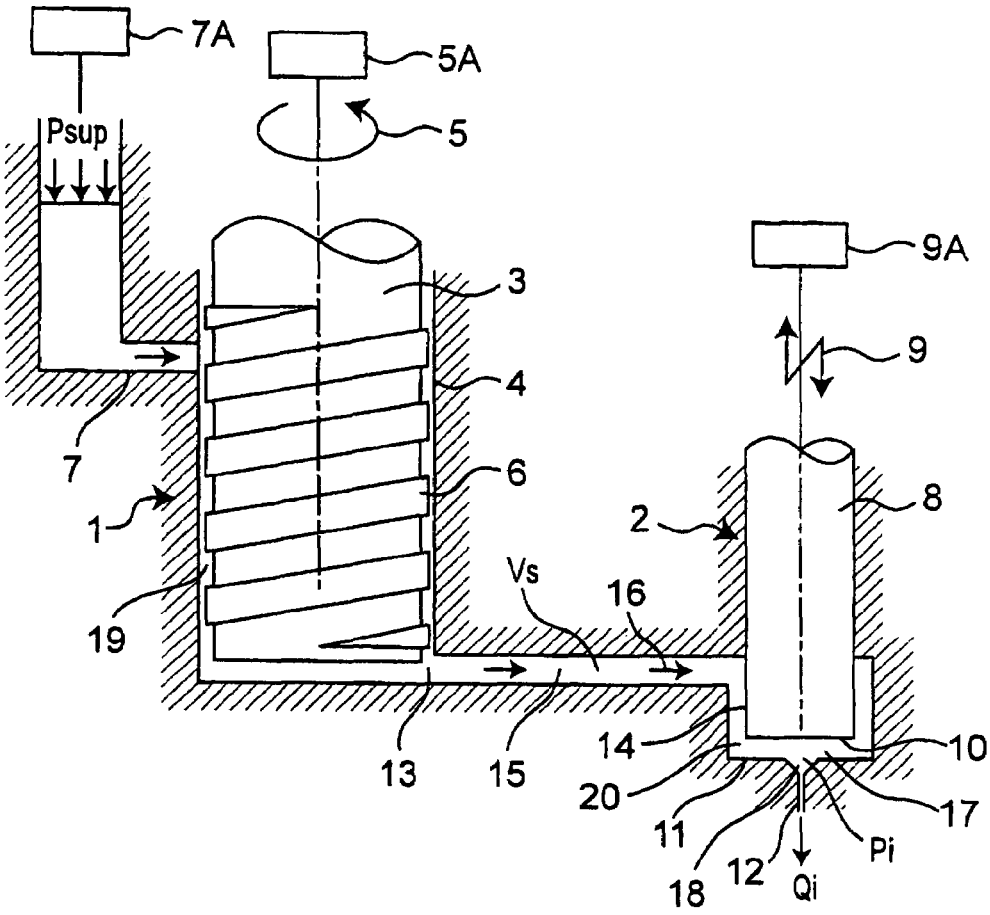
FIG. 1A is a model view of an example to which the present invention is applied.

Before the description of the present invention proceeds, it is to be noted that like parts are designated by like reference numerals throughout the accompanying drawings.

FIG. 1A is a model view showing a first embodiment of the present invention. Referring to FIG. 1A, reference numeral 1 denotes a thread groove pump portion, which is one example of a fluid supply device, and 2 denotes a piston portion for generating a squeeze pressure. Numeral 3 denotes a thread groove shaft, which is housed in a housing 4 so as to be rotatable relative to the housing 4. The thread groove shaft 3 is rotationally driven as shown in an arrow 5 by a rotation transfer device 5A such as a motor. Numeral 6 denotes a thread groove formed in relatively moving surfaces of the thread groove shaft 3 and the housing 4, and 7 denotes a suction port of a compressible fluid for introducing the compressible fluid into the thread groove pump portion 1 by air pressure (supplementary pressure) $P_{sup}$ applied from a supplementary pressure generating device 7A. Numeral 8 denotes a piston, which is moved in an axial direction (arrow 9) by an axial drive device 9A such as a piezoelectric actuator. Numeral 10 denotes a piston end face of the piston 8, 11 denotes its fixed-side opposing surface, and 12 denotes a discharge nozzle fitted to the housing 4 and serving as one example of a discharge port. The piston end face 10 and the fixed-side opposing surface 11 serve as the two surfaces that move relative to each other along the gap direction. A space formed by these two surfaces 10, 11 and the housing 4 serves as a discharge chamber.

Numeral 13 denotes a thread-groove-shaft end portion, 14 denotes a piston outer periphery, and 15 denotes a flow passage for connecting the thread-groove-shaft end portion 13 and the piston outer periphery 14 to each other. A discharge fluid 16 is fed to the piston portion 2 via the flow passage 15 by the thread groove pump portion 1, which is the fluid supply device, at all times.

The axial drive device 9 (its specific structure is not shown) is provided between the piston 8 and the housing 4 and changes relative positions of these two members 8, 4 in the axial direction. A gap h between the piston end face 10 and its opposing surface 11 can be changed by this axial drive device 9. If the minimum value of the gap h of the piston end face is assumed as $h=h_{min}$, then $h_{min}$ is large enough in one working example of the first embodiment, for example, set to $h_{min}=245$ μm.

When the gap h is changed at a high frequency, a fluctuating pressure is generated to the discharge chamber 17, which is a gap portion between the piston end face 10 and its opposing surface 11, by the later-described secondary squeeze effect found in a previous proposal (Japanese patent application No. 2003-341003 which was published as Unexamined Japanese Patent Publication No. 2004-141866)(U.S. patent application Ser. No. 10/673,495).

In the central portion of the discharge chamber 17, a portion positioned at an indication of numeral 18 is referred to as an upstream side of the discharge nozzle 12 (opening of the discharge nozzle), and a gap portion formed by the thread groove shaft 3 and the housing 4 is referred to as a thread groove chamber 19. A constant amount of fluid is continuously fed to the discharge chamber 17 by the thread groove pump 1.

This example to which the present invention is applied is based on the concept that performing analog-to-digital conversion of a continuous flow (analog) fed from the pump into an intermittent flow (digital) by using the secondary squeeze effect makes it implementable to intermittently discharge the fluid at high speed while the gap h between the piston end face 10 and its opposing surface is maintained large enough.

[1] Theoretical Analysis

(1-1) Derivation of Fundamental Equations

In the present invention, many findings can be derived from fundamental equations of the squeeze pump (tentative name), which form the principle of the present invention. Although the derivation method of these fundamental equations has already been proposed by the present inventor in Japanese patent application No. 2003-341003 which was published as Unexamined Japanese Patent Publication No. 2004-141866 (U.S. patent application Ser. No. 10/673,495), its contents are described again.

A fluid pressure when a viscous fluid is placed in a narrow gap between planes opposed to each other and the gap size therebetween changes with time can be obtained by solving the following Reynolds equation including a term of a squeeze action in polar coordinates.

$$\frac{1}{r}\frac{d}{dr}\left(r\frac{h^3}{12\mu}\frac{dP}{dr}\right)=\frac{dh}{dt} \tag{1}$$

Figure 1B:
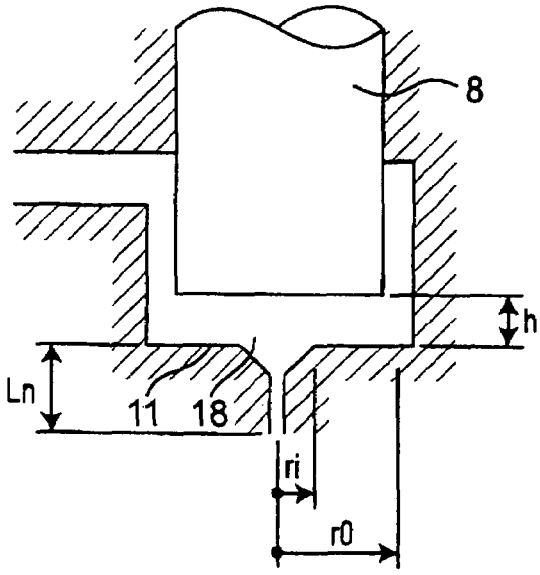
FIG. 1B is an enlarged view of a piston portion thereof.

In Equation (1), 'P' represents a pressure, 'μ' represents a viscosity coefficient of a fluid, 'h' represents a gap between the opposing surfaces, 'r' represents a position in the radial direction, and 't' represents time. Also, the right side is a term for producing a squeeze action effect generated when the gap changes. FIG. 1B is an enlarged view of the piston portion 2.

In addition, a suffix 'i' each added to symbols shows that the value is one at the position of the opening 18 of the discharge nozzle 12 in FIG. 1B, and a suffix 'o' shows that the value is one at a site positioned at a lower end of the piston outer periphery 14 inside the discharge chamber 17.

Assuming that $\dot{h}=dh/dt$, integrating both sides of Equation (1) twice results in the following equation:

$$P=\frac{12\mu}{h^3}\left(\frac{1}{4}\dot{h}r^2+c_1\ln r\right)+c_2 \tag{2}$$

Subsequently, undetermined constants $c_1$ and $c_2$ are determined. From the relationship between pressure gradient dP/dr and flow rate $Q=Q_i$ at $r=r_i$, it follows that $$c_1=\frac{Q_i}{2\pi}-\frac{\dot{h}}{2}r_i^2 \tag{3}$$

When the internal resistance of the thread groove pump is $R_s$, a pressure $P=P_0$ in the discharge-chamber end portion (the position of $r=r_0$) is $$P_0=P_{s0}-R_sQ_0 \tag{4}$$

where $Q_0$ represents the flow rate at $r=r_0$. $P_{S0}$ represents the supply-source pressure, which corresponds to a sum of a maximum generated pressure $P_{max}$ of the thread groove pump and an air supplementary pressure $P_{sup}$ for supplying the material to the thread groove ($P_{S0}=P_{sup}+P_{max}$). Substituting Equations (3) and (4) into Equation (2) allows $c_2$ to be determined:

$$c_2=P_{s0}-R_sQ_0-\frac{6\mu}{h^3}\left\{\frac{1}{2}\dot{h}r_0^2+\left(\frac{Q_i}{\pi}-\dot{h}r_i^2\right)\ln r_0\right\} \tag{5}$$

By substituting Equations (3) and (5) into Equation (2), the pressure P=P(r) is determined. If Q is the flow rate, then $$P=A+BQ \tag{6}$$

where $$A=P_{S0}-R_S\pi\dot{h}(r_0^2-r_i^2)-\frac{3\mu\dot{h}}{h^3}\left\{(r_0^2-r^2)+2r_i^2\ln\frac{r}{r_0}\right\} \tag{7}$$

$$B=\frac{6\mu}{h^3\pi}\ln\frac{r}{r_0}-R_S$$

In the above equations, at the opening of the discharge nozzle, where r=ri (indicated by numeral 18 in FIG. 1B), it is assumed that $P_i=A+BQ_i$.

When the fluid resistance of the discharge nozzle is $R_n$, the flow rate of the fluid passing through the discharge nozzle is obtained as $Q_n=P_i/R_n$.

From the continuity of flow, it holds that $Q_i=Q_n$, and the pressure $P_i$ of the opening of the discharge nozzle is determined as:

$$\begin{aligned}P_i&=\frac{A_iR_n}{R_n-B_i}\\&=\frac{R_n}{R_n+R_p+R_S}\\&\quad\left[P_{S0}-R_S\pi\dot{h}(r_0^2-r_i^2)-\frac{3\mu\dot{h}}{h^3}\left\{(r_0^2-r_i^2)+2r_i^2\ln\frac{r_i}{r_0}\right\}\right]\end{aligned} \tag{8}$$

where $A_i$ and $B_i$ are the values of A and B, respectively, when $r=r_i$ in Equation (7).

In the above equation, $R_p$ is the radial fluid resistance between the piston end face and its opposing surface. Here, a primary squeeze pressure $P_{squ1}$ and a secondary squeeze pressure $P_{squ2}$ are defined as follows:

$$\begin{aligned}P_{squ1}&=-\frac{3\mu\dot{h}}{h^3}\left\{(r_0^2-r_i^2)+2r_i^2\ln\frac{r_i}{r_0}\right\}\\P_{squ2}&=-R_S\pi\dot{h}(r_0^2-r_i^2)\end{aligned} \tag{9}$$

The primary squeeze pressure $P_{squ1}$ is attributed to the known squeeze effect that is generated on the piston end face by abruptly changing the gap between the piston end face 10 and its relatively moving surface, where the narrower the gap h, the larger the generated pressure.

A method for generating the secondary squeeze pressure $P_{squ2}$, and a method for applying this action to "high-speed intermittent discharge" and "starting- and terminating-end control for continuous discharge," are those that the present inventor has found, and their principles are as follows. When the gap between the piston end face and its relatively moving surface is abruptly changed, there occurs a flow rate change between the piston end face and the fluid supply source. This flow rate change corresponds to a volume change resulting when the gap is changed. For example, in the case where the volume has increased due to a piston's up, if the maximum possible flow rate that can be fed by the thread groove pump is not more than the volume change, a negative pressure on the piston end face occurs. From Equations (4) and (5), the pressure $P_i$ at the discharge-nozzle opening without consideration of the fluid compressibility is as follows:

$$P_i=\frac{R_n}{R_n+R_p+R_S}(P_{S0}+P_{squ1}+P_{squ2}) \tag{10}$$

Given that the flow rate is $Q_i$ and the discharge nozzle resistance is $R_n$, it holds that $Q_i=P_i/R_n$.

If the radius of the discharge nozzle is set as $r_n$ and the nozzle length is set as $L_n$, then the discharge nozzle resistance is $$R_n=\frac{8\mu L_n}{\pi r_n^4} \tag{11}$$

Furthermore, $R_p$ is the fluid resistance between the discharge nozzle opening (indicated by 18 in FIG. 1B) and the outer peripheral portion of the piston (piston outer periphery 14 in FIG. 1B).

$$R_p = \frac{6\mu}{h^3\pi}\ln\frac{r_0}{r_i} \tag{12}$$

As described before, $R_s$ is the fluid resistance between the outer peripheral portion of the piston (indicated by 14 in FIG. 1A) and the flow passage on the supply source side (suction port 7) (in the case where a thread groove pump is used, internal resistance of the thread groove pump+fluid resistance of the flow passage 15).

(1-2) Derivation of Fundamental Equations with Considerations of Fluid Compressibility As described before, the method for deriving the fundamental equations to draw the discharge pressure $P_i$ has already been described in the Specification of Japanese patent application No. 2003-341003 which was published as Unexamined Japanese Patent Publication No. 2004-141866 (U.S. patent application Ser. No. 10/673,495). As a result of the subsequent researches that had since been advanced under strict comparison between theoretical values and measured values of discharge pressure, it has been found that the compressibility of the coating fluid has a large effect on the 'sharpness' of high-speed intermittent discharge in the cases where:

<1> the frequency of intermittent discharge is set high;

<2> a multi-head is used;

<3> an effect of air bubbles mixed into the discharge fluid is not negligible; and <4> a high-elasticity material is used.

When the discharge apparatus is provided in a multi-head structure having a plurality of independent pistons, the total volume of flow passages that connect the individual pistons and the supply source to each other inevitably become larger, compared with the stand alone type (1 piston+1 nozzle type). In this case, if the fluid has slight compressibility, its effect is not negligible. The effect of the fluid capacitance on the 'sharpness' of discharge, which depends on that fluid compressibility and on the total volume of the flow passages, becomes increasingly noticeable with increasing frequency of intermittent discharge. This fluid compressibility is largely affected by, for example, mixing of air bubbles. In particular, with a high-viscosity fluid, air bubbles that have once mixed into the fluid could not be easily deaerated. Also, some kinds of adhesives, for example, rubber solutions, plastics, latex, and the like, are low in elastic modulus, requiring considerations of compressibility.

Here is assumed a fluid capacitance $C_h(=V_s/K)$ having a volume $V_s$ in the vicinity of the discharge-chamber end portion. Character K represents the modulus of elasticity of volume of the fluid. It is assumed that the fluid fed from the thread groove pump flows in as it is branched to this fluid capacitance and the discharge nozzle side.

$$Q_0 = Q_{01} + Q_{02} \tag{13}$$

$$Q_{02} = C_h\frac{dP}{dt} \tag{14}$$

Substituting Equation (13) for $Q_0$ in Equation (4) and putting the terms into order yields $$P_i + T\frac{dP_i}{dt} = \frac{R_n}{R_n + R_p + R_S}(P_{S0} + P_{squ1} + P_{squ2}) \tag{15}$$

where the time constant T is $$T = \frac{R_s R_n}{R_n + R_p + R_S}\frac{V_s}{K} \tag{16}$$

(1-3) Equivalent Circuit Model

Figure 2:
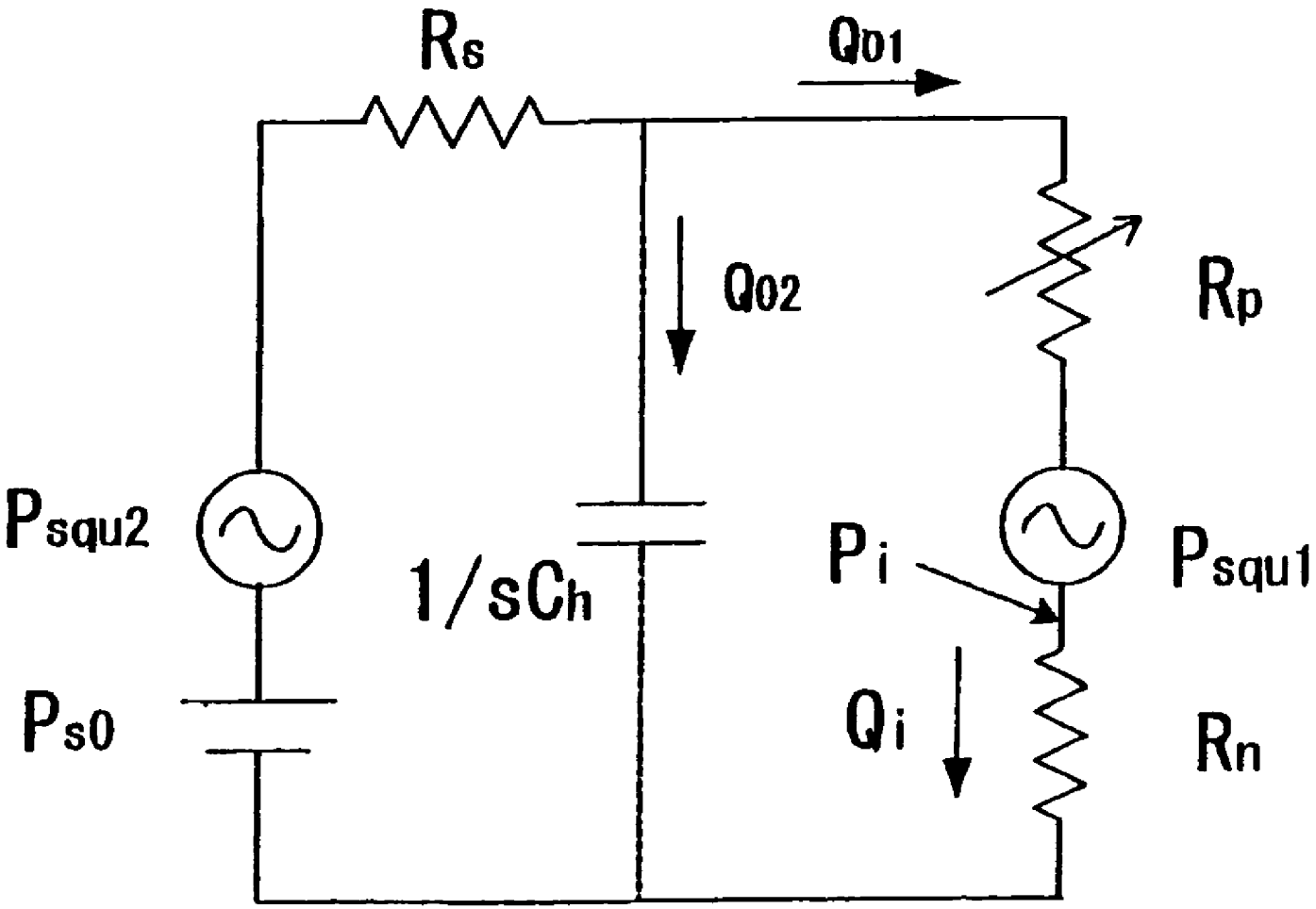
FIG. 2 is an equivalent electric circuit model of an example to which the present invention is applied.

Based on the above-described analysis results, the relationship between the pressure generation source and the load resistance can be expressed with an equivalent electric circuit model as shown in FIG. 2.

(1-4) When the Minimum Gap $h_{min}$ of the Piston End Face is Large Enough

Here is assumed a case where the high-speed intermittent discharge or the starting- and terminating-end control for continuous discharge is exercised by using only the secondary squeeze pressure. If $h\rightarrow\infty$, then $R_p\rightarrow 0$ from Equation (12) and $P_{squ1}\rightarrow 0$ from Equation (9) Equation (15) can be reduced as:

$$\begin{aligned} P_i + T\frac{dP_i}{dt} &= \frac{R_n}{R_n + R_S}\left[P_{S0} - R_S\pi(r_0^2 - r_i^2)\dot{h}(t)\right] \\ &= \frac{R_n}{R_n + R_S}P_{S0} - K_s\dot{h}(t) \end{aligned} \tag{17}$$

where $K_s$ is the proportional gain constant, and if the piston effective area is $S_p=\pi(r_0^2-r_i^2)$, it follows that $$K_s = \frac{R_n R_s}{R_n + R_S}S_p \tag{18}$$

[2] Conditions Under Which Discharge Fluid Can be Interrupted

Here a case is assumed where fluid bodies are continuously discharged onto the substrate while the discharge head and the substrate are being moved relative to each other. When displacement inputs of a pulse wave having an abrupt gradient are repeatedly given to the piston, the result is supposed to be that the waveform of the discharge pressure becomes a negative pressure immediately before the start of discharge, immediately thereafter shows generation of a positive pressure having a sharp peak, and goes again a negative pressure.

By the generation of the negative pressure immediately after the discharge, the fluid at the top end of the discharge nozzle is sucked again into the nozzle inside, being separated from the fluid present on the substrate or the fluid that is flying. That is, it is predicted that by the cycle of "negative pressure→positive pressure having an abrupt peak→negative pressure," an intermittent discharge of good sharpness can be fulfilled. The conditions can be summarized as follows:

<1> An abrupt positive peak pressure of a certain value or higher is generated; and <2> A negative pressure is generated before and after a positive peak pressure.

Hereinbelow, structural conditions and drive conditions of the head that allow the conditions <1> and <2> to hold are determined.

(2-1) Maximum and Minimum Values of Discharge Pressure

Figure 3:
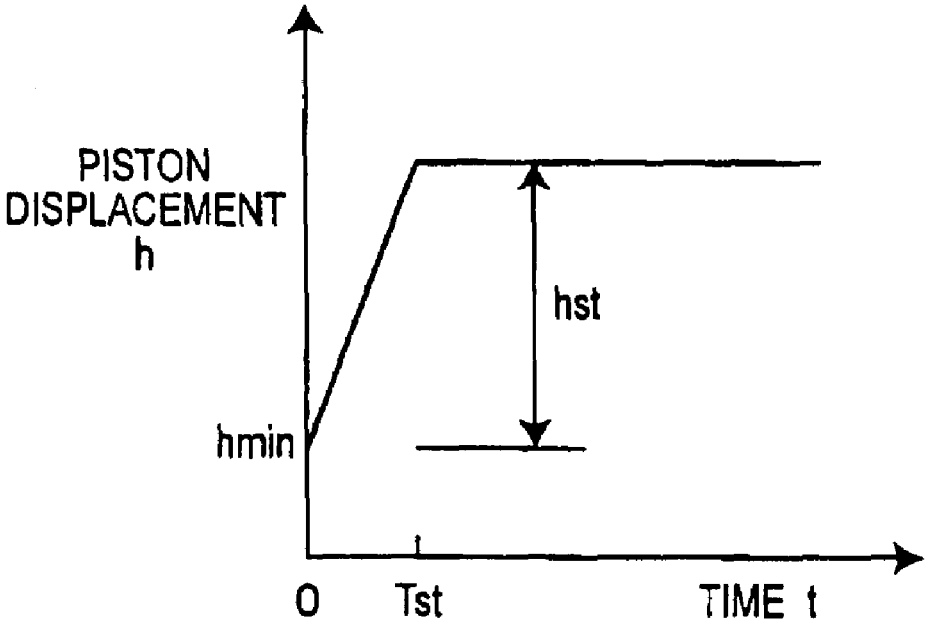
FIG. 3 is a graph showing piston displacement against time.
Figure 4:
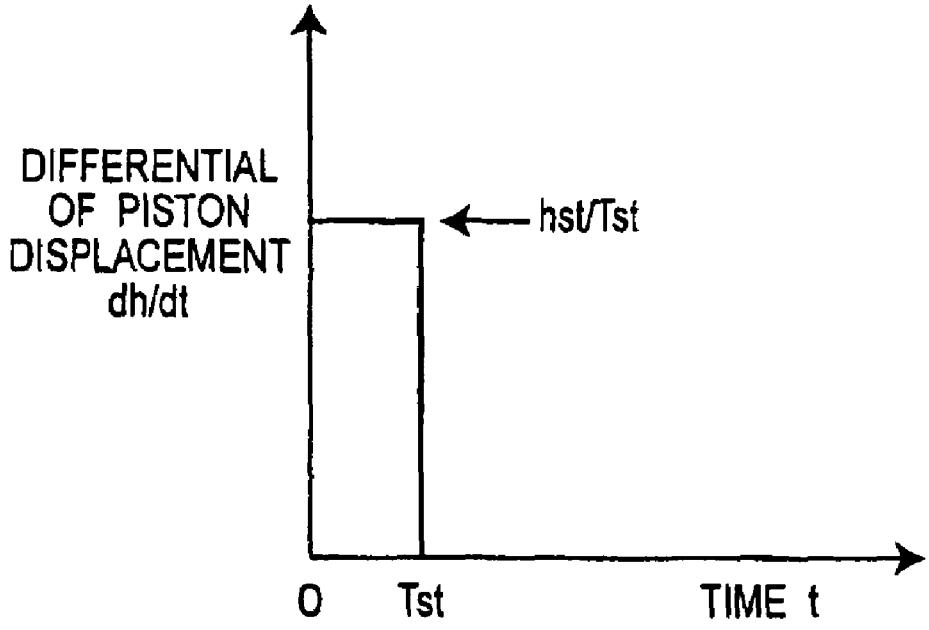
FIG. 4 is a graph showing a differential of piston displacement against time.

FIG. 3 shows a displacement input waveform h(t) of the piston. If $0 \leqq t \leqq T_{st}$, then the piston displacement is one expressed by a ramp function $h(t)=(h_{st}/T_{st})t+h_{min}$. If t>Tst, the piston displacement holds a constant value expressed by $h(t)=h_{st}+h_{min}$. As shown in FIG. 4, if $0 \leqq t \leqq T_{st}$, the differential dh/dt of the piston displacement is:

$$\dot{h}(t)=h_{st}/T_{st} \tag{19}$$

and if $t>T_{st}$, it is $$\dot{h}(t)=0 \tag{20}$$

Accordingly, in the time region ($0 \leqq t \leqq T_{st}$), the second term (forced input term) of the right side of Equation (17) takes step inputs, so that given an initial condition (t=0) of $P_i=P_{i0}$, it then follows:

$$P_i = P_{i0} - K_s \frac{h_{st}}{T_{st}}\left(1 - e^{-\frac{t}{T}}\right) \tag{21}$$

In Equation (17), when the piston descends (the gap decreases: $h_{st}<0$), i.e., when $h_{st}=-|h_{st}|$, the discharge pressure becomes a maximum value at $t=T_{st}$.

$$P_{i\max} = P_{i0} + K_s \frac{|h_{st}|}{T_{st}}\left(1 - e^{-\frac{T_{st}}{T}}\right) \tag{22}$$

Conversely, when the piston ascends (the gap increases: $h_{st}>0$), i.e., $h_{st}=|h_{st}|$, the discharge pressure becomes a minimum value at $t=T_{st}$.

$$P_{i\min} = P_{i0} + K_s \frac{|h_{st}|}{T_{st}}\left(1 - e^{-\frac{T_{st}}{T}}\right) \tag{23}$$

The maximum value (Equation 22) and the minimum value (Equation 23) of the discharge pressure are dependent on the initial value $P_i=P_{i0}$ of pressure. The maximum and minimum values of the discharge pressure are determined in the following two cases, respectively.

<1> When the cycle period of intermittent discharge is long enough, or when the starting and terminating ends of the continuous discharge line are intercepted and opened (FIGS. 5 and 6)<

Figure 7:
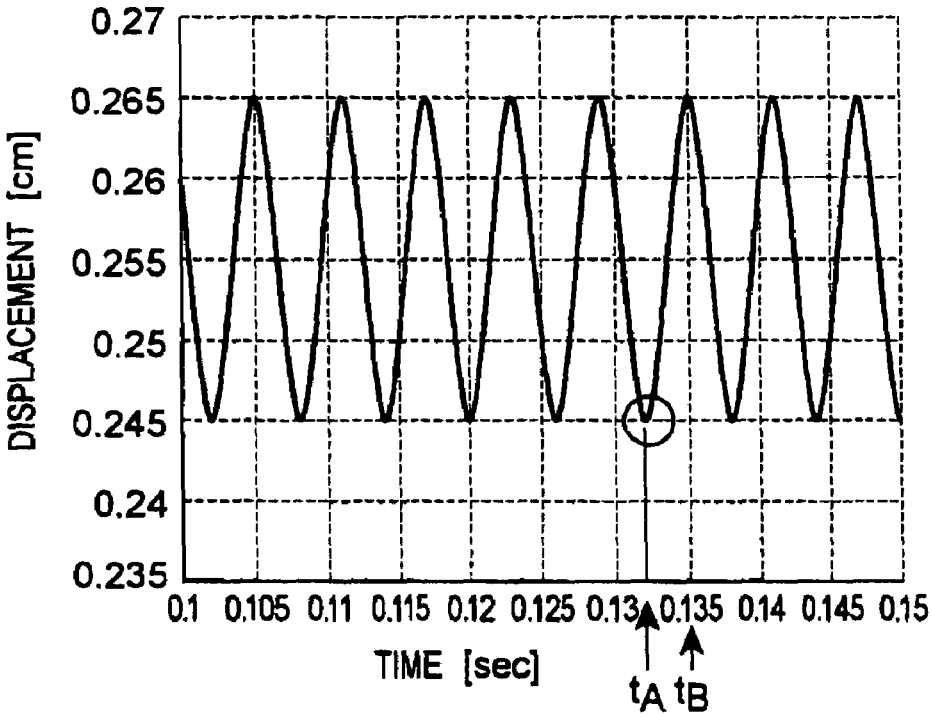
FIG. 7 is a graph of piston displacement against time with a short intermittence period.
Figure 8:
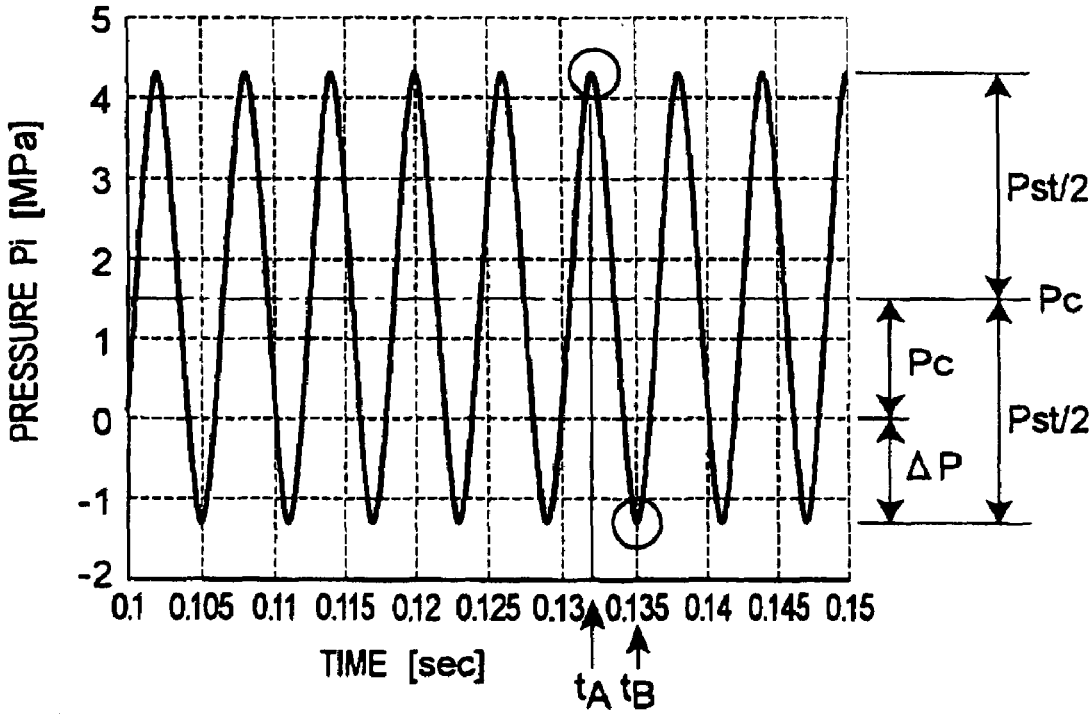
FIG. 8 is a graph of discharge pressure against time, given the piston displacement of FIG. 7.

2> When the cycle period of intermittent discharge is short enough (FIGS. 7 and 8)

Figure 5:
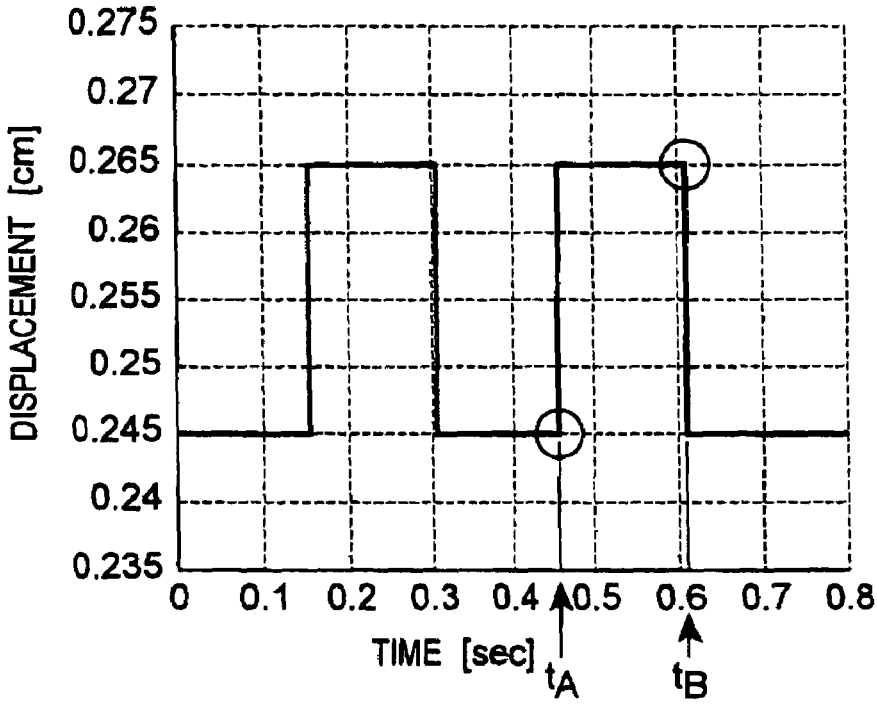
FIG. 5 is a graph of piston displacement with a long intermittence period.
Figure 6:
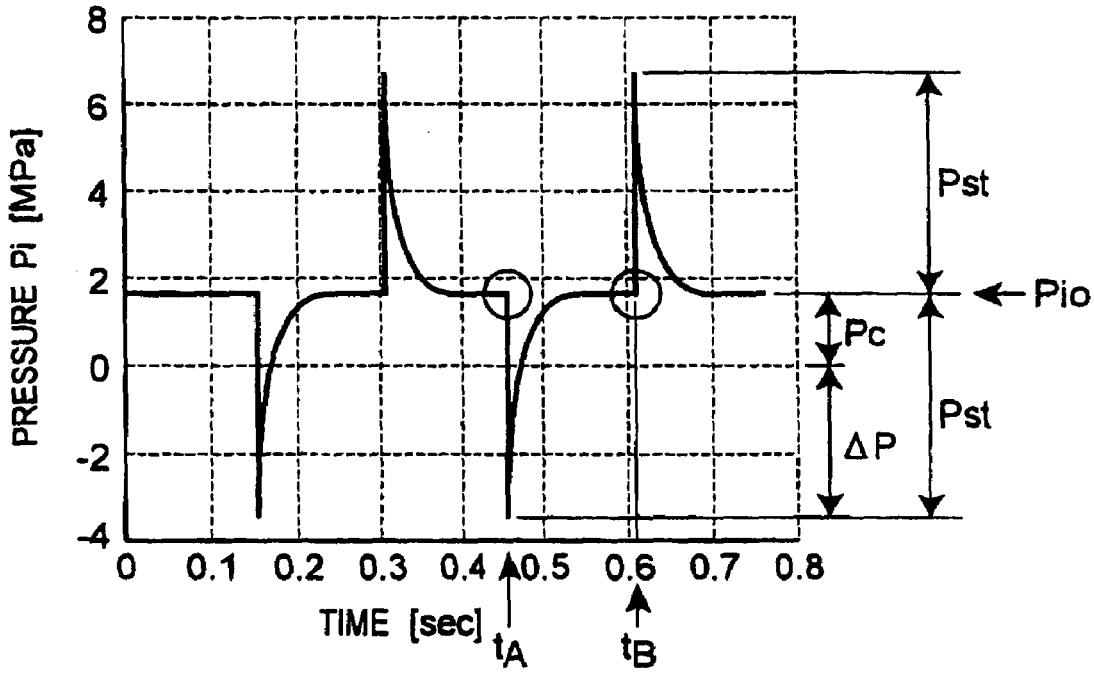
FIG. 6 is a graph of discharge pressure, given the piston displacement of FIG. 5.

FIG. 5 shows a piston displacement curve in the case of above <1> where the cycle period Tp of intermittent discharge is long enough, and FIG. 6 shows an analysis result of the discharge pressure waveform determined under the conditions of Table 1 and a period $T_P$=0.3 sec. The piston starts ascending at $t=t_A$, and immediately thereafter the discharge pressure becomes a minimum value. Also, the piston starts descending at $t=t_B$, and immediately thereafter the discharge pressure becomes a maximum value. In either case of the piston's start of ascent and descent, the following working point pressure $P_C$ that depends on thread groove characteristics and discharge nozzle resistance becomes the initial value $P_{i0}$.

$$P_{i0} = P_C = \frac{R_n}{R_n + R_S} P_{S0} \tag{24}$$

The term $P_C$ in Equation (24) is one for the case where $h_{min}$ is large enough. Therefore, the maximum pressure is $$P_{i\,max}=P_c+P_{st} \tag{25}$$

The minimum pressure is $$P_{i\,max}=P_c+P_{st} \tag{26}$$

where $$P_{st} = K_s \frac{|h_{st}|}{T_{st}}\left(1 - e^{-\frac{T_{st}}{T}}\right) \tag{27}$$

FIG. 7 shows a piston displacement curve in the case of above <2> where the cycle period $T_P$ of intermittent discharge is short enough, and FIG. 8 shows an analysis result of the discharge pressure waveform determined under the conditions of Table 1 and a period $T_P$=6 msec. The piston starts ascending at $t=t_A$, and immediately thereafter the discharge pressure becomes a minimum value. Also, the piston starts descending at $t=t_B$, and immediately thereafter the discharge pressure becomes a maximum value. The pressure $P_C$ that depends on the working point of thread groove characteristics and discharge nozzle resistance becomes a center value of the periodic pressure waveform. Therefore, the maximum pressure is $$P_{i\,max}=P_c+P_{st}/2 \tag{28}$$

The minimum pressure is $$P_{i\,min}=P_c-P_{st}/2 \tag{29}$$

(2-2) Conditions for generating Negative Pressure in High-Speed Intermittent Discharge Now a case of short-period high-speed intermittent discharge is considered. From Equation (29), the condition that enables the interception of discharge is that $P_{imin}<0$ immediately after a piston ascends, $$\frac{P_{st}}{2P_c} > 1 \tag{30}$$

An intermittent interception control parameter $\Pi_c$ ($=P_{st}/2P_C$) is defined as shown below. The time constant T has a value of $R_p \rightarrow 0$ set in Equation (16).

$$II_c = \frac{R_s S_p |h_{st}| \left(1 - e^{-\frac{T_{st}}{T}}\right)}{2P_{s0}T_{st}} \tag{31}$$

When $II_c$ satisfies the following condition, it results that $P_{imin}<0$ in Equation (29), enabling the interception of the discharge:

$$II_c>1 \tag{32}$$

Further, in Equation (31), if the piston rise time $T_{st}\rightarrow 0$, then there results a unit impulse (delta function) response. Assuming the intermittent interception control parameter in this case is $II_{c2}$, $$II_{c2} = \frac{(R_n + R_s)}{2R_n} \frac{S_p |h_{st}| K}{P_{s0} V_s} \tag{33}$$

then the interception condition is $II_{c2}>1$ similarly.

In the case where the piston can be driven at a high response of the order of several milliseconds by using an electromagnetostriction device such as ultra-magnetostriction device and piezoelectric device serving as one example of the axial drive device, the interception control parameter of Equation (31) in ramp response can be approximated to Equation (33) in impulse response.

(2-3) Conditions for Generating High Positive Peak Pressure in High-Speed Intermittent Discharge In order that the discharge fluid is securely transferred from the tip end of the discharge nozzle onto the substrate, it is a necessary condition that the squeeze pressure generated by a piston's down stroke has a sufficiently high positive peak value. If a sufficiently high positive peak pressure can be generated, the discharge fluid can be flown from the discharge nozzle so as to be discharged onto the substrate.

From discussion results of comparison between measured values of discharge pressure and discharge experiments, it has been found that for implementation of an intermittent discharge of good sharpness with use of a high-viscosity fluid of, for example, 100 mPa·s (cps) or more, the positive peak value $P_{imax}$ of discharge pressure needs to hold a certain value or higher, in addition to the aforementioned negative-pressure generation condition (Equation (32)).

However, since the discharge pressure cannot be measured in a state that the fluid has been let to flow out from the discharge nozzle, measurements were done with a pressure sensor fitted at a place where the discharge nozzle is set. In this case, since $R_n\rightarrow\infty$ and the center value of pressure waveform is $P_C\rightarrow P_{s0}$, $$P^*_{\text{imax}} = P_{s0} + \frac{P_{st}}{2} \tag{34}$$

Furthermore, if the piston rise time is $T_{st}\rightarrow 0$, there results a unit impulse (delta function) response. On account of time constant $T\rightarrow R_s V_s/K$ and gain constant $K_s\rightarrow R_s S_p$, $$P^*_{\text{imax}} = P_{s0} + \frac{S_p |h_{st}| K}{2V_s} \tag{35}$$

the results of the discharge experiments with the use of the dispenser made up according to Table 1 and under comparison of theoretical values and measured values of discharge pressure were as follows:

When $P^*_{imax}<2$ MPa (0.2 kg/mm$^2$) <1>

When the high-speed intermittent discharge was performed, fluid bodies discharged onto the substrate adjoin to one another among individual dots, and fully independent fluid bodies were not formed.

When 2 $MP_a<P^*_{imax}<3$ $MP_a$ <2>

When the gap between the discharge nozzle and its opposing surface was set small enough, fully independent fluid bodies were able to be transferred onto the substrate When $P^*_{imax}>3$ $MP_a$ (0.3 kg/mm$^2$) <3>

The fluid was able to be flown from the discharge nozzle so as to be securely transferred onto the substrate. In this case, the gap between the discharge nozzle and its opposing surface can be set large enough.

Figure 9:
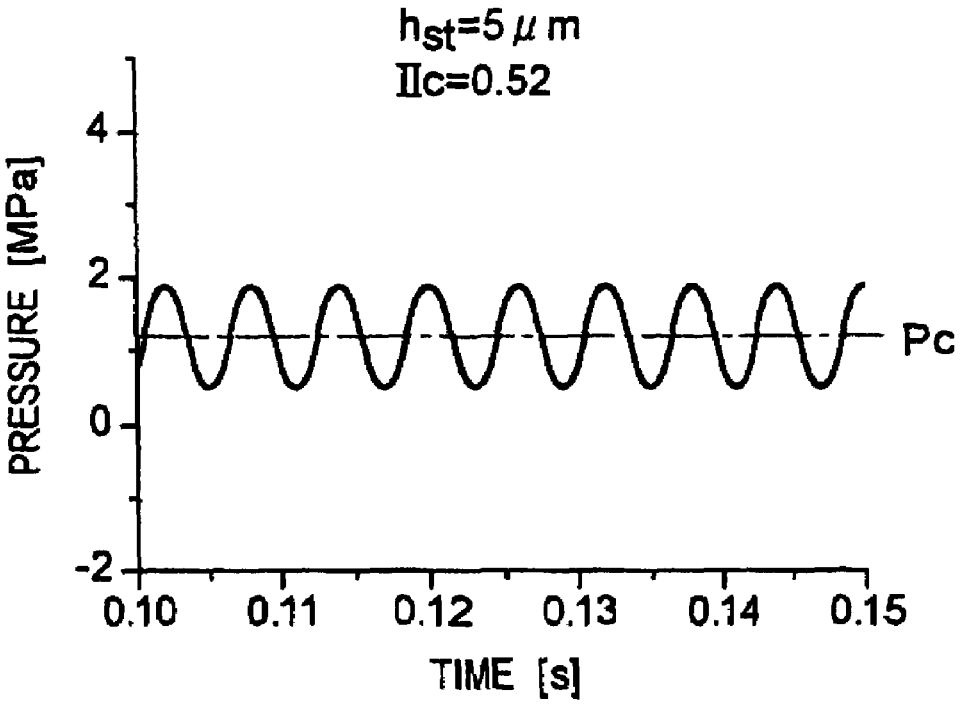
FIG. 9 is a graph of an analysis result of discharge pressure against time at a piston stroke of hst=5 μm.
Figure 10:
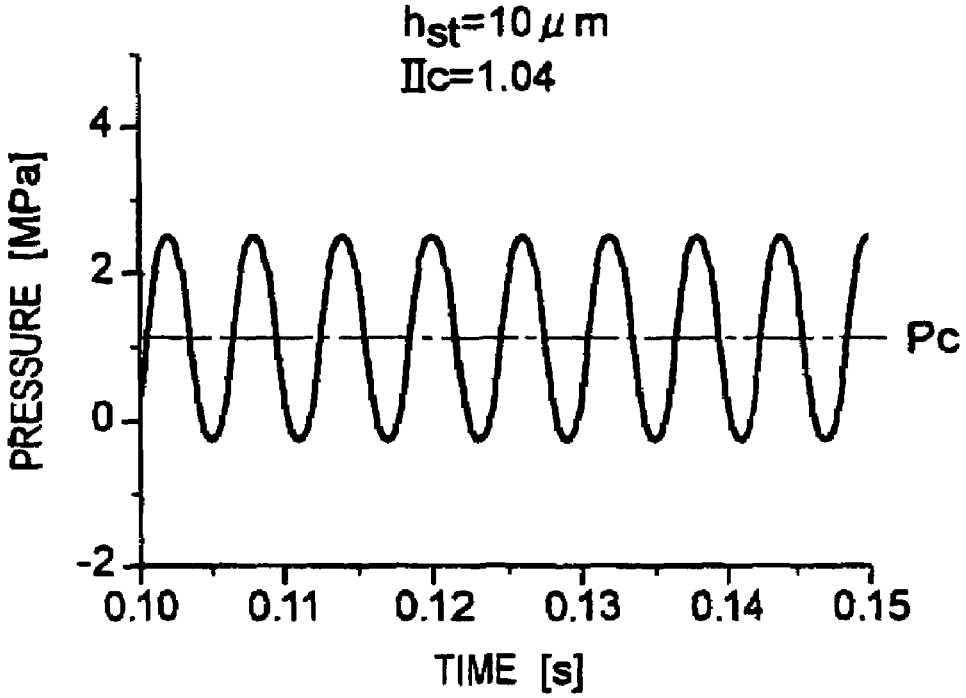
FIG. 10 is a graph of an analysis result of discharge pressure against time at a piston stroke of hst=10 μm.
Figure 11:
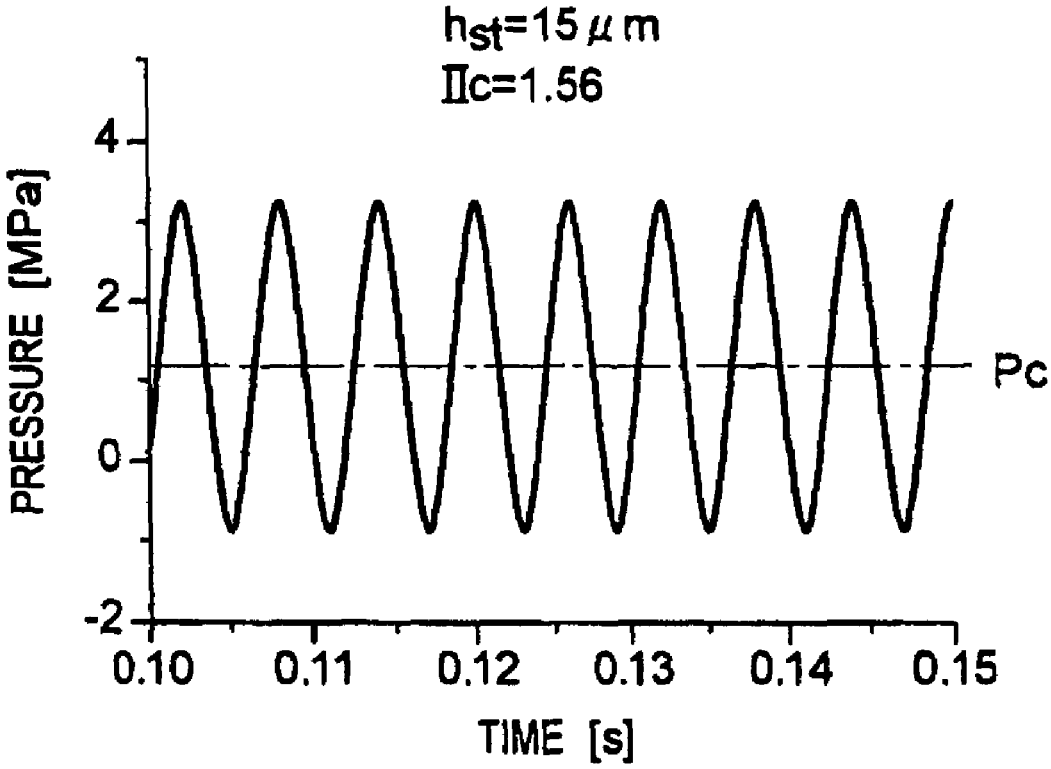
FIG. 11 is a graph of an analysis result of discharge pressure against time at a piston stroke of hst=15 μm.

[3] Evaluations by Concrete Application Examples (3-1) Interception Performance Evaluation by Intermittent Interception Control Parameter With a discharge head made up under the conditions of Table 1, analysis results of the discharge pressure waveform with the piston stroke $h_{st}$ varied in various ways are shown in FIGS. 9 to 11.

Also, results of determining the intermittent interception control parameter $II_c$ for each stroke by using Equation (31) are shown in Table 3. In addition, values of individual fluid resistance necessary to determine the parameter $II_c$ are shown in Table 2. Since the piston area (effective area of the relatively moving surface) is $S_P$=28.3 mm$^2$ and the air pressure (supplementary pressure) $P_{sup}$ for introducing the fluid material to the thread groove pump, smaller than the maximum pressure $P_{max}$ of the thread groove pump, is $P_{max}>>P_{sup}$, calculation was done under the condition that $P_{s0}\approx P_{max}$:

With $h_{st}$=5 μm, $P_{min}<0$ and $II_c$=0.52, showing that discharge interception is apparently impracticable. With $h_{st}$=10 μm, $P_{min}$ is around 0 $MP_a$ and $II_c$=1.04, showing that discharge interception is practicable but marginally so. With $h_{st}$=15 μm, $P_{min}<0$, showing a sufficient negative pressure state, where $II_c$=1.56 and discharge interception is practicable.

In addition, as can be seen from the pressure waveforms of FIGS. 9 to 11, the center value of each pressure waveform holds a constant value, $P_c$=1.2 MPa, regardless of the differences in piston stroke $h_{st}$.

Accordingly, in the dispenser of the above first embodiment, given a discharge nozzle resistance $R_n$, the center value $Q_c$ (=$P_c/R_n$) of the flow rate also holds a constant value. These center values of the pressure and flow rate are equal to the working-point pressure that depends on the thread-groove characteristics and the discharge nozzle resistance (see Equation (24) and FIG. 33) and the working-point flow rate, respectively. Therefore, in the first embodiment, the discharge amount per dot is equal to a value resulting from dividing the working-point flow rate by the intermittent frequency, independent of the piston stroke or the profile of the piston displacement waveform or the like. The reason of this is that since the piston-end-face minimum gap $h_{min}$ (=245 μm) is set large enough in one working example of the first embodiment (Table 1), only the secondary squeeze pressure $P_{squ2}$ (see Equation (9)) is effective and $P_{squ2}$ is determined only by a differential of the gap independently of the absolute value of the gap h.

That is, the action of the piston that generates the secondary squeeze pressure $P_{squ2}$ does not affect the discharge flow rate, and serves only for the roll as a D/A converter that converts thread-groove continuous flow rate (analog) to intermittent flow rate (digital).

The above-described findings, although already described in the Specification of Japanese patent application No. 2003-341003 which was published as Unexamined Japanese Patent Publication No. 2004-141866 (U.S. patent application Ser. No. 10/673,495), were able to be proved to be consistent even with the fluid compressibility taken into consideration, from the analysis results of FIGS. 9 to 11 in the present invention.

TABLE 1

| Parameters | | Symbol | Specifications |
|---|---|---|---|
| Viscosity | | $\mu$ | 600 mPa · s (cps) |
| Thread groove pump performance | Max. Flow rate | $Q_{max}$ | 9.71 $mm^3$/sec |
| | Max. Pressure | $P_{max}$ | 1.63 MPa (0.16 $kg/mm^2$) |
| Piston outer diameter | | $D_o$ | 6 mm |
| Min. gap of piston end face | | $h_{min}$ | 245 μm |
| Piston stroke | | $h_{st}$ | Separate sheet |
| Radius of discharge nozzle | | $r_n$ | 0.035 mm |
| Length of discharge nozzle | | $L_n$ | 0.5 mm |
| Flow passage volume | | $v_s$ | 67 $mm^3$ |

TABLE 2

| Parameter | Symbol | Specifications |
|---|---|---|
| Internal resistance of thread groove pump | $R_s$ | $1.65 \times 10^{-2}$ kgsec/$mm^5$ |
| Fluid resistance between discharge-nozzle opening and piston outer periphery | $R_p$ | $2.15 \times 10^{-5}$ kgsec/$mm^5$ |
| Fluid resistance of discharge nozzle | $R_n$ | $5.19 \times 10^{-2}$ kgsec/$mm^5$ |
| Time constant | T | 12.4 msec |

TABLE 3

| No | $h_{st}$ | $II_c$ | $II_{c2}$ | Discharge interception conditions |
|---|---|---|---|---|
| 1 | 5 μm | 0.52 | 0.58 | x |
| 2 | 10 | 1.04 | 1.16 | ○ |
| 3 | 15 | 1.56 | 1.75 | ◎ |

Where the modulus of elasticity of volume used in the analyses was K=68.5 $kg/mm^2$ in every case.

Generally, mineral oil, ester, water, or the like, which are taken as non-compressible, are regarded as being within a range of 50<K<200 $kg/mm^2$. Fluorescent material paste, electrode material, adhesive, and the like used for the discharge in this research had rather low values, for example, values of K=40 to 80 $kg/mm^2$, due to the effects of air bubbles mixed in their material compositions and the manufacturing processes.

The setting of the negative-pressure generation level, i.e. what specific value the intermittent interception control parameter $II_c$ is set, may be adjusted depending on the conditions of the applied processes and the characteristics of the discharge material (e.g., spinnability, which refers to an unlikeliness that the discharge line flowing out from the nozzle is cut off), and the like. When $II_c$=1, the minimum pressure $P_{imin}$=0 in Equation (29). As a result of the discharge experiments, it proved that the parameter values of $II_c$>1 suffice for practical use, and those of $II_c$>1.2 suffice more reliably.

(3-2) Negative-Pressure Generation Conditions and Peak Pressure Generation Conditions The negative-pressure generation condition $II_c$>1 (or $II_{c2}$>1) that can be evaluated by the intermittent interception control parameter is a common necessary condition for the fulfillment of high-sharpness intermittent discharge common regardless of applied processes, the kind of discharge material, viscosity characteristics, and the like. The magnitude of the parameter $II_c$ shows the interception performance of intermittent discharge.

Meanwhile, the peak-pressure generation condition differs depending on applied processes, the kind of discharge material, viscosity characteristics, and the like. For example, in the case where an adhesive material is discharged onto a circuit board and where so much is not required for the process time, there is no need for letting the fluid material fly from the discharge nozzle for its discharge onto the substrate. In this case, it is appropriate that the gap between the nozzle tip end and the substrate is set to H=50 to 100 μm or so, where enough time may be taken to transfer the material from the nozzle tip end onto the substrate, and there is no need for generating so high a peak pressure.

Further, even in the case of a process that involves discharging the material with enough gap H (e.g., H≧0.5 mm), there is no need for generating so high a peak pressure if the fluid viscosity is low.

Although details will be described later, in the case of high-speed discharge of a fluorescent material into the PDP independent cells, it is necessary to make the discharge material flow and discharge onto the substrate with enough distance H between the discharge nozzle and its opposing surface. Therefore, the negative-pressure generation condition and the peak-pressure generation condition were both necessary. That is, the peak-pressure generation condition shows the performance of the discharge material. Also in application to other discharge processes, for implementation of the intermittent discharge with H>0.5 mm, the negative-pressure generation condition and the peak-pressure generation condition were both necessary.

In the above-described application example of the present invention, with the piston end face gap set to a sufficiently large one, a continuous flow of fluid supplied from the fluid supply source is converted into an intermittent flow, from analog to digital form, and thus intermittently discharged, by using only the secondary squeeze pressure in a region less affected by the first squeeze pressure. In this case, the discharge amount per dot does not depend on the stroke or displacement of the piston, and is determined by a working-point flow rate $Q_C(=P_c/R_n)$ that depends on the pressure-flow rate characteristic of the pump, which is the fluid supply device, and the flow resistance of the discharge nozzle. Therefore, <1> The discharge amount per dot is constant;

<2> The cycle is constant; and

<3> Ultrahigh-speed intermittent discharge.

The present discharge method provides an extremely effective means for discharge processes that are required to meet the above conditions of <1> to <3> at the same time.

For example, the method is effective for the case where fluorescent materials of R, G, and B are intermittently discharged into box-type ribs of the rear side plate of a plasma display panel (hereinafter, referred to as PDP) for color display or other cases. In the case of PDP, box-type ribs are arranged symmetrically in a grid shape on the panel with high accuracy. In this case, a certain amount of material may be fed into the ribs at high speed at equal time intervals, which largely differs from dispensers that are widely used in circuit formation or the like. For example, when solder is discharged to a circuit board, the time interval of discharge is usually at random. In contrast, in the case of conventional air type dispensers, the discharge cycle is 0.05 to 0.1 sec. at most In conclusion, the above-described application example of the present invention has realized an ultrahigh-speed intermittent discharge of the order of several milliseconds or of 1 milliseconds or less by focusing on the "geometric symmetry" of the discharge object and by performing discharge process with this symmetry replaced by "time periodicity."

[4] Specific Embodiments

Figure 12:
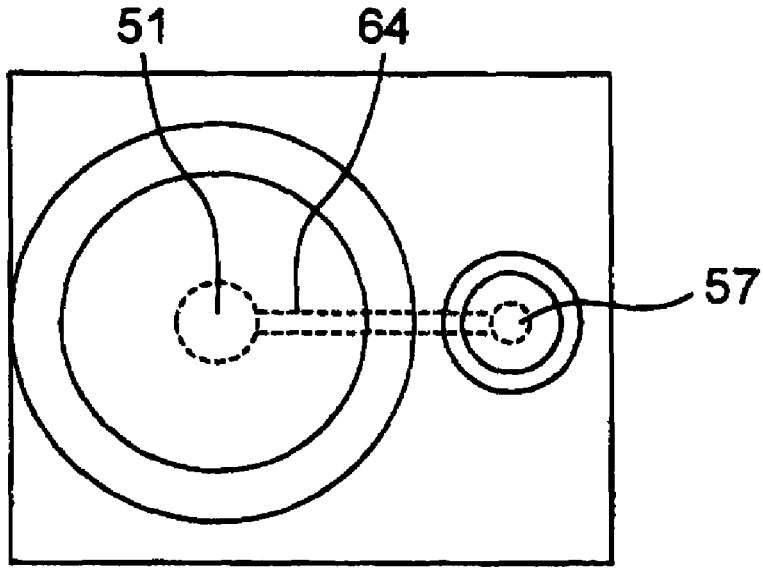
FIG. 12 is a top view showing one working example of a first embodiment of the present invention.
Figure 13:
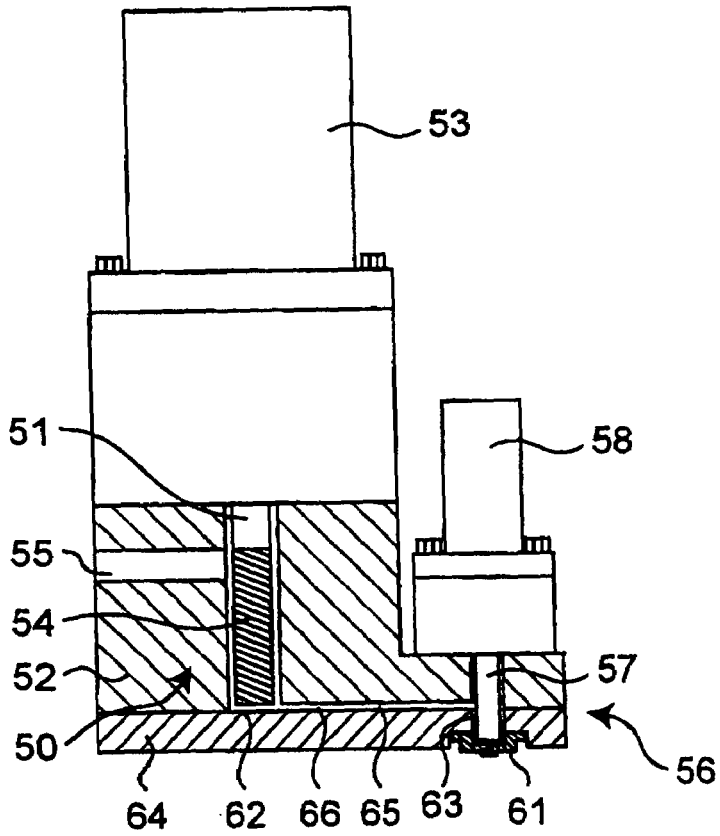
FIG. 13 is a partially-sectional front view showing the above working example of the first embodiment of the present invention.
Figure 14:
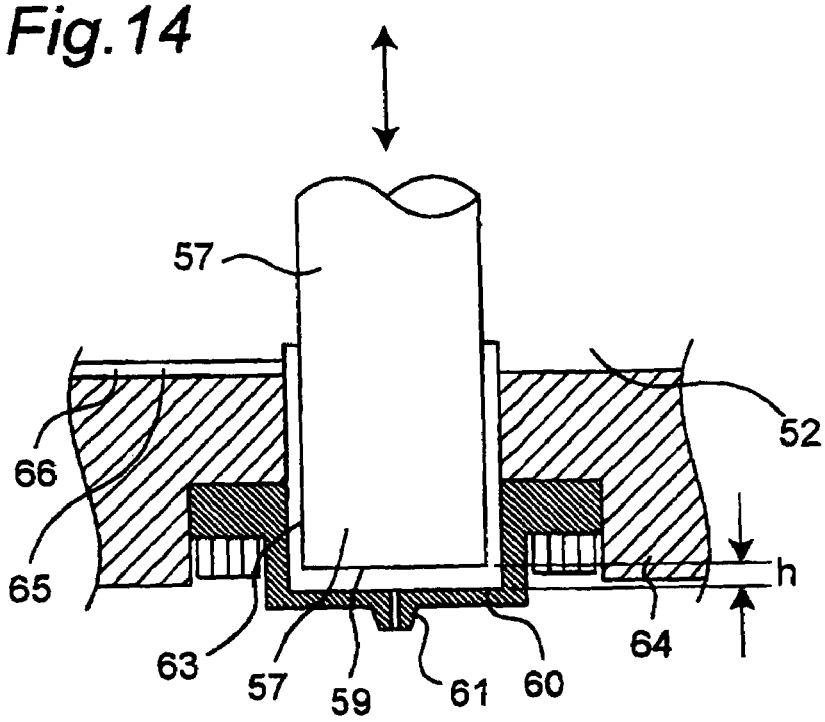
FIG. 14 is a partially-sectional enlarged view of the piston portion of FIG. 13.

FIGS. 12 and 13 show one working example of the first embodiment of the present invention. FIG. 14 is an enlarged view of the piston portion.

Reference numeral 50 denotes a thread groove pump portion, and 51 denotes a thread groove shaft, which is housed in a housing 52 so as to be movable in a rotational direction relative to the housing 52. The thread groove shaft 51 is rotationally driven by a motor 53, which is one example of a rotation transfer device. Numeral 54 denotes a thread groove formed in relatively moving surfaces of the thread groove shaft 51 and the housing 52, and 55 denotes a suction port of a fluid.

Numeral 56 denotes a piston portion, 57 denotes a piston, and 58 denotes a piezoelectric actuator, which is an axial drive device of the piston 57.

Numeral 59 denotes a piston end face of the piston 57, 60 denotes its fixed-side opposing surface, and 61 denotes a discharge nozzle. The piston end face 59 and the fixed-side opposing surface 60 serve as the two surfaces (discharge chamber) that move relative to each other along the gap direction.

The piezoelectric actuator 58 gives a change to the axial-direction relative positions of the piston 57 and the fixed-side opposing surface 60. By this piezoelectric actuator 58, the gap h between the piston end face 59 and its fixed-side opposing surface 60 can be changed. Numeral 62 denotes a thread-groove-shaft end portion, 63 denotes a piston outer periphery, 64 denotes a lower plate, and 65 denotes a flow passage that connects the thread-groove-shaft end portion 62 and the piston outer periphery 63 to each other, the flow passage 65 being formed between the housing 52 and the lower plate 64. A coating fluid 66 is fed to the piston outer periphery 63 via the flow passage 65 by the thread groove pump 50, which is a fluid supply device, at all times.

[5] Multi-Head Dispenser (5-1) Multi-Head

In either case of the above-described embodiments and examples of the dispenser or discharge apparatus, the dispenser or discharge apparatus is a single-head type dispenser or discharge apparatus in which the pump portion, which is the fluid supply device, and the piston drive portion are provided in one pair. Hereinbelow, measures for further improving the production cycle time of the head in the invention are described.

In the case of PDPs as an example, the fluorescent material layer to be formed on the front/rear face plate has been formed by the screen printing method, the photolithography method, or the like. There has been a strong desire for realizing a direct patterning method using a dispenser in order to solve the above-described issues related to the screen printing method and the photolithography method. However, even in cases where the fluorescent-material layer is formed on the panel screen with a dispenser, there is a demand for a production cycle time equivalent to that of the screen printing method.

In the case where the present invention is applied to a process that a fluorescent material is intermittently discharged into the box-type ribs, the dispenser's "being a multi-head type" becomes a necessary condition in addition to the above-described conditions of discharge process, <1> the discharge amount per dot is constant, <2> the cycle is constant, and <3> ultrahigh-speed discharge.

(5-2) Embodiments of Multi-Head Dispenser

Figures 15, 16:
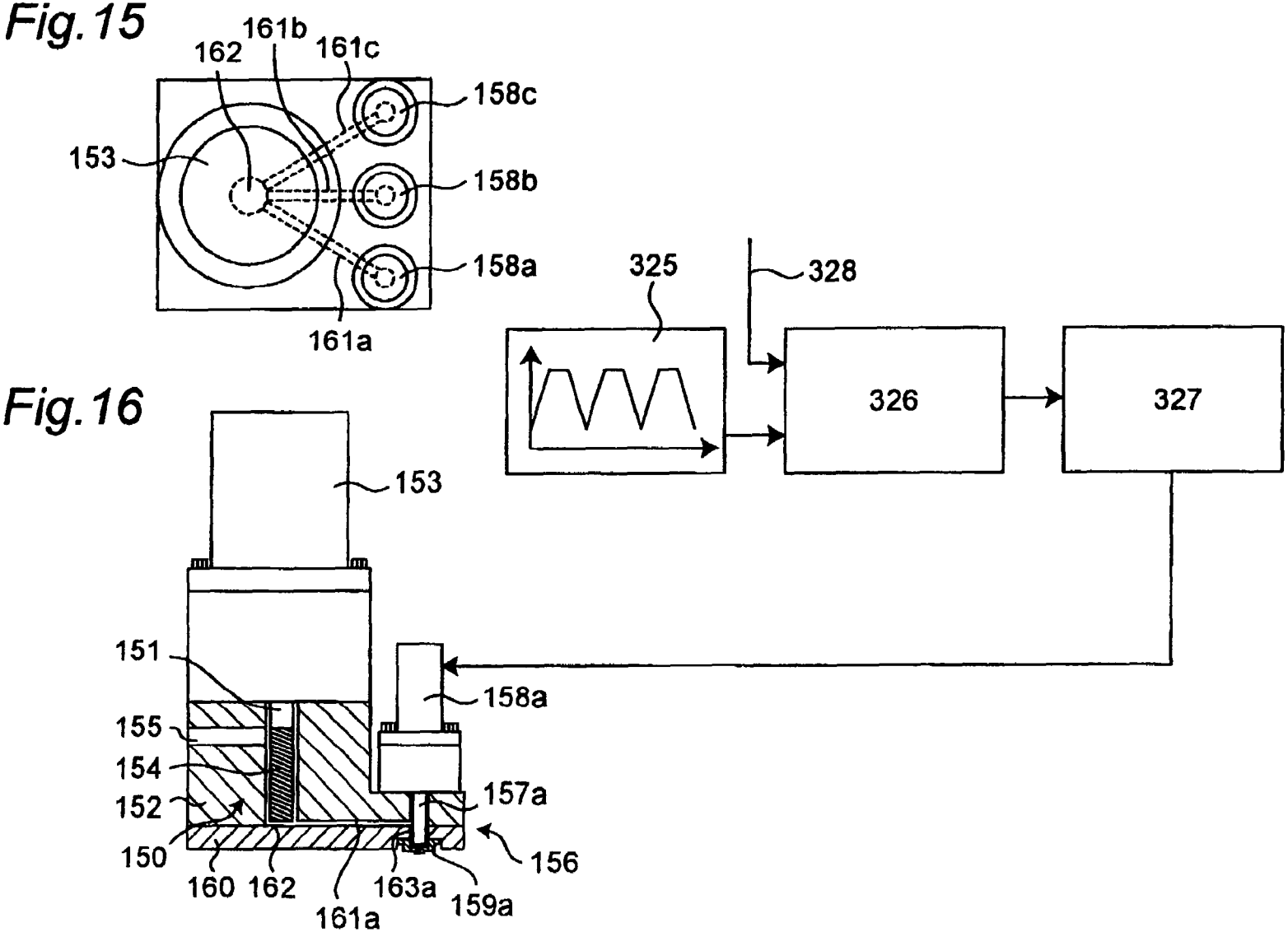
FIG. 15 is a top view showing a fluid discharge apparatus with a multi-head according to a second embodiment of the present invention.
FIG. 16 is a partially-sectional front view showing a fluid discharge apparatus with a multi-head according to a second embodiment of the present invention.

FIGS. 15 and 16 show a second embodiment of the present invention, showing a discharge apparatus (coating apparatus) having a multi-head. Numeral 150 denotes a thread groove pump portion, and 151 denotes a thread groove shaft, which is housed in a housing 152 so as to be movable in a rotational direction relative to the housing 152. The thread groove shaft 151 is rotationally driven by a motor, which is one example of a rotation transfer device 153. Numeral 154 denotes a thread groove formed in relatively moving surfaces of the thread groove shaft 151 and the housing 152, and 155 denotes a suction port of a fluid.

Numeral 156 denotes a piston portion, 157*a* denotes a piston, 158*a* denotes a piezoelectric actuator, which is one example of an axial drive device of the piston 157*a*, and 159*a* denotes a discharge nozzle. Numeral 160 denotes a lower plate, and 161*a* denotes a flow passage that connects the thread-groove-shaft end portion 162 and the piston outer periphery 163*a* to each other, the flow passage 161*a* being formed between the housing 152 and the lower plate lower plate 160.

In the piston portion 156 are arranged piezoelectric actuators 158*a*, 158*b*, 158*c* of the same structure, and pistons 157*a*, 157*b*, 157*c* which are driven by these actuators independently of one another. Fluid is supplied from the thread groove pump to the individual piston portions via three flow passages 161*a*, 161*b*, 161*c*.

In the case where the discharge apparatus is so formed that the pump portion, which is the fluid supply device, and the piston portions are separated from each other as shown in the second embodiment, and where the fluid is supplied in branches from one set of pump portion to a plurality of piston portions, there can be fulfilled a discharge head having multiple nozzles.

FIG. 16 shows a simplified view of an example of the control block diagram of this discharge apparatus. Reference numeral 325 denotes an instruction signal generator for driving the piezoelectric actuator 313, 326 denotes a controller, 327 denotes a driver, which is a drive power supply for the piezoelectric actuator 313, and 328 denotes positional information derived from a linear scale provided on a stage. Through the controller 326, the piezoelectric actuator 313 is driven by the driver 327 based on instruction signals as to predetermined rise and fall waveforms, intermittent cycle, amplitude, minimum gap, and the like of the piston, as well as on the information 328 derived from the linear scale that detects relative speed and relative position between the discharge apparatus and the substrate.

(5-3) General Construction of the Discharge Apparatus

As shown in the above embodiments and examples, with a construction that a plurality of piston drive portions are provided for one set of the pump portion, which is the fluid supply device, the apparatus as a whole can be downsized to a large extent. Although the pump portion, which is the fluid supply device, usually has limitations in downsizing, the piston drive portion allows a small-diameter piezoelectric actuator or the like to be used therefor, where a multi-head construction, when adopted, allows the pitch between the individual nozzles to be small enough.

However, an increased number of heads would cause the number of flow passages to increase, which in turn would cause the flow-passage total volume $V_s$ to increase, the time constant of the system (Equation (16)) to increase, and the 'sharpness' of discharge to deteriorate. Therefore, it is also allowable that the multi-head shown as an example in FIGS. 15 and 16 is used as a sub-unit to make up the discharge apparatus in combination of a plurality of the sub-units.

(5-4) Discharge Interception Conditions for Multi-Head Dispensers

Figure 17:
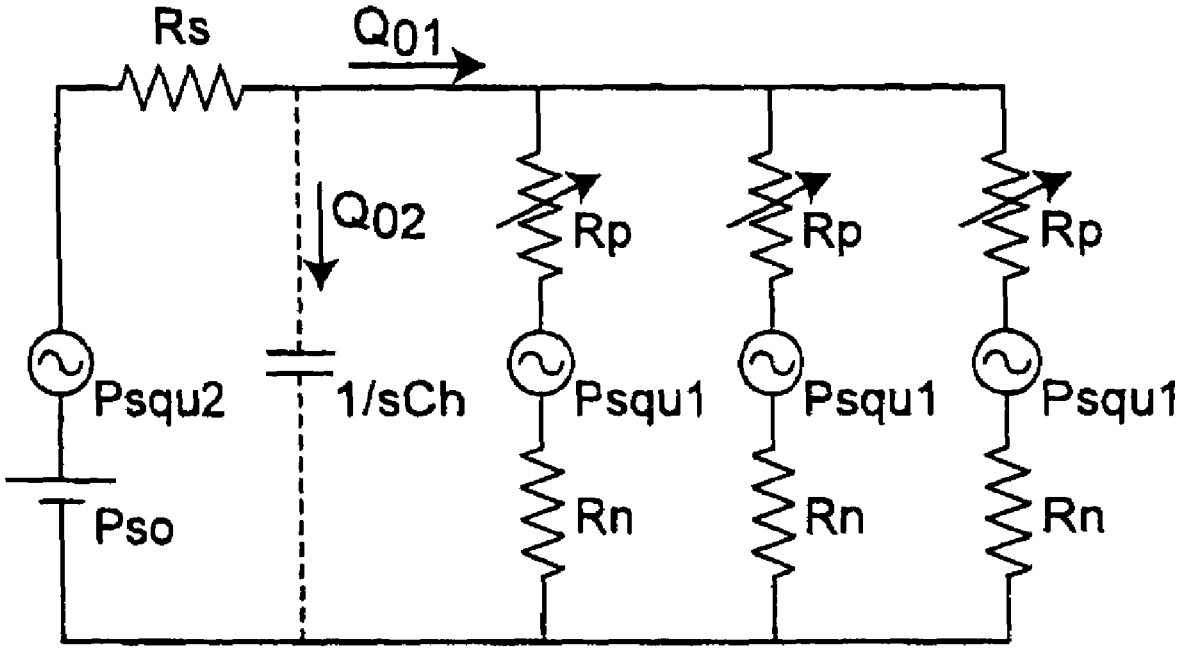
FIG. 17 is a view showing an equivalent electric circuit of a multi-head type fluid discharge apparatus.

The conditional equation that allows high-sharpness intermittent discharge, which is theoretically determined in the Item [2], needs compensating in the case of a multi-head dispenser. FIG. 17 shows an equivalent electric circuit in the case of a multi-head dispenser. Now assuming a case where the minimum gap $h_{min}$ of the piston end face is large enough, then $R_p \rightarrow 0$, $P_{squ1} \rightarrow 0$. If the number of pistons is n, then the individual nozzles are in a parallel arranged state, so that the fluid resistance of the whole nozzle portion is $R_n \rightarrow R_n/n$. In consideration of this point, each fundamental equation is corrected.

$$P_i + T\frac{dP_i}{dt} = \frac{R_n}{R_n + nR_S}\left[P_{SO} - R_S\pi(r_0^2 - r_i^2)\dot{h}(t)\right] = \frac{R_n}{R_n + nR_S}P_{SO} - K_s\dot{h}(t) \quad (36)$$

For the time constant T and the proportional gain constant $K_s$, the equations are as follows:

$$T = \frac{R_s R_n}{R_n + nR_S}\frac{V_s}{K} \quad (37)$$

$$K_s = \frac{R_n R_s}{R_n + nR_S}S_p \quad (38)$$

For the intermittent interception control parameter $II_c$, the time constant T of Equation (37) and the Equation (27) can appropriately be used.

In the case of unit impulse response, Equation (33) becomes as follows:

$$II_{c2} = \frac{(R_n + nR_s)}{2R_n}\frac{S_p|h_{st}|K}{P_{sO}V_s} \quad (39)$$

For the discharge maximum pressure $P^*_{imax}$ of Equation (34), it is appropriate to determine $P_{st}$ by using the time constant T of Equation (37).

Equation (35), which is a result of the unit impulse response can be used as it is.

Given m nozzles in correspondence to one piston, it is applicable that $R_n \rightarrow R_n/m$. If the fluid resistance differs among the individual nozzles, it may be assumed that the nozzles are arranged in parallel, and a parallel sum of fluid resistances may be determined. If $S_p$ and $h_{st}$ differ among the individual pistons, an average value of $S_p \times h_{st}$ may be used.

In the case of a multi-head shown as an example in FIGS. 15 and 16, it is preferable that the flow passages 161*a*-161*c* that connect the thread-groove-shaft end portion 162 and the piston outer periphery 163*a* to each other are so formed that their individual fluid resistances $R_r$ are equal to one another. This is applicable to continuous discharge as well without being limited to the intermittent discharge. Depending on process conditions, there are some cases where variations in flow rate among the individual nozzles have to be suppressed to several percent or less.

With the number of heads n=2, there are no problems since the flow passages can be provided in a symmetrical shape.

With n equal to three or more, even if the absolute values of the fluid resistances $R_r$ are set low enough by providing large enough opening cross-sectional areas of the flow passages, the differences among the fluid resistances result in flow rate variations among the nozzles. Therefore, it is necessary to give considerations to make the fluid resistances of the flow passages equal to one another.

Figure 18:
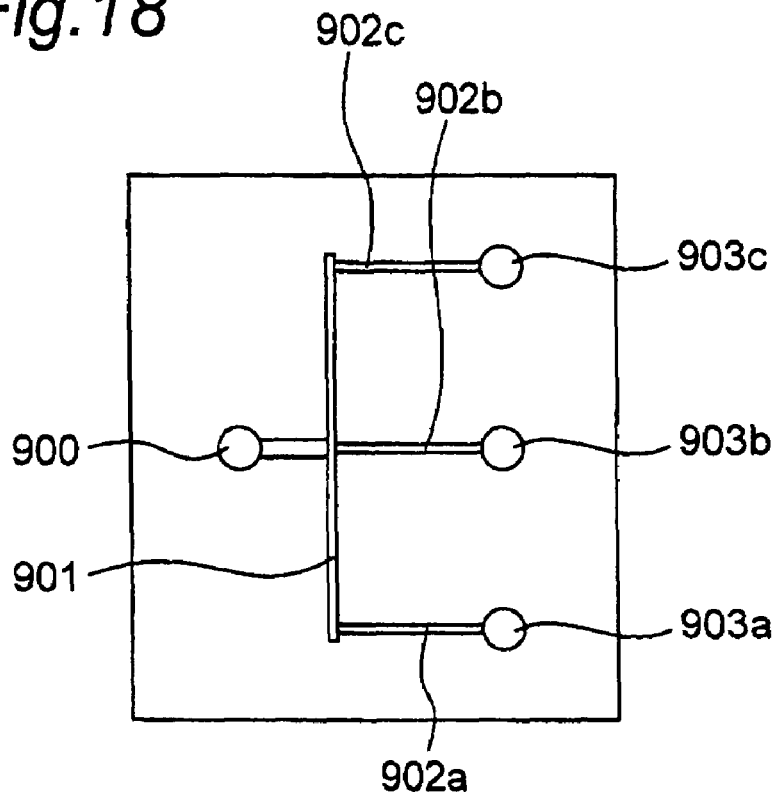
FIG. 18 is a view showing a working example of the flow passage.
Figure 19:
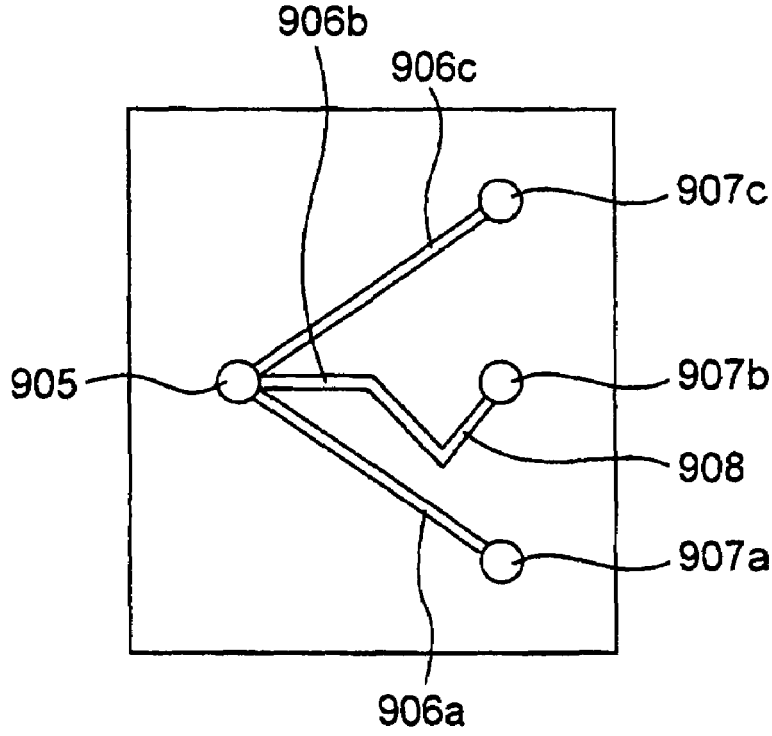
FIG. 19 is a view showing a working example of the flow passage.

In the case of FIG. 15, the flow passage 161*b* is shorter than the flow passages 161*a* and 161*c*, and therefore the lowest in fluid resistance thereamong. Accordingly, when the passages are formed with an identical cross-sectional shape, there may be a fear for variations in flow rate from the individual discharge nozzles. FIGS. 18 and 19 are ones showing the shapes of the flow passages that solve those flow-rate variations.

Referring to FIG. 18, reference numeral 900 denotes a thread-groove-shaft end portion, 901 denotes a common flow passage, 902*a*, 902*b* and 902*c* denote flow passages, and 903*a*, 903*b* and 903*c* denote piston outer peripheries. The flow-passage cross section of the common flow passage 901 is so formed that its flow passage width or depth is larger enough, compared with the flow-passage cross-sectional areas of the flow passages 902*a*, 902*b* and 902*c*.

Referring to FIG. 19, reference numeral 905 denotes a thread-groove-shaft end portion, 906*a*, 906*b* and 906*c* denote flow passages, and 907*a*, 907*b* and 907*c* denote piston outer peripheries. The flow passages 906*a*, 906*b* and 906*c* are so formed as to be identical in cross-sectional shape to one another. The flow passage 906*b* that connects the thread-groove-shaft end portion 905 and the piston outer periphery 907*b* to each other is given a bent portion 908 so as to be equal in length to the other flow passages. This formation of the bent portion 908 in the flow passage 907*b* in the multi-head makes it possible to minimize the total volume $V_S$ of the flow passages that connect the gaps between n sets of relatively moving surfaces and the fluid supply device to each other.

Thus, the formation of the bent portion is quite effective in enhancing the responsivity of discharge.

[6] Application Examples for PDP Fluorescent-Material Discharge

Figure 20:
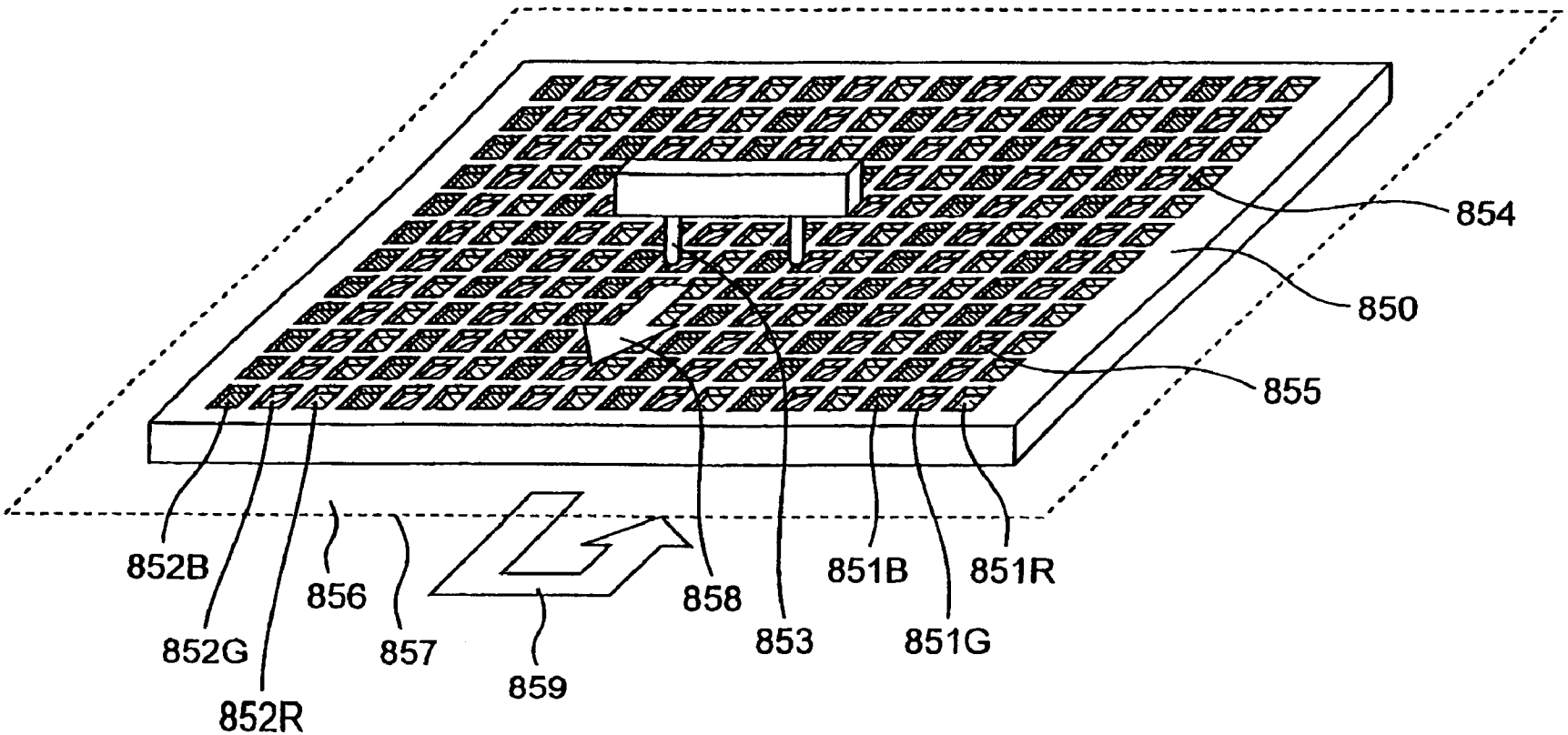
FIG. 20 is a perspective view of an assumed process in which the fluorescent material is inserted onward into the independent cells of a PDP.

Now, as shown in FIG. 20, a process is assumed in which the fluorescent material is inserted (implanted) repeatedly into the independent cells of a PDP while a dispenser of the present invention having multiple nozzles keeps relatively moving above the grid. Reference numeral 850 denotes a second substrate forming a rear side plate, and 851 denotes independent cells formed by barrier ribs. The independent cells 851 are composed of 851R, 851G and 851B into which fluorescent materials of R, G and B colors are inserted, respectively. As the fluorescent materials 852, a fluorescent material 852R of R color (Red), a fluorescent material 852G of G color (Green), and a fluorescent material 852B of B color (Blue) are used. In FIG. 20, only the nozzle portion of the dispenser is described, and the dispenser main body is not shown.

Figure 21:
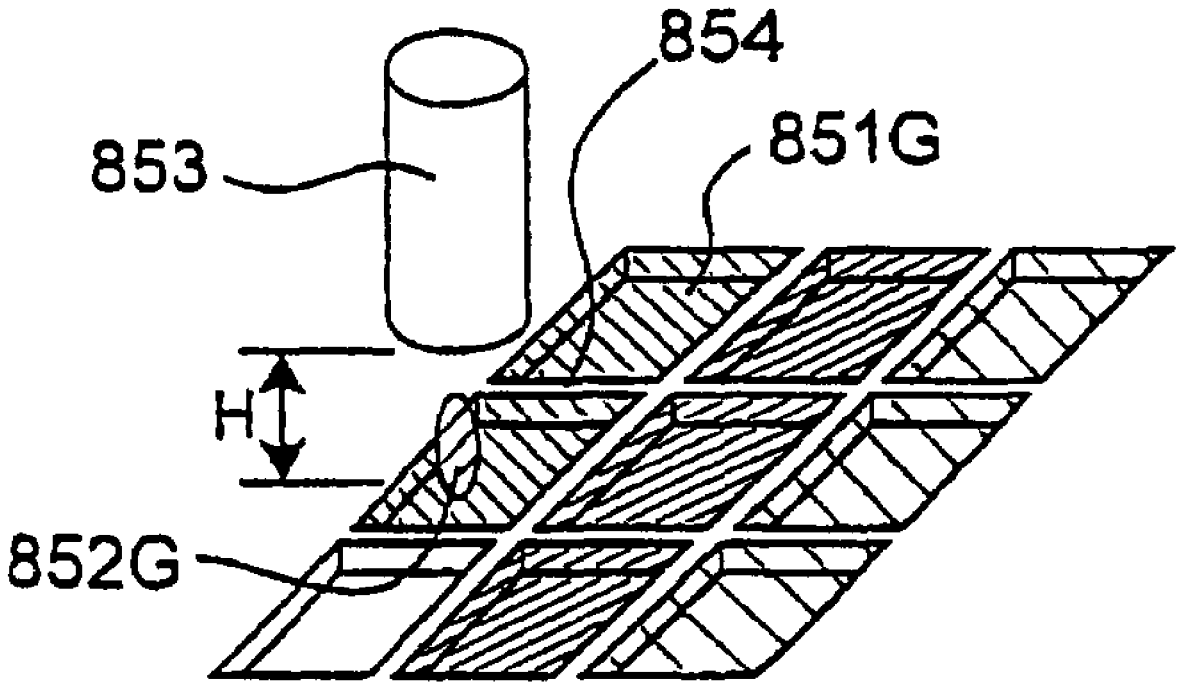
FIG. 21 is a partial enlarged view of FIG. 20.

Now attention is focused only on one nozzle 853. In this method of making the fluorescent material flown from the dispenser and thereby inserted into the independent cells repeatedly, a distance H between a tip end of the discharge nozzle 853 and a top of the barrier rib 854 needs to be maintained large enough as shown in the enlarged view of FIG. 21. The reason for this is as follows. The volume of a PDP independent cell is, e.g., in the case of this working example, V=0.65 mm long×0.25 mm wide×0.12 mm deep≈0.02 $mm^3$ or so, and the fluorescent material paste needs to be filled into the whole of this container. This is because through the filling and drying processes of the fluorescent-material discharge liquid and after the removal of volatile components, a thick fluorescent material needs to be formed on the inner walls of the cell as described before.

At the stage that the fluorescent material paste is being inserted into the cell, a high-viscosity paste would not be filled promptly into the whole cell container because of its poor fluidity. Its meniscus would be so formed that while a shape swollen higher than the barrier rib top 854 is maintained, the paste is filled thereinto from above. Accordingly, even at the stage that the discharge into the targeted cell has been completed, the meniscus has not been flattened. In event that the discharge nozzle 853 has its top put into contact with this swollen fluorescent-material meniscus on the way of the discharge, the liquid would adhere to the nozzle top, so that the fluid having flowed out from the nozzle would make causes of various troubles under the influence of the fluid bodies at the nozzle tip. Therefore, it is necessary to maintain a sufficient distance H between the tip end of the discharge nozzle 853 and the barrier rib top 854.

For the prevention of the liquid adhesion at the nozzle tip end, in this working example, it was necessary that H≧0.5 mm at least. Further, in the case where H≧1.0 mm, it was enough to prevent the liquid adhesion, where an intermittent discharge of high reliability for long time was able to be achieved.

It is the dispenser of the present invention which has made it possible to implement the method of aiming and blowing the fluid into a specified "independent cell" while the gap H between the tip end of the discharge nozzle 853 and its opposing surface is maintained large enough and while a high-viscosity powder and granular material is being flown, with a gap of the flow passage maintained larger enough than the particle size of the powder and granular material.

The features of the discharge apparatus and method using the present invention can be summarized that the apparatus and method is:

<1> capable of treating high-viscosity fluids of the order of several thousands to several tens of thousands mPa·s (cps);

<2> free from occurrence of clogging even with a discharge material having a powder size of several μm or more;

<3> implantable even with a short intermittent discharge cycle on the order of msec or lower;

<4> capable of making the discharge fluid flow a large distance from a point 0.5 to 1.0 mm or more distant from the discharge nozzle;

<5> capable of ensuring a discharge amount per dot with high precision; and

<6> capable of easily implementing a multi-head construction and simple in structure.

These points <1> to <6> are also necessary conditions for achieving the fluorescent-material layer of the independent cell method by direct patterning with the use of the dispenser, instead of the conventional screen printing method or photolithography method. Hereinbelow, the reasons why the points <1> to <6> are the necessary conditions, as well as the reasons why this dispenser has those features are additionally explained.

The reason why the point <1> is required in forming the fluorescent-material layer is that, as described before, a high-viscosity pasty fluid with a reduced amount of solvent needs to be used as the discharge material containing the fluorescent material in order to obtain a fluorescent-material layer of about 10 to 40 μm swollen thick on the rib wall surfaces after the discharge and drying processes. Also, one of the reasons why the present invention is applicable to high-viscosity fluids of the order of several thousands to several tens of thousands mPa·s (cps), more specifically, of the order of 5,000 to 100,000 mPa·s, is that, with the thread groove pump used as the fluid supply device in this embodiment of the present invention, a pumping pressure for pressure-feeding the high-viscosity fluid to the piston side (discharge chamber) can be easily obtained by this thread groove pump. Further, with a high-viscosity fluid used, since the squeeze pressure is proportional to the viscosity, a large discharge pressure is generated. Given a generated pressure of $P_i$=10 MPa and given a piston diameter of, for example, $D_o$=3 mm from Table 1, then an axial load f to be applied to the piston is $f=0.0015^2\times\pi\times10\times10^6\approx70$ N. In this embodiment, an electro-magnetostriction actuator of large withstanding load capable of enduring the above load is used on the piston side.

The reason why the point <2> is required in forming the fluorescent-material layer is that, as described before, fluorescent-material fine particles having particle sizes of the order of several microns are usually most suitable in order for the display to obtain high brightness. Also, the reason why the dispenser of the present invention is less liable to occurrence of clogging within the flow passage is that since the secondary squeeze pressure can be utilized, the minimum value $h_{min}$ of the gap between the piston and its opposing surface, where the clogging would be most likely to occur, can be set large enough than the particle size of the powder, for example, to $h_{min}$=50 to 150 μm, or more.

The reason why the point <3> is required in achieving the fluorescent-material layer of the independent cell method by direct patterning is as follows. That is, for example, in the case of a 42-inch wide PDP, if the number of pixels is 852RGB longitudinal×480 lateral, then the number of independent cells is 3×408960≈1,230,000 pcs. Assuming that the time $T_P$=30 sec is allowed for the discharge process of the fluorescent material and that 100 nozzles are mounted on the discharge apparatus, then the time per shot is $T_S=30\times100/1230000\approx0.0024$ sec. This value is not more than 1/100 of the responsivity of the conventional air type dispenser or thread groove type dispenser. Therefore, in consideration of mass productivity, a fast-response dispenser far beyond the conventional types is required.

One of the reasons why the dispenser of the present invention can fulfill the point <3> is that since the gap $h_{min}$ of the piston end face can be set to a large one, for example, 50-150

μm or more, so that the fluid resistance of the flow passage leading from the supply-source pump to the discharge chamber (a gap portion formed by 10 and 11 in FIG. 1) in the fluid filling process (suction process with the piston up) can be made as small as possible. Since the fluid resistance of the radial flow passage leading to the discharge nozzle is small, the filling time can be made short even in the case of high-viscosity fluids of poor fluidity.

Also, in this dispenser, an electro-magnetostriction actuator employing a piezoelectric element, ultra-magnetostriction element, or the like having high responsivity of, for example, 0.1 msec or less can be effectively used. Whereas the stroke of the electro-magnetostriction actuator is limited to about 30 to 50 μm as a practical-use level, the dispenser of the embodiment or example, by virtue of its using the secondary squeeze pressure, can produce a large pressure even in the state of a large gap $h_{min}$. The secondary squeeze pressure, as can be seen from Equation (12), depends only on the differential dh/dt (velocity) of the gap independently of the absolute value of the gap h. Accordingly, by taking advantage of an electro-magnetostriction actuator capable of obtaining a large velocity dh/dt, a discharge pressure having a high peak of 5 to 10 MPa or more at an acute, short cycle can be easily obtained.

The reason why the point <4> is required in forming the fluorescent-material layer by direct patterning is that, as described before, contact between the fluorescent-material meniscus, which is swollen upper than the barrier rib top, and the tip end of the discharge nozzle needs to be prevented on the way of discharge process. Further, the reason why the point <4> can be fulfilled is that, as described before, this dispenser can easily obtain a discharge pressure having an acute, high peak of 5 to 10 MPa or more by making use of the fast response of the electro-magnetostriction actuator. Use of a high peak pressure that overcomes the surface tension of the nozzle tip end allows even a high-viscosity fluid to be flown over a far distance.

The reason why the point <5> is required is that the accuracy for the fluorescent-material filling amount in the independent cell needs to be, for example, about ±5%. The reason why the point <5> can be fulfilled is that the discharge amount per dot in the intermittent discharge of this dispenser is, in principle, determined only by the "pressure—flow rate characteristics of the supply-source pump and the flow rate at the working point of the discharge nozzle fluid resistance" and the number of discharges per unit time, independently of the piston stroke, piston absolute position, or the viscosity of the discharge fluid. More concretely, with a thread groove pump used as the supply-source pump, a specified discharge amount per dot can be set only by changing the intermittent frequency and the rotating speed of the thread groove shaft In the case of a conventional type dispenser, since any of the piston stroke, absolute position, and the viscosity of the discharge fluid would largely affect the discharge amount, there is a need for strict control therefor. For example, in the case of an air type dispenser, the discharge amount is inversely proportional to the fluid viscosity.

The reason why the point <6> is required is that in the case of direct patterning, there is a need for mounting at least several tens of heads on the discharge apparatus. In order to substitute for the conventional engineering methods, the method is required to have maintenance properties comparable to the screen printing method or the photolithography method.

The reason why the point <6> can be fulfilled is that this discharge apparatus, as in the case of the above <5>, can make the discharge amount per dot in intermittent discharge less responsive to the piston stroke and absolute position, so that the piston drive portion (indicated by 2 of FIG. 1A) can be made simple in construction. That is, this dispenser is less required to meet the process control conditions such as high-precision machining of the relatively moving members (8 and 4 of FIG. 1A) in the piston drive portion, the correct positional alignment among members in assembly, and the ensured obtainment of the absolute accuracy of the piston stroke, which are those required for conventional dispensers. Accordingly, the multi-head as a whole that drives a plurality of pistons independently of one another can be greatly simplified.

[7] Actuator Part

The foregoing embodiment has been provided with a construction that the piston is driven by a piezoelectric actuator (exemplified by 158*a* of FIG. 16), which is a kind of electro-magnetostriction device as one example of the axial drive device.

As described before, this dispenser, by virtue of its capability of utilizing the secondary squeeze pressure, can generate a large discharge pressure even when the piston end face gap $h_{min}$ is set large enough. Therefore, in the present invention, drawbacks of electro-magnetostriction devices, which have limitations in stroke size, impose no restraints, and only the advantages of electro-magnetostriction devices having high response (large velocity) can be utilized. Since the gap $h_{min}$ can be set large enough, the time required for filling the high-viscosity fluid to the piston end face can be shortened. Accordingly, in the dispenser of the present invention, the use of an electro-magnetostriction device greatly contributes to improvement in responsivity (productivity) as a discharge apparatus.

In the case where the present invention is applied to a process that the fluorescent material is intermittently discharged into, for example, box-type ribs of a PDP, it is possible to use a resonant electro-magnetostriction device instead of a piezoelectric actuator as one example of the axial drive device, based on the utilization of the discharge-process conditions, i.e., <1> the discharge amount per dot has only to be a constant one and <2> the cycle may be constant, and with attention focused on the feature of this head that <3> the discharge flow rate can structurally be made independent of the piston stroke and displacement. The piezoelectric resonator can be utilized in various types such as disc type, prismatic type, cylindrical type, and Langevin type.

In this case, since the load of driving the piston can be reduced to a large extent, heat generation of the device can be reduced, thus allowing the actuator part to be simplified to a large extent. The resonance frequency of the system may be determined by utilizing the mechanical resonance point in consideration of the mass of the piston and the rigidity of the piston and the electro-magnetostriction device-supporting part.

In the case where this resonant oscillator is used for the multi-head, the method of correcting flow rate differences among the heads, as will be described later, may be to provide a semi-fixed fluid restriction resistor on the way of the flow passages.

[8] A Case Where a Two-Degree-of-Freedom Actuator is Used

The foregoing embodiments and examples have all been provided in a construction that the pump portion, which is the fluid supply source, and the piston portion are separated from each other.

The present invention is, of course, applicable also to the head structure using the already proposed ultra-magnetostriction device and a two-degree-of-freedom actuator driven by a motor (e.g., proposed Japanese unexamined patent publication No. 2002-1192) (U.S. Pat. No. 6,558,127) or the head structure that a thread groove and a piston are provided coaxially (e.g., proposed Japanese unexamined patent publication No. 2002-301414) (U.S. Pat. No. 6,679,685) FIG. 22 shows a third embodiment of the present invention.

Figure 22:
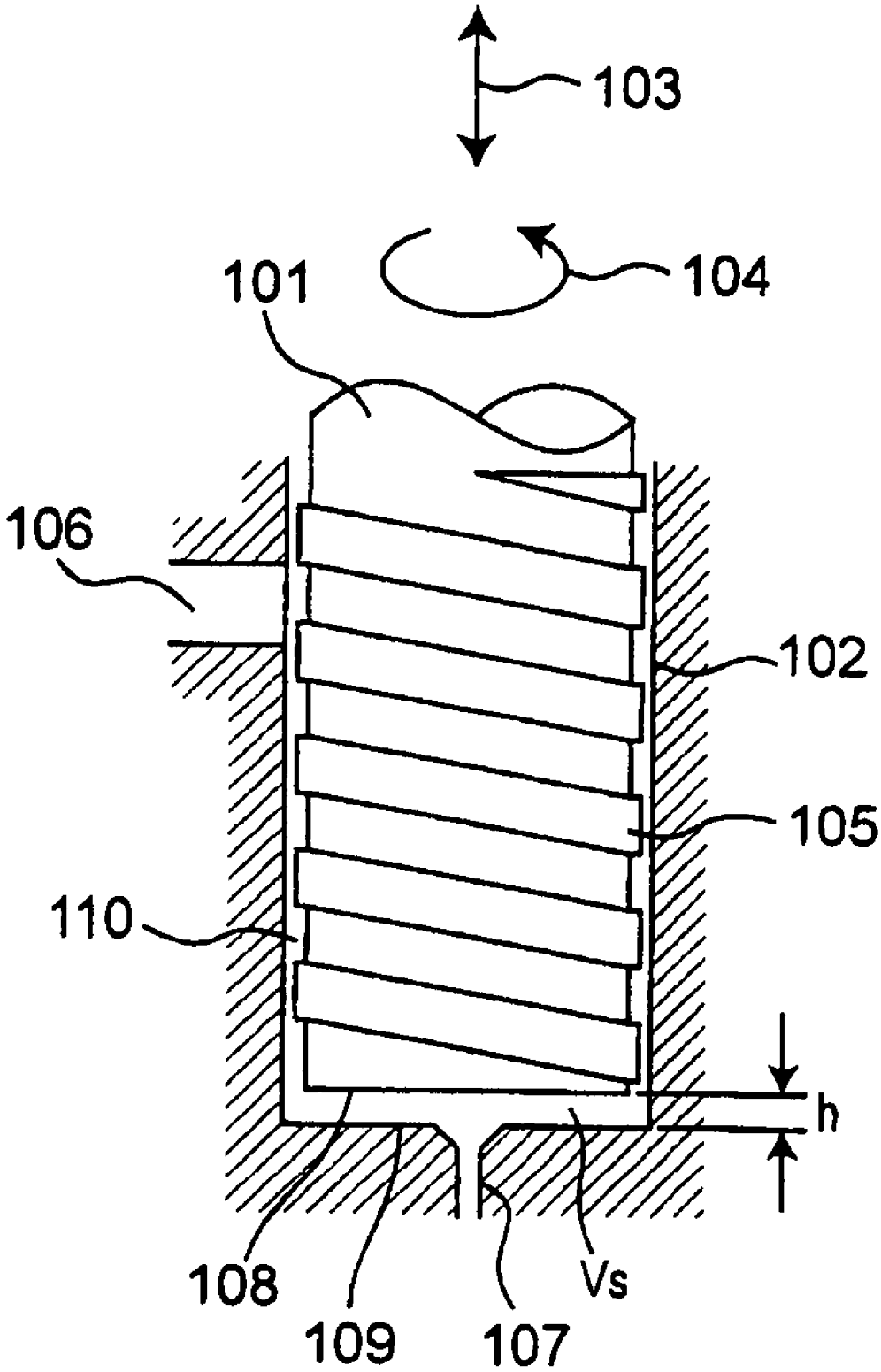
FIG. 22 is a front view showing a third embodiment of the present invention.

Referring to FIG. 22, reference numeral 101 denotes a piston, which is housed in a housing 102 so as to be movable in an axial direction and a rotational direction relative to the housing 102, which is the fixed side. The piston 101 is driven in the axial direction and the rotational direction by an axial drive device (arrow 103) such as a piezoelectric type actuator and a rotation transfer device (arrow 104) such as a motor, respectively and independently. Numeral 105 denotes a thread groove formed in relatively moving surfaces of the piston 101 and the housing 102, 106 denotes a suction port for fluid, and 107 denotes a discharge port In the third embodiment, the thread groove pump is used as the fluid supply device.

Numeral 108 denotes a discharge-side piston end face of the piston 101, and 109 denotes its fixed-side opposing surface. The piston end face 108 and the fixed-side opposing surface 109 serve as the two surfaces that move relative to each other along the gap direction.

Numeral 110 denotes a discharge fluid fed to between the piston 101 and the housing 102.

The flow-passage volume $V_S$ in this case is equal to the volume of the void between the piston end face 108 and the fixed-side opposing surface 109. With the use of this structure, since the total $V_2$ of the flow passage that connect the gap between the relatively moving surfaces and the fluid supply device can be set to $V_2 \rightarrow 0$, there are great advantages in terms of negative-pressure generation condition (intercept performance), peak-pressure generation condition (fly performance), and time constant (production cycle time).

[9] Applying to Continuous Discharge

Figure 23A:
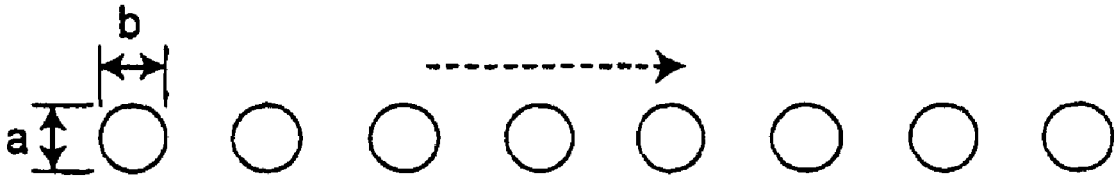
FIG. 23A is a view showing a discharge pattern of intermittent discharge.

In this specification and claims, the intermittent discharge and the continuous discharge are defined from the shape of the discharge pattern immediately after the discharge onto the substrate. As shown in FIG. 23A, given a pattern width 'a' in a direction vertical to the relative moving direction (indicated by an arrow in the figure) of the discharge nozzle and the substrate as well as a length 'b' thereof in the moving direction, a case of a≈b is defined as an intermittent discharge. Otherwise, a case where the discharge pattern is formed in a shape generally proportional to the internal shape of the discharge nozzle is also assumed as an intermittent discharge similarly. For example, when the internal surface of the discharge nozzle is elliptical shaped, the pattern of the intermittent discharge results in an elliptical shape as well.

Figure 23B:
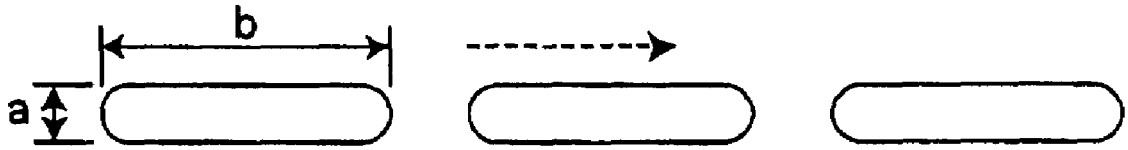
FIG. 23B is a view showing a discharge pattern of continuous discharge.

As shown in FIG. 23B, given a pattern width 'a' in a direction vertical to the relative moving direction as well as a length 'b' thereof in the moving direction, a case of a<b is assumed as an intermittent discharge.

The present invention is applicable also to such continuous discharges as a case where fluorescent-material screen stripes, electrode lines, or the like are drawn on the display surface (i.e. a case of a <<b). The greatest issue of high-speed continuous discharge lies in a high-grade discharge of starting- and terminating-ends of the drawn line. More specifically, the issues are:

<1> At a start of discharge process, there occurs no 'thinning,' 'cut', or the like at the starting point of the discharge line.

<2> At an end of discharge, likewise, there occurs no 'thickening,' 'residing', or the like at the end point of the discharge line.

Figure 24:
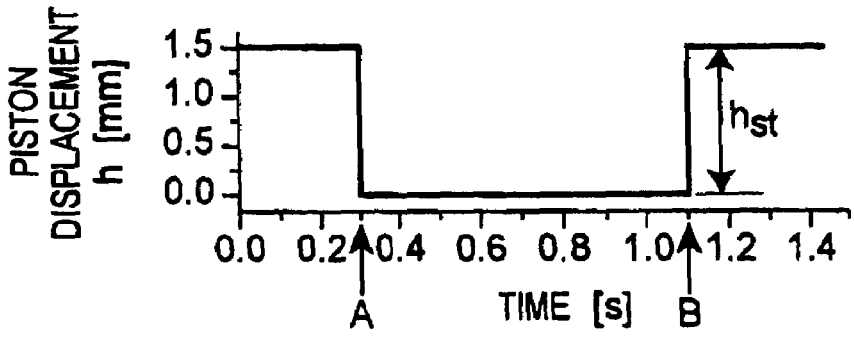
FIG. 24 is a graph showing displacement h of the piston against time t in continuous discharge.
Figure 25:
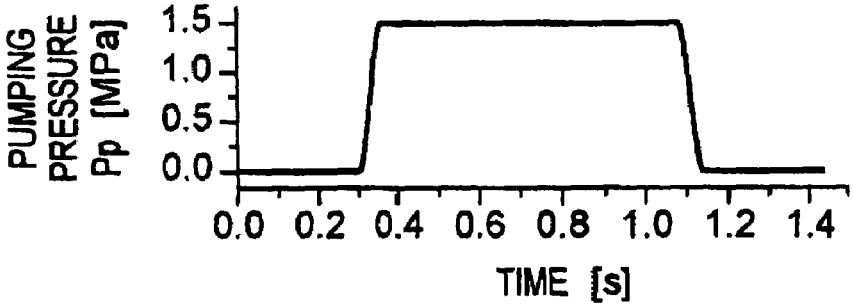
FIG. 25 is a graph showing pumping pressure $P_p$ of a thread groove pump against time t in continuous discharge.
Figure 26:
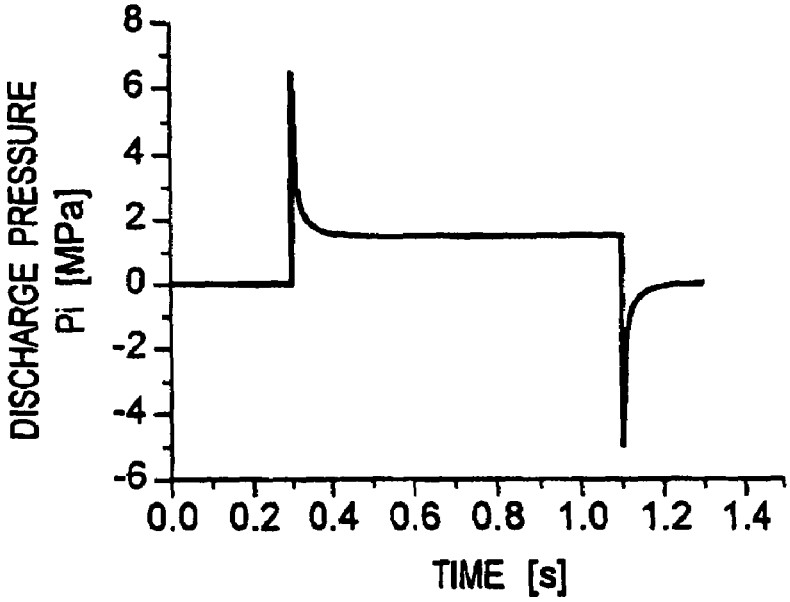
FIG. 26 is a graph showing discharge pressure $P_i$ against time t in continuous discharge.

In order to fulfill the above <1> and <2>, we have already proposed a starting- and terminating-end control method using squeeze pressure. FIGS. 24, 25, and 26 show characteristics of piston displacement h, thread-groove-pump pumping pressure $P_p$, and discharge pressure $P_i$, respectively, relative to time t. By taking advantage of the possibility that the piston driven by an electro-magnetostriction element as one example of an axial drive device can perform high-speed linear motion, (i) at the start of discharge (t=A), simultaneously when the piston is moved down, the motor for the thread groove pump is started rotating; and (ii) at the end of discharge (t=B), simultaneously when the piston is rapidly moved up, the motor for the thread groove pump is stopped from rotating.

In the above (ii), the condition under which a negative pressure is generated to the discharge pressure $P_i$, i.e. the condition under which $P_{min}<0$ in Equation (26), is:

$$\frac{P_{st}}{P_c} > 1 \tag{40}$$

Here is defined a continuous interception control parameter $CI_c$ ($=P_{st}/P_c$) as shown below. For the time constant T, Equation (16) is used.

$$CI_c = \frac{R_s S_p |h_{st}| \left(1 - e^{-\frac{T_{st}}{T}}\right)}{P_{s0} T_{st}} \tag{41}$$

When $CI_c$ satisfies the following condition, it results that $P_{min}<0$ in Equation (26), where the terminating end of the continuous discharge line can be intercepted:

$$CI_c > 1 \tag{42}$$

The foregoing many findings and devised ideas obtained on the subject of intermittent discharge are applicable also to continuous discharge. The case being the same also with a multi-head, the time constant T in Equation (41) may be given by using Equation (37) or later-described Equation (44).

In the case where the piston can be driven at a high response of the order of several milliseconds by using an electromagnetostriction element such as ultra-magnetostriction element and piezoelectric element, the interception control parameter of Equation (31) in ramp response can be approximated to Equation (33) in impulse response.

[10] Responsivity of Discharge Apparatus

As already described, the conditions that the present invention has found, such as the intermittent interception control parameter $II_c>1$, continuous interception control parameter $CI_c>1$, have been ones for describing discharge conditions for implementing a high-grade discharge, including the dispenser drive conditions (piston stroke $h_{st}$, period T, piston movement time $T_{st}$, etc.).

Hereinbelow, except the dispenser drive conditions (software), fundamental responsibility of the discharge apparatus (hardware) to which the present invention is applied is evaluated. For this purpose, evaluation indices (time constant) that allow the responsibility of the discharge apparatus to be comprehensively evaluated including the following cases are summarized:

<1> A case of multi-head dispenser;

<2> A case of no limitation in the size of the piston end face minimum gap;

<3> A case of no limitation to intermittent discharge or continuous discharge.

From Equations (36) and (15), which are derived to determine the interception conditions on a multi-head, $$P_i + T\frac{dP_i}{dt} = \frac{R_n}{R_n + R_p + nR_S}(P_{S0} + P_{squ1} + P_{squ2}) \quad (43)$$

where the time constant $T$ is $$T = \frac{R_S R_n}{R_n + R_p + nR_s}\frac{V_s}{K} \quad (44)$$

In Equation (44), with reference to FIG. 15, $V_S$ is a sum of the volume of the piston end face portion and the volume of all the flow passages (161*a*-161*c*) that connect the piston end face portion and the fluid supply device (thread groove pump). The term $R_p$ is a function of the gap h, where a gap minimum value $h=h_{min}$ or an average value of gaps is used. When the fluid resistance $R_r$ of the flow passages is not negligible, as is the case also in determining the intermittent interception control parameter $II_c$ or the like, it is assumed that $R_S \rightarrow R_S + R_r/n$, which results from adding the fluid resistance of the flow passage to the internal resistance $R_S$ of the fluid supply device, by taking into consideration that the flow rate of each of the n flow passages is 1/n of the total flow rate of the fluid supply device.

Also, in a case where m discharge nozzles are provided for each of n pistons, since the fluid resistance of the discharge nozzles becomes a parallel sum, it may be assumed that $R_n \rightarrow R_n/m$.

Here are shown, in Table 4, results of determining the time constant T from the parameters in the conditions of Table 1.

TABLE 4

| Parameter | Symbol | Specifications |
|---|---|---|
| Internal resistance of thread groove pump | $R_s$ | $1.65 \times 10^{-2}$ kgsec/mm$^5$ |
| Fluid resistance of piston end face | $R_p$ | $2.15 \times 10^{-5}$ kgsec/mm$^5$ |
| Discharge nozzle resistance | $R_n$ | $5.19 \times 10^{-2}$ kgsec/mm$^5$ |
| Sum of piston end face and flow passage volumes | $V_s$ | 73.9 mm$^3$ |
| Number of pistons | n | 1 |
| Time constant | T | 13.4 msec |

Figure 27:
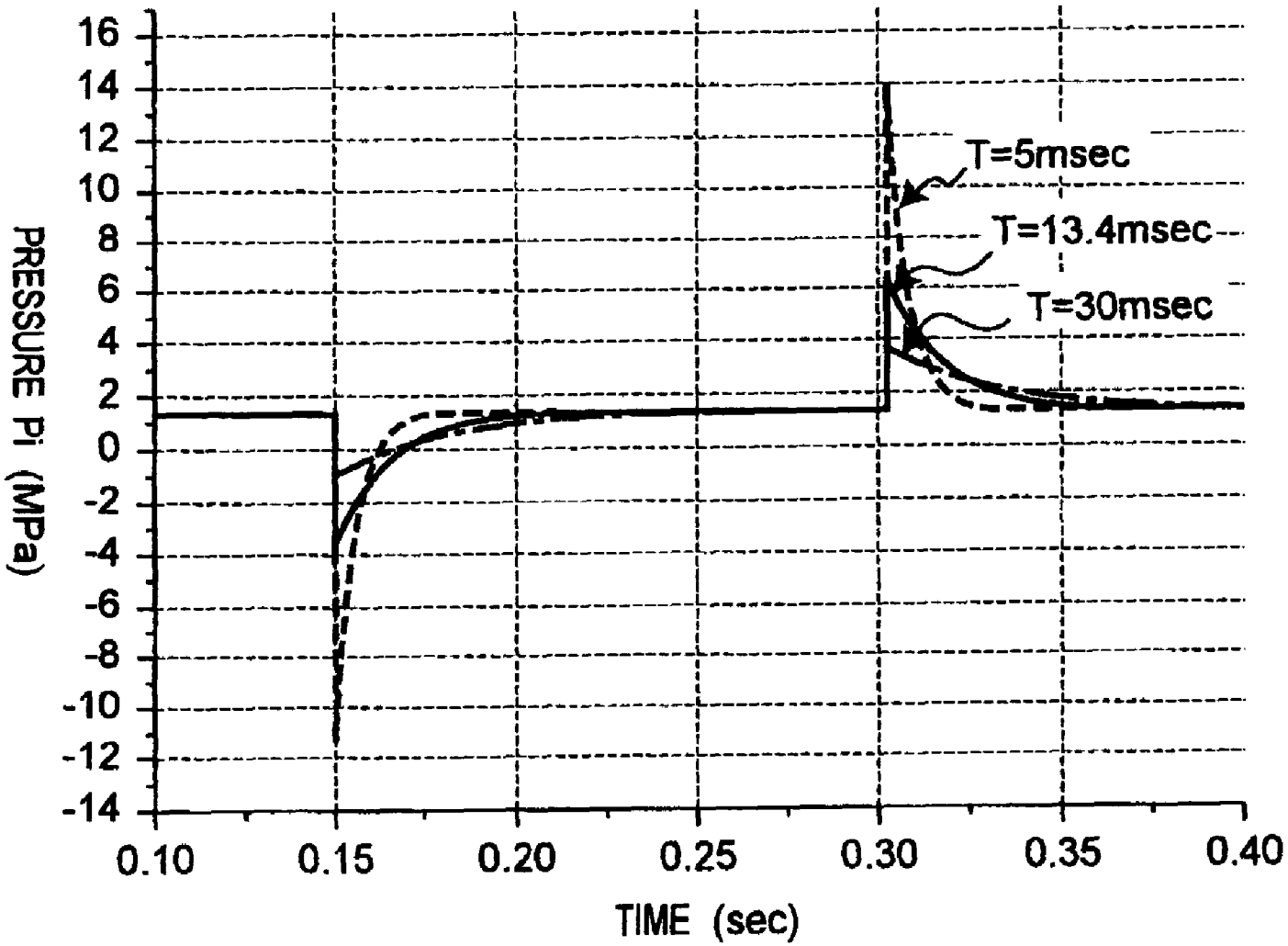
FIG. 27 is a graph in which the discharge pressure $P_i$ against time t is determined with a time constant T employed used as a parameter.

FIG. 27 is an analysis result of a comparison of the effect of the magnitude of the time constant T exercised on the discharge pressure waveform. With only the volume $V_S$ changed, a comparison of analysis results was made between the case of T=13.4 msec (FIG. 6) and the cases of T=5 msec and T=30 msec. The smaller the time constant T, the more an abrupt positive or negative pressure waveform is generated even under the conditions of equal stroke size $h_{st}$ and piston movement time $T_{st}$, so that the discharge fluid can more easily be intercepted and flown.

Also, the settling time of recovery from a negative pressure to a steady-state pressure, and the settling time of recovery from a positive peak pressure to a steady-state pressure, becomes smaller as the time constant T becomes smaller.

It can be understood that whereas the above-described intermittent interception control parameter $II_c$ and the continuous interception control parameter $CI_c$ serve as evaluation indices that determine the "discharge quality," the time constant T is an important evaluation index that determines the "discharge speed" (productivity) of the discharge apparatus.

From the discharge experiments in which various discharge objects were assumed, the following points have been found:

<1> When 30 msec<T<50 msec

Although the response is enough in comparison with the conventional air type and thread groove type, yet the features of the present invention are not fully exploited;

<2> When 10 msec≦T≦30 msec

In various fields such as circuit formation and displays, the dispenser can be sufficiently utilized as a means for preforming high-speed discharge of adhesives, solder paste, fluorescent material, electrode material, and the like.

<3> When T<10 msec

A productivity (discharge speed) that substitutes for the conventional printing method can be obtained. The dispenser proved to be best matching for the fluorescent-material discharge into the PDP independent cells," which is one of the embodiments and examples of the present invention.

Whether the dispenser is of the multi-head type or the single-head type, the volume of the flow passage that connects the fluid supply device (thread groove pump) and the piston portion to each other (e.g., 15 in FIG. 1A) has a considerable effect on the responsibility of the dispenser. As can be seen from Equation (44), given a volume $V_1$ (mm$^3$) between the piston end face and its opposing surface, a total volume $V_2$ (mm$^3$) of the flow passages that connect the piston and the fluid supply device to each other, and given that $V_S=V_1+V_2$, then the time constant T is proportional to $V_S$. Since $V_1$ can be made small enough, it holds that $V_2 \gg V_1$, thus allowing an assumption that the time constant T is proportional to the flow-passage volume $V_2$. In Equation (44), if the internal resistance of fluid supply device $R_S \rightarrow 0$, then it can be derived that the time constant $T \rightarrow 0$. However, since the intermittent interception control parameter $II_c \rightarrow 0$ from Equation (31), the interception condition at the end of discharge is no longer satisfied. If the discharge-nozzle resistance $R_n \rightarrow 0$, it becomes achievable likewise that the time constant $T \rightarrow 0$, but the discharge nozzle diameter cannot be enlarged from the restraints of the dot shape, neither can its length due to restraints in terms of machining. Further, the modulus of elasticity of volume K is in many cases subject to restraints in terms of material.

Consequently, the time constant T can be set to a small one most effectively by making the flow-passage volume $V_2$ as small as possible. Given a volume $V_{2S}(=V_2/n)$ of the flow passage that connects the fluid supply device and one piston to each other, preferable results were obtained in the example by setting as $V_{2S}<80$ mm$^3$. However, the lower-limit value of $V_{2S}$, which is dependent on the fluid resistance permitted to the flow passages, was $V_{2S}>10$ mm$^3$ in the example.

Even with the time constant T set small enough, the dispenser could not fulfill the function as a discharge apparatus if the actuator that drives the piston is of low responsiveness. With the use of an electro-magnetostriction device for the actuator as one example of an axial drive device, the actuator can be set easily to a time constant of at least $T_A \leqq 30$ msec, in which case the effect of setting the time constant T≦30 msec in Equation (44) can be utilized.

[11] Other Supplementary Explanations (11-1) Method for Correcting the Flow Rate in a Multi-Head Dispenser Each of the foregoing embodiments and examples of a single-head dispenser has been so constituted that the discharge amount per dot depends only on the condition setting (e.g., rotational speed) of the pump portion, by setting the piston-end-face gap h large enough and thereby suppressing the generation of the primary squeeze pressure to the utmost. In the case where the fluid is branched and fed from one pump portion to a plurality of piston drive portions, if the individual piston drive portions are made up so as to be strictly equal in dimensional accuracy, fluid resistance, and the like thereamong, the flow rate supplied from the pump portion is equally distributed. However, in many cases, it is practically difficult to achieve with such discharge objects as displays that are required to meet several-percent precision of discharge amount.

Figure 28A:
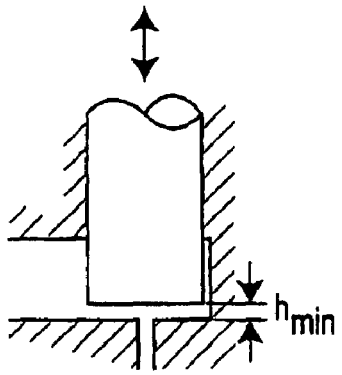
FIG. 28A is an explanatory view for explaining discharge amount per dot to the piston minimum gap.
Figure 28B:
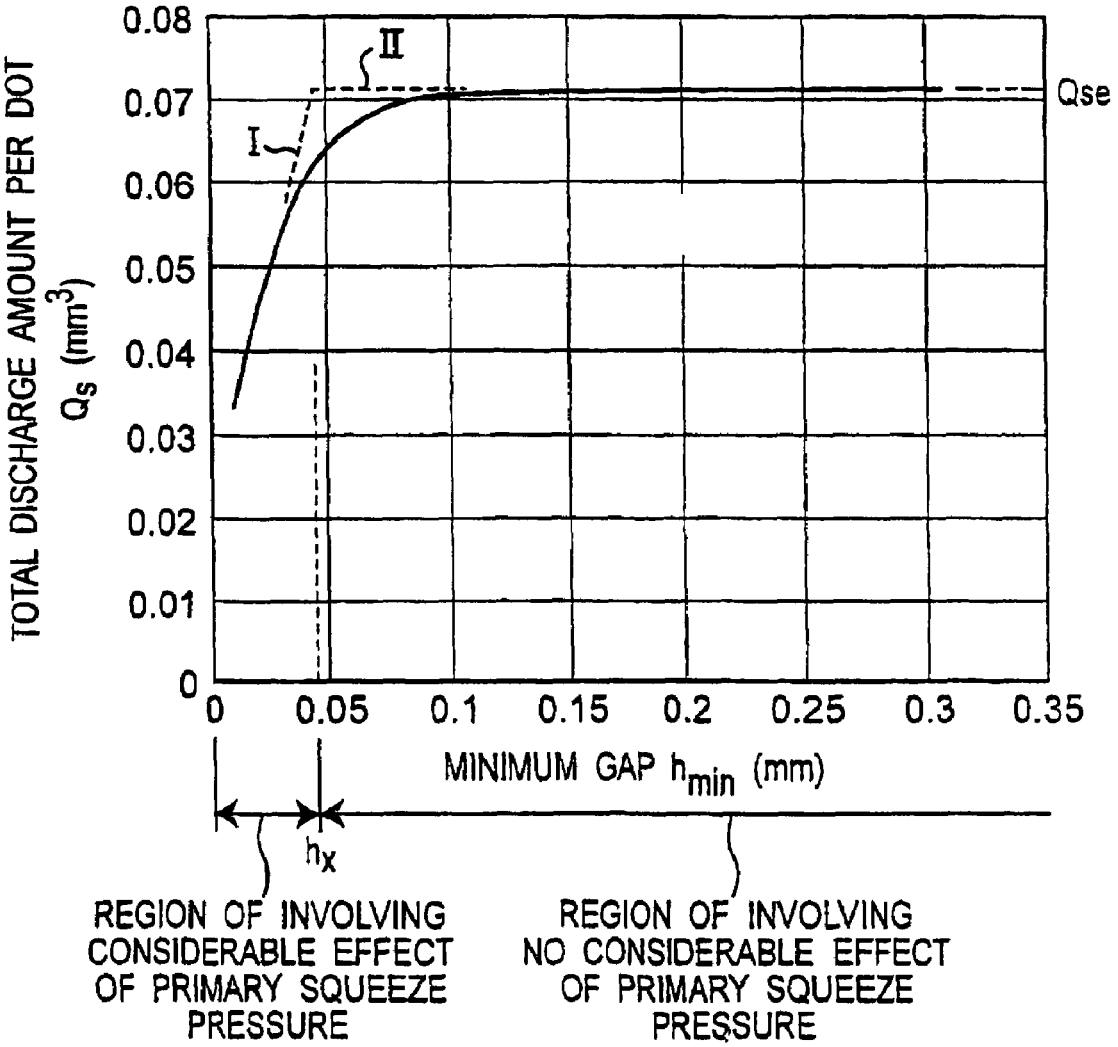
FIG. 28B is a graph showing discharge amount per dot to the piston minimum gap.

Hereinbelow, the "method for correcting the flow rate for each head," which is an issue of implementing a multi-head construction, is explained. The graph of FIG. 28B shows an example of the discharge amount per dot relative to the piston minimum gap $h_{min}$. As the piston minimum gap $h_{min}$ increases, the primary squeeze pressure goes $P_{squ1}\rightarrow 0$, while the thrust fluid resistance between the piston end face and its opposing surface simultaneously goes $R_p\rightarrow 0$, thus causing the partial pressure ratio ($=R_n/(R_s+R_p+R_n)$) to increase (see Equation (10)).

Whereas this tendency differs depending on analysis conditions, the amplitude of the pressure $P_i$ (i.e., total discharge amount $Q_s$) increases with increasing value of $h_{min}$ if the effect of increase of the partial pressure ratio is larger than the effect of $P_{squ1}\rightarrow 0$.

With $h_{min}$ beyond a proximity of 0.1 mm, the discharge amount per dot $Q_s$ converges at a constant value as $Q_s\rightarrow Q_{se}$ independently of $h_{min}$. As described before, the convergent value $Q_{se}$ of discharge amount is determined only by the working point $Q_c$ (see FIG. 33) that is determined by the pressure-flow rate characteristics of the pump, which is the fluid supply device, and the pump load (discharge-nozzle fluid resistance $R_n$), independently of the piston stroke, the minimum gap, or the like. That is, if the frequency of intermittent discharge is expressed by f, then $Q_c=f\times Q_{se}$. The above characteristic of "discharge amount per dot relative to the piston minimum gap $h_{min}$" is applicable also when the fluid compressibility is not negligible.

Now, based on the findings obtained from the above analyses, one of the following measures may be selected as the flow rate control for each head:

<1> When the flow rate among the individual heads is subject to large variations, the piston minimum gap $h_{min}$ is set within a region over which a large effect of the primary squeeze pressure is involved, i.e., within a range of $0<h_{min}<h_x$ over which the discharge amount relative to the gap shows an abrupt gradient.

<2> When it is desired to ensure the discharge amount per dot with an extremely high accuracy, the piston minimum gap $h_{min}$ is set to a proximity of $h_{min}\approx h_x$, where the discharge amount relative to the gap shows a smooth gradient.

The above $h_x$ is assumed to be an intersection point between an envelope (I) of a $Q_s$ curve relative to $h_{min}$ in the region of $0<h_{min}<h_x$ and a straight line (II) of $Q_s=Q_{se}$. This $h_x$ may also be determined experimentally. As to the displacement of the piston, providing a displacement sensor for detecting an absolute position of the piston and performing a closed loop control makes it possible to fulfill any arbitrary positioning control. However, in the case where an electromagnetostriction element such as a piezoelectric element, ultra-magnetostriction element, or the like is used as one example of an axial drive device, because of stroke limitations (0 to several tens of microns), the control of the minimum gap $h_{min}$ of the piston may be done by a combination of mechanical method and electronic-control method. For example, after the piston position is first roughly determined in a mechanical manner, the piston position of each head may be corrected once again by using electronic control based on data as to flow-rate measurements.

Also, even in either case of foregoing <1> or <2> for flow-rate control, combinational use of an output-flow-rate setting method for the supply-source pump makes it possible to control the flow rate at points where the piston end face gap is large enough. As an example, when the flow rate is so large that the minimum gap $h_{min}$ of the piston has to be set to a small one, decreasing the rotating speed of the thread groove pump allows $h_{min}$ to be set to a large one. This makes an advantage when powder and granular material is treated, as will be described later.

The above-described measure used for the correction of flow-rate differences among the individual heads of the multiple head is applicable also to the case of a single head. In the case of a single head, with the minimum gap $h_{min}$ of the piston set to a proximity of $h_{min}\approx h_x$ or to a range of $0<h_{min}<h_x$, high-speed flow rate control can be performed by controlling $h_{min}$ instead of changing the motor rotating speed of the pump. The responsiveness of the motor rotating speed control is at a level of 0.01 to 0.05 second at most, but the control responsiveness of the piston that is driven by an electromagnetostriction element is implementable at a level of 0.001 or less.

Other than the control of the flow rate by the minimum gap $h_{min}$ of the piston, it is also possible to control the flow rate by a mean value or central value of an input displacement waveform of the piston. As another method of correcting flow rate differences among the heads of the multi-head, a semi-fixed fluid throttle resistor may be provided on the way of each flow passage.

(11-2) When a Fluid Throttle Resistor is Provided on the Piston Outer Periphery

Described below are the effects of the case where a fluid throttle resistor is provided on the piston outer periphery on the flow passage that connects the piston end face portion and the fluid supply device to each other.

Figure 29:
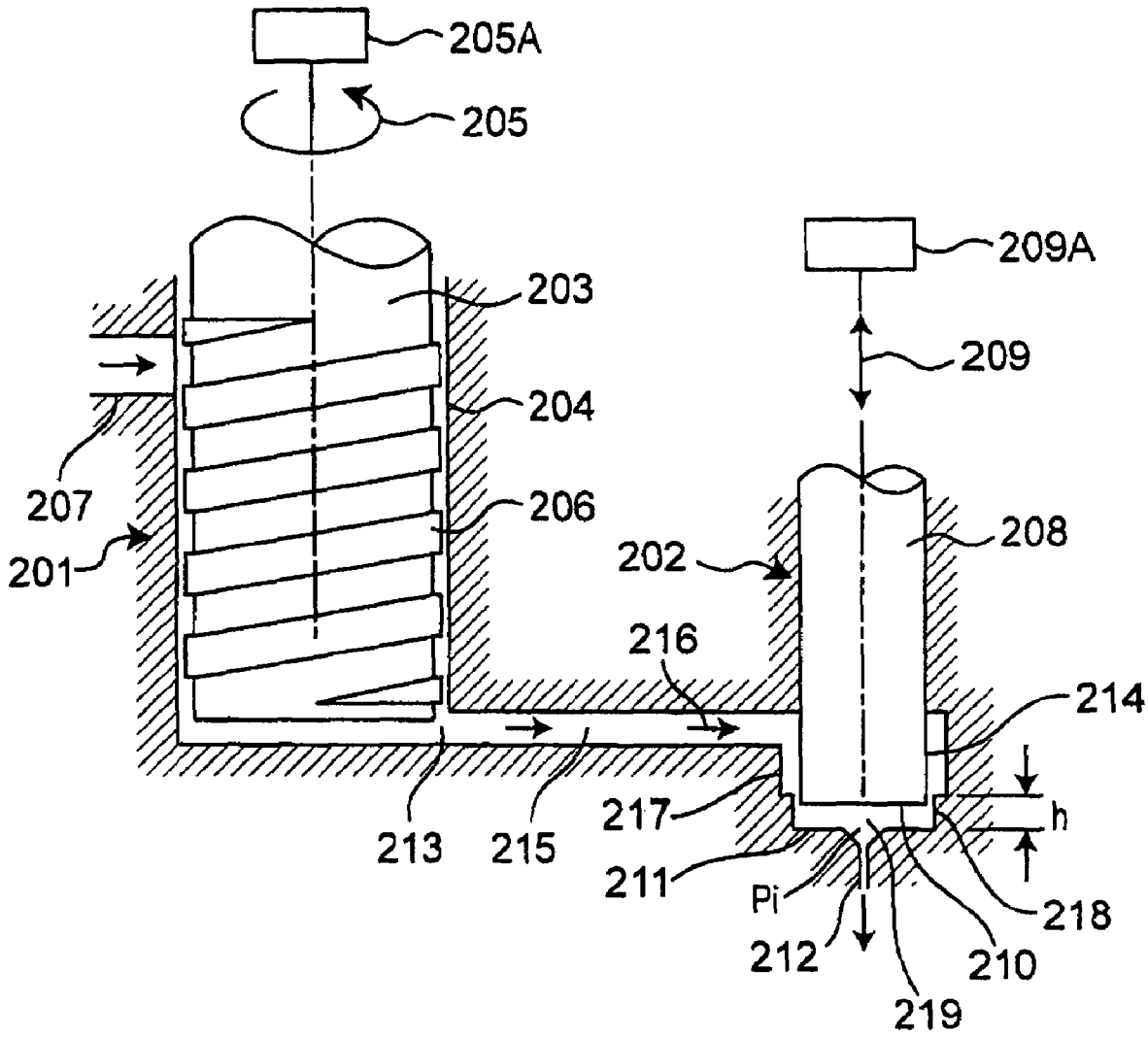
FIG. 29 is a partially sectional view of a model showing a case where a fluid throttle resistance portion is provided in an outer periphery of the piston.

Referring to FIG. 29, reference numeral 201 denotes a thread groove pump portion, and 202 denotes a piston portion.

Numeral 203 denotes a thread groove shaft, 204 denotes a housing, 205 denotes a rotation transfer device 205A so as to rotate along an arrow 205 the thread groove shaft 203 such as a motor, 206 denotes a thread groove formed in relatively moving surfaces of the thread groove shaft 203 and the housing 204, and 207 denotes a suction port for fluid. Numeral 208 denotes a piston, which is moved in an axial direction 209 by an axial drive device 209A such as a piezoelectric actuator.

Numeral 210 denotes an end face of the piston 208, 211 denotes its fixed-side opposing surface, and 212 denotes a discharge nozzle fitted to the housing 204. The piston end face 210 and the fixed-side opposing surface 211 serve as the two surfaces that move relative to each other along the gap direction. These two surfaces and the housing 204 form a later-described discharge chamber.

Numeral 213 denotes a thread-groove-shaft end portion, 214 denotes a piston outer periphery, 215 denotes a flow passage that connects the thread-groove-shaft end portion 213 and the piston outer periphery 214 to each other, 216 denotes a discharge fluid, 217 denotes a housing large-diameter portion for housing therein the piston 208, 218 denotes a housing small-diameter portion, and 219 denotes a discharge chamber formed by the piston end face 210, the fixed-side opposing surface 211, the housing large-diameter portion 217 and the housing small-diameter portion 218.

FIGS. 30A-30E show the piston positions in one cycle of suction and discharge processes in a case where the dispenser of this construction is used for intermittent discharge.

Figures 30A, 30B, 30C, 30D, 30E:
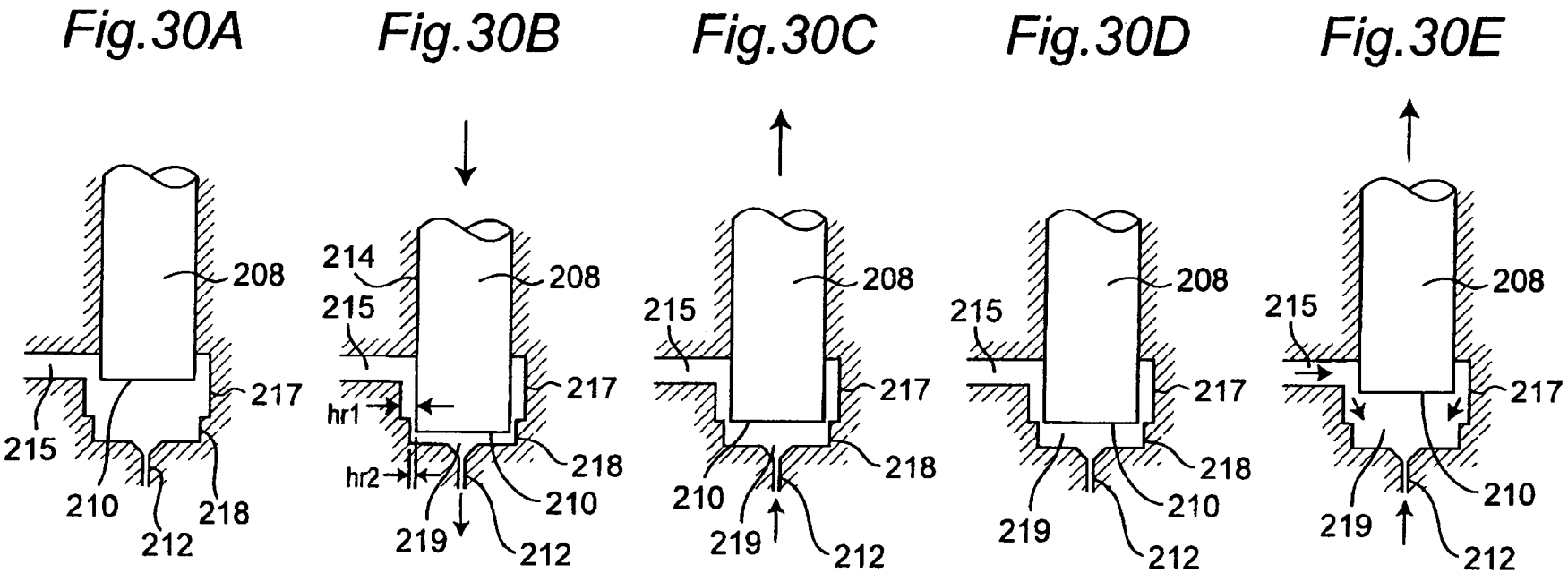
FIGS. 30A, 30B, 30C, 30D, and 30E are partially sectional views of the piston showing the piston position from discharge stroke to suction stroke.
Figure 31:
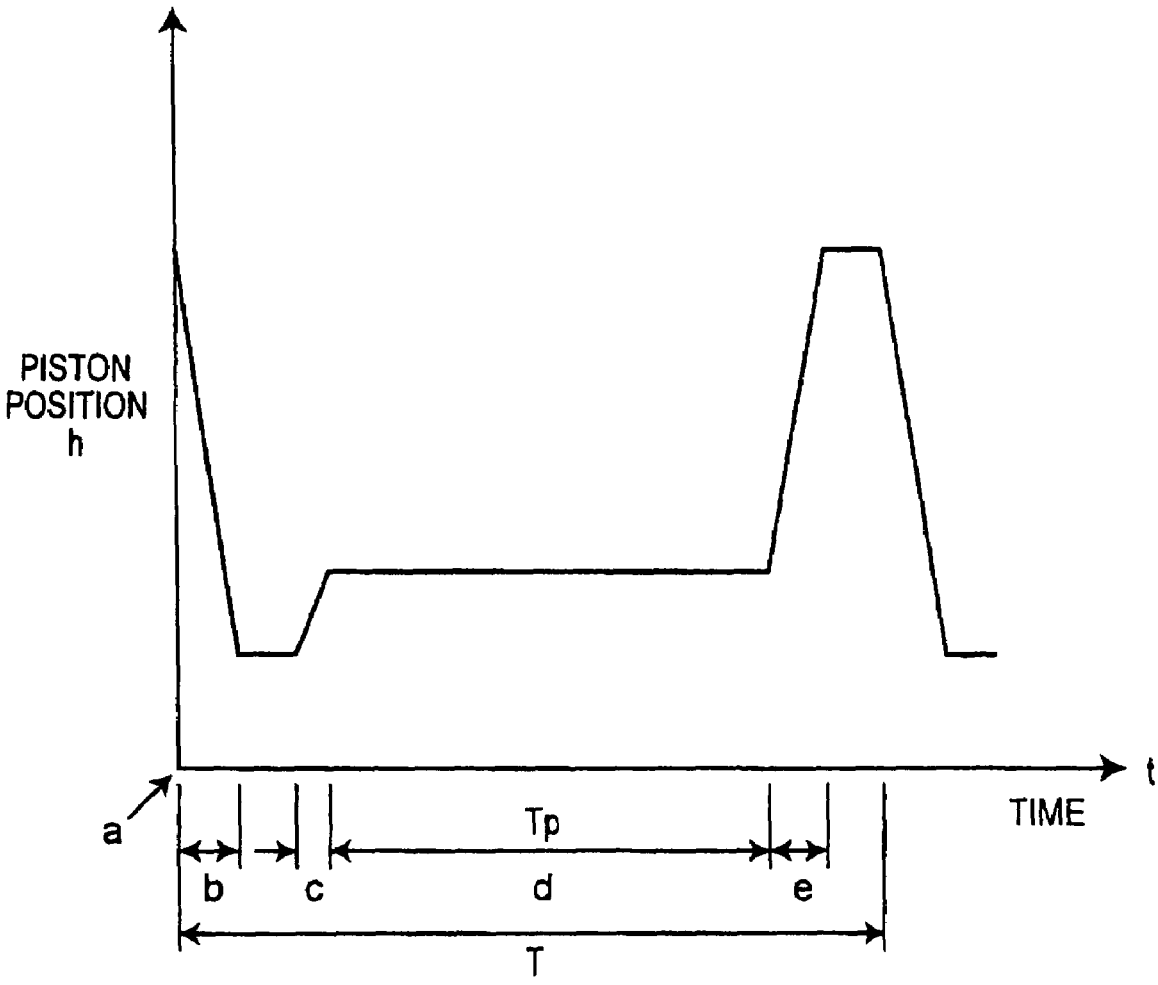
FIG. 31 is a graph showing piston position h against time t.

FIG. 31 shows the piston position h relative to time t in comparison with FIG. 30.

FIG. 30A shows a state immediately before a start of discharge, and FIG. 30B shows a state of discharge process in which the piston 208 is descending. The axial position of the piston end face 210 has descended to the small-diameter portion 218 of the housing 204. The gap between the piston outer periphery 214 and the large-diameter portion 217 was set to a sufficiently large one, $h_{r1}$>100 μm in the example, and the gap between the piston outer periphery 214 and the small-diameter portion 218 was set to a sufficiently small one, $h_{r2}$<10 μm. Therefore, <1> before the axial position of the piston end face 210 reaches the housing small-diameter portion 218, the discharge chamber 219 communicates with the flow passage 215 connected to the thread groove pump portion 201; and <2> after the axial position of the piston end face 210 has reached to the housing small-diameter portion 218, the discharge chamber 219 is generally separated hydrodynamically from the flow passage 215 connected to the thread groove pump portion 201. The discharge chamber 219 becomes a generally closed space when the discharge nozzle 212 is eliminated.

Accordingly, a discharge pressure generated at the stage of above <1> is the above-described secondary squeeze pressure, while a discharge pressure generated at the stage of <2> is a compression pressure generated by the fluid being compressed in the closed space.

FIG. 30C shows a state in which the discharge process had ended and the piston 208 is ascending from the lowermost-point position. At this stage, since the piston end face 210 is in the position of the housing small-diameter portion 218, the discharge chamber 219 still remains intercepted from the flow passage 215. Therefore, a slight amount of the fluid flows from the thread groove pump side into the closed space (discharge chamber 219), which has increased in capacity by the ascent of the piston 208. As a consequence, a negative pressure is generated in the discharge chamber 219 more effectively, thereby separating the fluid that is flowing out from the discharge nozzle 212 and moreover the fluid that has adhered to the tip end is sucked to the inside of the discharge nozzle 212 as indicated by arrow.

FIG. 30D shows a state that the piston end face 210 is at rest (standby state). In this state also, since a slight amount of the fluid flows from the thread groove pump side into the discharge chamber 219, the pressure in the discharge chamber 219 will not easily increase. That is, the total filling amount of the discharge fluid within the discharge chamber 219 will not easily increase. Thus, even if the standby time $T_P$ in FIG. 31 is varied over a wide range, the accuracy of intermittent discharge amount per shot is not largely impaired.

FIG. 30E shows a state in which the piston 208 is ascending once again. In this case, since the piston end face 210 is in the position of the housing large-diameter portion 217, the gap $h_{r1}$ is large enough, so that the fluid is rapidly filled from the thread groove pump side into the discharge chamber 219.

In the case where a longer standby time $T_P$ is required, rotation of the motor for the thread groove pump may be temporarily halted. The housing small-diameter portion 218 that separates the flow passage between the discharge chamber 219 and the thread-groove-pump side, although provided at a position on one side close to the piston end face 210 in the example, yet may be provided at an upper portion of the piston. The piston end face 210, although cylindrical shaped in the example, yet may be tapered or spherical-shaped. In short, it is only required that the discharge chamber becomes a closed space except for the discharge nozzle before a start of discharge.

Figure 33:
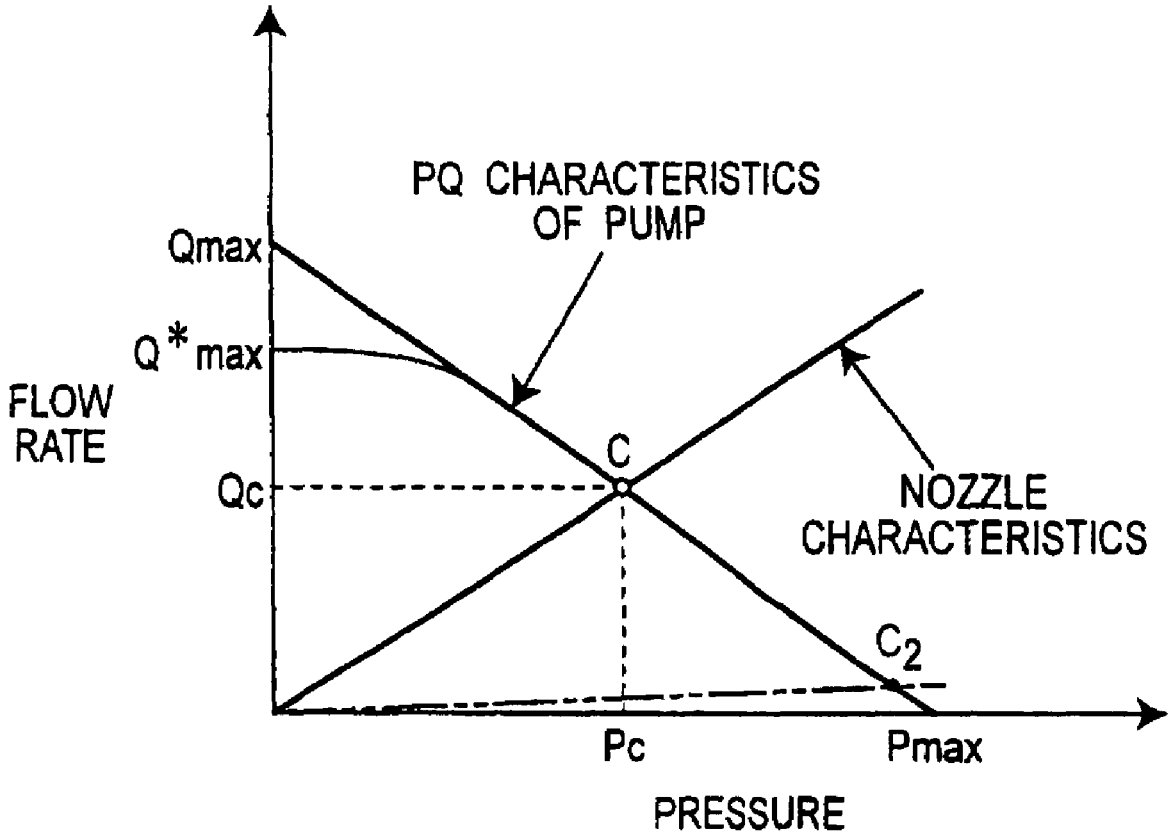
FIG. 33 is a view showing PQ characteristics of a pump.
Figure 34:
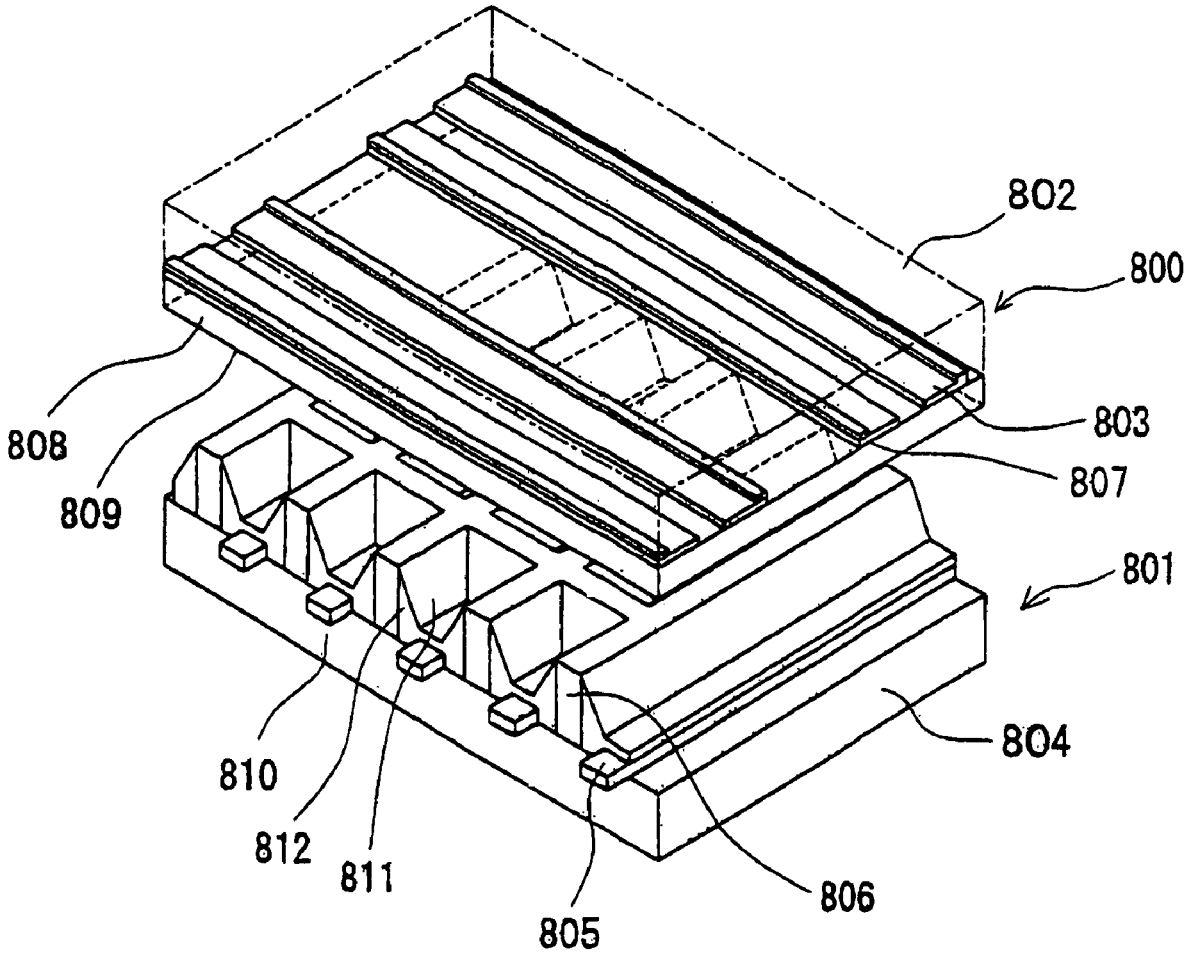
FIG. 34 is a view showing an example of the plasma display panel structure.
Figure 35:
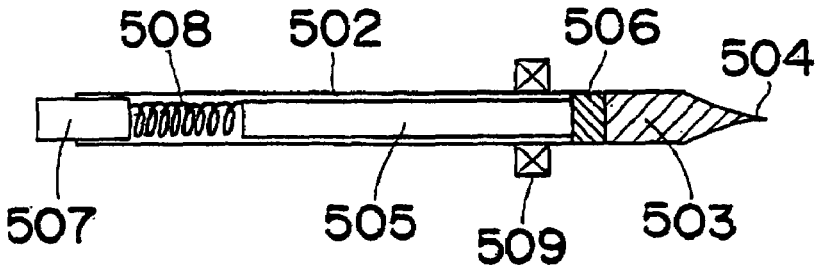
FIG. 35 is a view showing a conventional design example of a jet device using an ultra-magnetostriction device.
Figure 36:
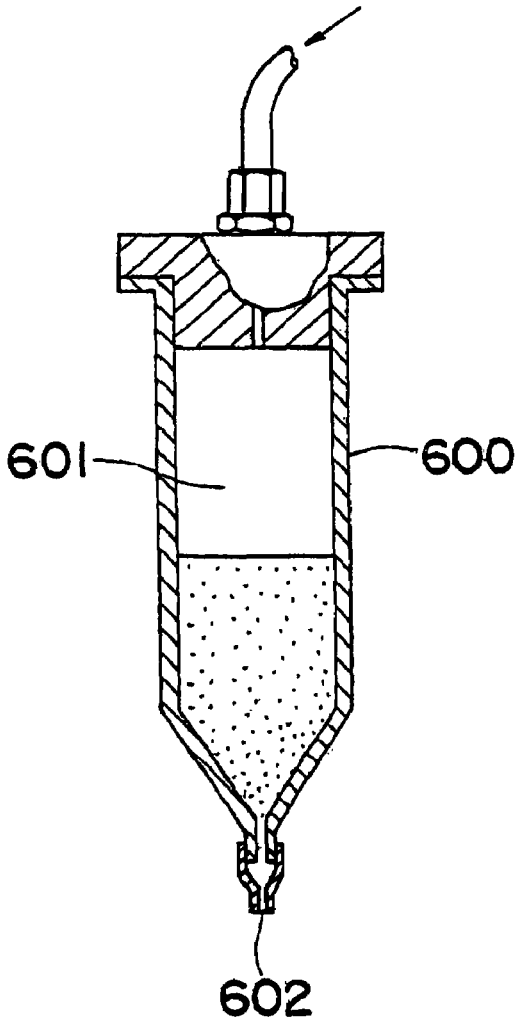
FIG. 36 is a view showing a conventional air-pulse type dispenser.

In addition, the structure of this example is applicable to both high-speed intermittent discharge and starting- and terminating-end control for continuous discharge. In this example, the working point of the thread groove pump changes in two steps. Referring to FIG. 33, the working point is at C position at the stage of above <1>, i.e., before the axial position of the piston end face 210 reaches the housing small-diameter portion 218, where a sufficiently large feed amount $Q_c$ can be obtained from the thread groove pump. At the stage of above <2>, i.e., after the axial position of the piston end face 210 has reached the housing small-diameter portion 218, the working point moves to $C_2$ position, resulting in a small flow rate $Q_c$ fed by the thread groove pump. Accordingly, given time allocations $T_1$ and $T_2$ in one cycle T for the above <1> and <2>, respectively, if the cycle T is constant and if the ratio of $T_1$ to $T_2$ is constant, then the discharge amount per shot can be set by only changing the rotational speed of the thread groove pump. Taking advantage of this point makes it possible to correct variations in flow rate among the individual heads by controlling the ratio of $T_1$ to $T_2$ in the case of a multi-head.

(11-3) Process Conditions to Which the Present Invention Can be Effectively Applied As described on an example in "[6] Application examples for PDP fluorescent-material discharge," the dispenser of the present invention is capable of managing the following process conditions. That is, <1> The dispenser is capable of managing high-viscosity fluid of the order of several thousands to several tens of thousands mPa·s (cps). There are no restraints on the lower-limit value of viscosity. As comparison with the ink jet method for discrimination of the features of the present invention, the dispenser of the present invention is capable of managing fluids of 100 mPa·s or more, to which the ink jet method is inapplicable.

<2> The dispenser of the present invention is capable of managing contained-powder particle sizes ϕd<50 μm. The flow passages among the relatively moving members are completely contactless in terms of mechanics. Of course, there are no restraints on the lower-limit value of powder particle size.

<3> The cycle $T_P$ of intermittent discharge is 0.1 to 30 msec.

<4> The dispenser of the present invention is capable of making the fluid flown and discharged with a gap H≧0.5 mm between the discharge nozzle and the substrate.

(11-4) Additional Description on Features of Discharge Apparatuses to Which the Present Invention is Applied The features of discharge apparatuses to which the present invention is applied are described below.

(i) The discharge amount $Q_s$ is less affected by the viscosity of the discharge fluid.

Referring to Equation (10), the fluid resistances $R_n$, $R_p$, and $R_s$ are proportional to the viscosity μ. Also, given that supply-source pressure $P_{S0}$≈thread-groove maximum pressure $P_{max}$, then $P_{S0}$ is proportional to the viscosity μ.

Since the flow rate $Q_i=P_i/R_n$, the viscosities μ of the denominator and the numerator of $Q_i$ are canceled. Therefore, the discharge amount of this dispenser is not dependent on the viscosity. Generally, the viscosity of fluid largely varies logarithmically against temperature. The property of being insensitive to such temperature variations comes to an extremely advantageous characteristic in making up the discharge system.

(ii) The reliability against clogging of powder and granular material within the flow passage is high.

When the present invention is applied, a large opening area for the flow passage leading from the suction port of the pump to the discharge nozzle can be allowed for, so that a high reliability to powder and granular material can be obtained.

In particular, since the gap h of the piston end face, which is the flow passage leading to the discharge nozzle, can be set to a sufficiently large one, there can be provided a great advantage to prevention against the clogging of powder material (e.g., those having a particle size of 7 to 9 μm for fluorescent material).

For example, in the case where a multi-head construction is adopted and the flow rate for each head is finely controlled, with the combinational use of an output-flow-rate setting method (where the flow rate is controlled by rotating speed) for the supply-source pump, the minimum gap may appropriately be set to a proximity to $h_{min} \approx h_x$ (e.g., $h_{min}$=50 μm in FIG. 28A) where the gradient of the discharge amount versus the gap is smooth.

The point that the flow rate control is implementable at such large-gap portions is one of the primary characteristics of the present invention. In addition, in the case of discharging with powder and granular materials, such as fluorescent material and adhesive material, in which fine particles are contained, the minimum gap $\delta_{min}$ of the flow passage may be set larger than the fine particle size $\phi d$.

$$\delta_{min} > \phi d \tag{43}$$

Hereinabove, the thread groove pump has been used as the fluid supply device in the embodiments and examples of the present invention. For implementation of the present invention, pumps of types other than the thread groove type are also applicable. However, the thread groove type is advantageous in that the maximum pressure $P_{max}$, the maximum flow rate $Q_{max}$ and the internal resistance $R_s(=P_{max}/Q_{max})$ can be freely selected by changing various parameters (radial gap, thread groove angle, groove depth, groove to ridge ratio, etc.) constituting the thread groove Also, since the flow passage can be formed so as to be completely contactless, the thread groove type is advantageous in treating any powder and granular materials. Further, the internal resistance $R_S$ can be set to a large one, and moreover held stably at a constant value.

Furthermore, the pump as the fluid supply device in the present invention is not limited to the thread groove type, and other types of pumps are also applicable. Among those applicable are, for example, Mono type called snake pump, gear type, twin-screw type, syringe type pumps, and the like. Otherwise, pumps that serve only to pressurize the fluid with high-pressure air may also be used.

Figure 32:
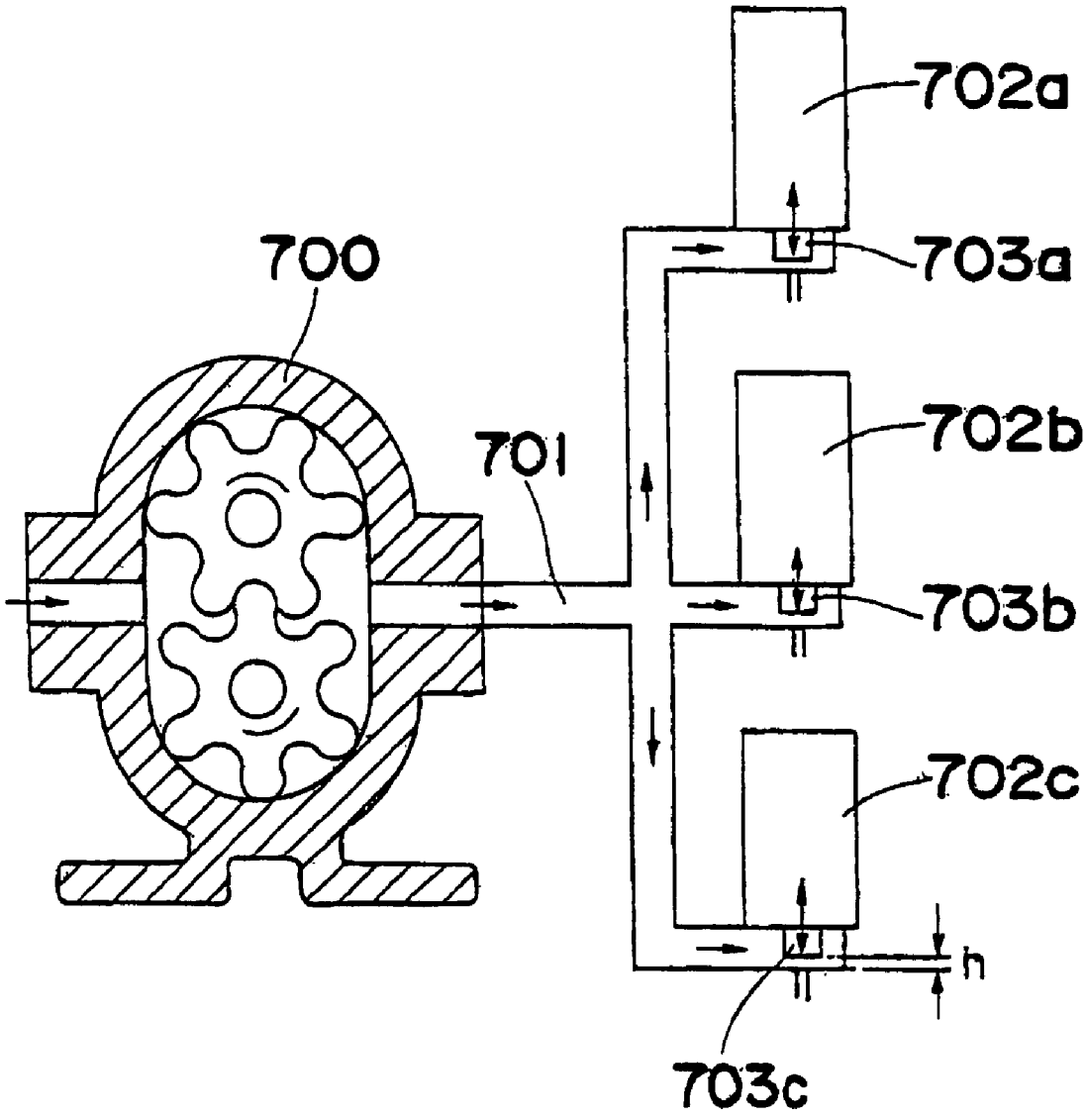
FIG. 32 is a view showing a fourth embodiment of the present invention.

FIG. 32 is a model view in a case where a gear type pump is used as fluid supply device in the present invention. Reference numeral 700 denotes a gear pump, 701 denotes a flow passage, 702*a*, 702*b* and 702*c* denote axial drive device implemented by, for example, a piezoelectric actuator or the like, and 703*a*, 703*b* and 703*c* denote pistons, respectively.

In general, the maximum flow rate $Q_{max}$ and the maximum pressure $P_{max}$ of the pump can often be theoretically determined. However, if it is difficult to do, pressure-flow rate characteristics (PQ characteristics) may be determined experimentally. Also, as shown in FIG. 33, the relationship between pressure and flow rate of the pump is not necessarily linear shaped as shown by broken line in the figure and, in some cases, PQ characteristics obtained from the interconnection of the maximum pressure $P_{max}$ and maximum flow rate $Q^*_{max}$ result in a curve. When the graph of the PQ characteristics is expressed by a straight line, the internal resistance $R_s$ of the fluid supply device can be obtained by $P_{max}/Q_{max}$. In some case, depending on the kinds of pumps, the graph of the PQ characteristics may be expressed by a curve. In such a case, since the internal resistance R at a working point is not equal to $P_{max}/Q^*_{max}$, the internal resistance can not be obtained by using the maximum flow rate $Q^*_{max}$ at the working point.

In this case, the internal resistance $R_S$ of the pump can be determined by applying the theory of the present study on the assumption that, given tangent lines of PQ characteristics drawn at working points $P_C$ and $Q_c$, $R_S=P_{max}/Q_{max}$, where $P_{max}$ is the intersection point of the X axis and $Q_{max}$ is the intersection point of the Y axis.

The fluid resistances $R_n$, $R_p$ can usually be determined from a well-known theoretical formula (e.g., Equations (11), (12)). Otherwise, with complex configurations involved, those fluid resistances may be determined by numerical analysis or by experimental process. In the case of an orifice whose length of its throttle portion is shorter than its inner diameter, although the equation of linear resistance (e.g., Equation (7)) does not hold, yet linearization around the working point may be applied in this case to obtain an apparent fluid resistance.

In addition, the viscosity of the discharge fluid is, in many cases, has dependence on the shear rate. For example, the shear rate to which the fluid undergoes differs between when the fluid passes through the thread groove pump and when the fluid passes through the discharge nozzle. In this case, it is appropriate to preliminarily determine the relationship between viscosity and shear rate of the discharge material by experiments and moreover apply viscosities of individual flow passages from shear rates to which the fluid undergo. By this method, the fluid resistances $R_n$, $R_p$, $R_S$, $R_r$, etc. can be determined.

The piston and its opposing surface constituting the piston drive portion may be other than circular shaped for its cross-sectional shape. The piston may be rectangular shaped in cross section, in which case the radius of a circle having an equivalent area size is assumed to be a mean radius. If the discharge-side tip end of the piston and the housing that accommodates this piston therein are both conical shaped, then it becomes possible to reduce the effects of compressibility to a slight one and moreover, when powder and granular material is used, to improve its fluidity.

The shape of the discharge nozzle holes may be other than a perfect circle. For example, in the case where a fluorescent-material layer is formed in independent cells of a PDP, if the independent ribs are rectangular shaped, the discharge nozzle holes are preferably elliptical shaped.

In the embodiments and examples, the piston and the drive shaft of the actuator that drives this piston are placed in parallel to the thread groove shaft of the thread groove pump. Other than this arrangement method, for example, the thread groove shaft of the thread groove pump may also be placed so as to be perpendicular to the drive shaft of the actuator. With such an arrangement, the passage that connects the fluid supply source and the discharge chamber to each other can be reduced in volume, so that the effect of compressibility on the discharge performance can be reduced.

The center axis of the discharge nozzle may be not vertical to the discharge-target plane, but inclined thereto with a gradient. In the case where the discharge nozzle is positioned so as to be inclined by an angle α against an axis vertical to the substrate, given a flow velocity V of the discharge fluid, the discharge fluid has a velocity component $V_{sin}\ \alpha$ in the horizontal direction of the substrate. For example, in the "process of discharging fluorescent material into independent cells of a PDP," which is one of the embodiments and examples of the present invention, if the discharge fluid has the velocity component $V_{sin}\ \alpha$ in the longitudinal direction of rectangular-shaped ribs, the fluid can be filled more smoothly to the whole regions of the rib interiors.

Depending on the process to which the present invention is applied, there are some cases where the cycle of intermittent discharge is not constant and the time interval differs from dot to dot. Here is assumed a case, as an example, where three dots are shot at time t=a, t=b and t=c. It is assumed, as an example, that a time interval $T_1$ between t=a and t=b is double a time interval $T_2$ between t=b and t=c. In this case, an equal-quantity discharge to the three dots can be achieved by an arrangement that the rotating speed of the thread groove pump for a section of time interval $T_1$ is set to half that for a section of time interval $T_2$.

The pump of this embodiment and examples for working with micro-small flow rates only needs piston strokes on the order of several tens of microns at most, in which case stroke limits do not matter even if an electro-magnetostriction element such as ultra-magnetostriction element or piezoelectric element is used as one example of an axial drive device.

Further, in the case where a high-viscosity fluid is discharged, occurrence of a large discharge pressure due to the squeeze action could be predicted. In this case, since the axial drive device that drives the piston is required to exert a large thrust against a high fluid pressure, it is preferable to apply an electro-magnetostriction type actuator that can easily exert a force of several hundreds to several thousands N. The electro-magnetostriction element, having a frequency responsiveness of several MHz or higher, is capable of putting the piston into rectilinear motion at high responsiveness. Therefore, the discharge amount of a high-viscosity fluid can be controlled at high response with high precision.

The piston and the housing that accommodates this piston therein, which have cylindrical inner configurations, are used in the embodiments and examples. Other than this method, for example, it is allowable that a bimorph type piezoelectric element, which is used in ink jet printers or the like, is used to make up the two relatively moving surfaces, where the discharge fluid is supplied from the fluid supply device to a discharge chamber defined between these two surfaces (not shown).

If the responsiveness is sacrificed, a moving-magnet type or moving-coil type linear motor, or an electromagnetic solenoid, or the like may be used as the axial drive device that drives the piston. In this case, constraints on the stroke are dissolved (not shown).

As can be understood from the graphs of FIGS. 7 and 8, generated pressure and flow rate due to a squeeze effect result in such a waveform that the phase is advanced by $\Delta\theta=\pi/2$ over the displacement input waveform of the gap between the piston end face and its opposing surface. That is, the fluid is discharged during sections in which the piston is descending ($dh/dt<0$). For example, in the case where the intermittent discharge is performed while the substrate to be discharged onto is being moved by the stage, in order that discharge is achieved at high positional precision by aiming at discharge places, it is appropriate to set a coincident timing for both the stage and the displacement input signal h by taking into consideration that the phase of discharge is advanced by $\Delta\theta=\pi/2$ over the displacement input signal h of the piston gap. For example, the stage may be moved while the piston is ascending, and after a stop, the piston may be lowered for the discharge on an object substrate.

The more the piston is driven at higher frequencies, the more the intermittent discharge limitlessly approaches the continuous discharge. This intermittent discharge may be exploited for pseudo-continuation so as to depict a continuous line.

In this case, for the control of flow rate as a continuous line, a method similar to that for the control of discharge amount per dot can be applied.

Further, as a time delay factor, a small-diameter, long pipe may be fitted on the discharge side, and with a construction that the discharge nozzle provided at a tip end of the pipe, the pseudo-continuation becomes implementable at even lower frequencies.

Figure 37:
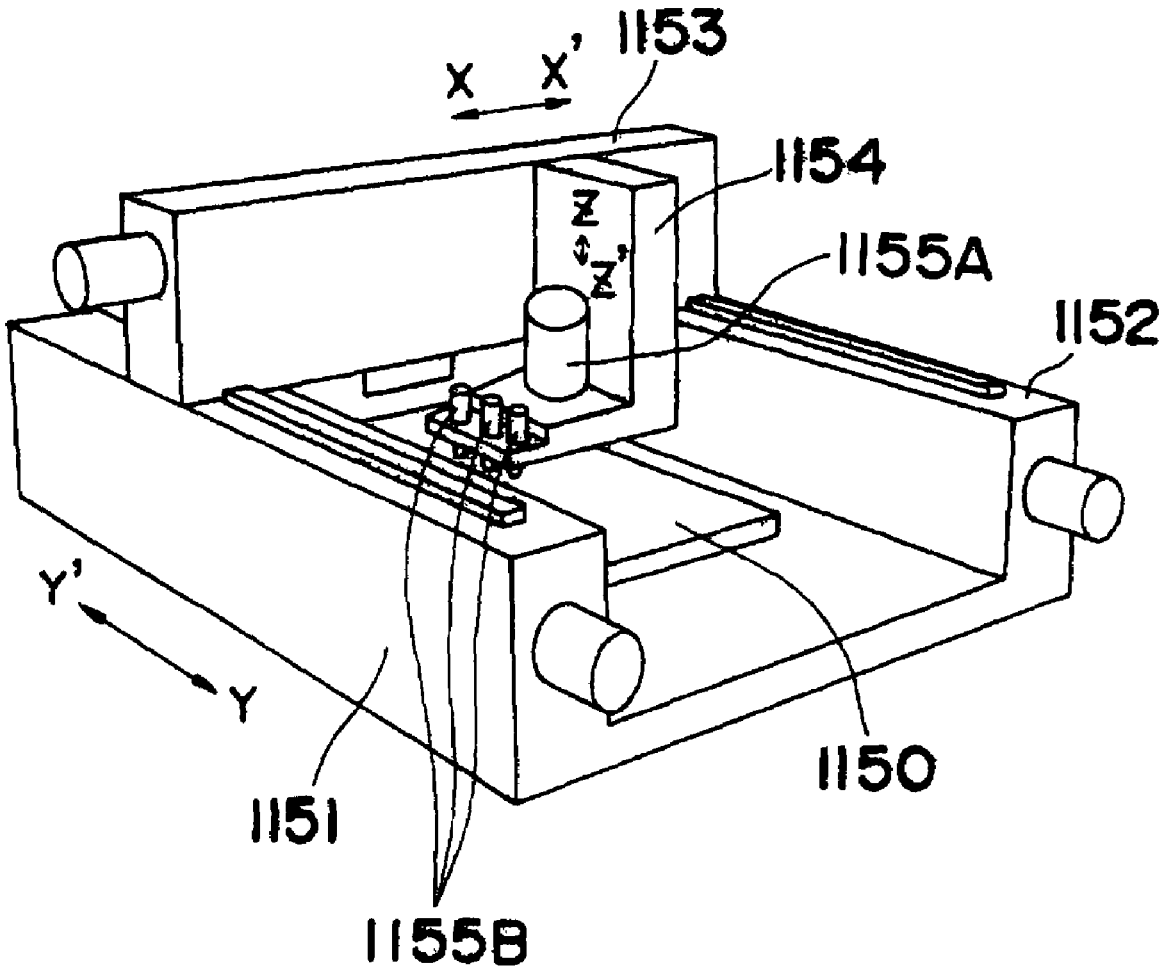
FIG. 37 is a perspective view showing the fluid discharge apparatus of the embodiment of the present invention.

FIG. 37 is a perspective view showing the fluid discharge apparatus of the embodiment of the present invention, where on a Z-axis direction conveyor unit is mounted a master pump (thread groove pump) 1155A (ex. corresponding to the pump portion 1 in FIG. 1A or 150 in FIG. 16) and a piston drive portion 1155B (ex. corresponding to the piston drive portion 2 in FIG. 1A or 156 in FIG. 16) constructed by a plurality of pumps.

Reference numeral 1150 denotes a panel, on both sides of which are provided a pair of Y-axis direction conveyor units 1151, 1152. Also, an X-axis direction conveyor unit 1153 is mounted on the Y-axis direction conveyor units 1151, 1152 so as to be movable in a Y-Y' direction. Further, a Z-axis direction conveyor unit 1154 is mounted on the X-axis direction conveyor unit 1153 so as to be movable in an arrow X-X' direction. On the Z-axis direction conveyor unit 1154 is mounted a master pump (thread groove pump) 1155A (ex. corresponding to the pump portion 1 in FIG. 1A or 150 in FIG. 16) and a piston drive portion 1155B (ex. corresponding to the piston drive portion 2 in FIG. 1A or 156 in FIG. 16) constructed by a plurality of pumps.

By the fluid discharge apparatus and method using the present invention, the following effects can be obtained. That is, the fluid discharge apparatus and method is:

1. capable of fulfilling intermittent discharge and continuous discharge of ultrahigh-speed response that has conventionally been difficult to do with the air type and the thread groove type; and 2. capable of managing powder and granular material with fine particles mixed therein with high reliability because flow passages leading from suction port to discharge path can be kept contactless at all times and because a sufficiently large flow passage area can be allowed for.

3. In addition to the above, the dispenser of the present invention is capable of having the following characteristics at the same time. That is, the dispenser is capable of:

<1> fulfilling high-speed discharge of high-viscosity fluid that has been difficult to do with the ink jet type;

<2> fulfilling ultra-small amounts of discharge with high precision.

When the present invention is used, for example, for fluorescent-material discharge of PDPs and CRT displays, dispensers of surface mounting, the formation of micro-lenses, and so forth, its merits can be fully exhibited, and immense effects can be obtained.

The technical matters relating to the referred portions in this specification are described in U.S. patent application Ser. No. 10/673,495 cited in this specification, the teachings of which are hereby incorporated by reference.

By properly combining the arbitrary embodiments of the aforementioned various embodiments, the effects possessed by the embodiments can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fluid discharge method for intermittently discharging fluid, the fluid discharge method comprising:

feeding the fluid from a fluid supply device to a gap defined between opposed relatively moving surfaces of two members while keeping the two members moving relative to each other along a direction of the gap, and utilizing a pressure change caused by changing the gap so that the fluid is intermittently discharged through a discharge port communicating with the gap, wherein the opposed relatively moving surfaces of the two members are provided in n sets, where n is an integer not less than 1, wherein given a total volume $V_1$ ($mm^3$) of the n sets of the opposed relatively moving surfaces, a total volume $V_2$ ($mm^3$) of flow passages that connect the n sets of the opposed relatively moving surfaces and the fluid supply device to each other, an absolute value $X_{st}$ (mm) of a stroke of the n sets of the opposed relatively moving surfaces that move relative to each other, a time $T_{st}$ (sec) required for the n sets of the opposed relatively moving surfaces to move by the stroke $X_{st}$, a fluid internal resistance $R_S$ (kgsec/$mm^5$) of the fluid supply device, a fluid resistance $R_n$ (kgsec/$mm^5$) of the discharge port, a modulus of elasticity of volume K (kg/$mm^2$) of the fluid, an effective area $S_P$ ($mm^2$) of the opposed relatively moving surfaces, and a sum $P_{s0}$ (kg/$mm^2$) of a maximum pressure of the fluid supply device and an auxiliary pressure for introducing the fluid into the fluid supply device, and wherein if it is defined that $V_S=V_1+V_2$ and that a time constant T and an intermittent interception control parameter $II_c$ are $$T = \frac{R_s R_n}{R_n + nR_S}\frac{V_s}{K}$$

and $$II_c = \frac{R_s S_p X_{st}\left(1 - e^{-\frac{T_{st}}{T}}\right)}{2P_{s0}T_{st}},$$

respectively, then it holds that $II_c>1$.

2. The fluid discharge method according to claim 1, wherein $$P_{s0} + \frac{S_p X_{st} K}{2V_s} > 0.2.$$

3. The fluid discharge method according to claim 1, wherein in a multi-head for feeding the fluid from the fluid supply device to the gap between the opposed relatively moving surfaces in which n≧3, the flow passages are formed generally mutually parallel and so as to lead from a common flow passage arranged on a way between the fluid supply device and the opposed relatively moving surfaces so as to communicate with the fluid supply device on an upstream side and communicate with individual opposed relatively moving surfaces on a downstream side in such a manner that fluid resistances of individual flow passages are equal to one another.

4. The fluid discharge method according to claim 1, wherein in a multi-head for feeding the fluid from the fluid supply device to the gap between the opposed relatively moving surfaces in which n≧3, at least one of the flow passages is formed in a bent configuration so that fluid resistances of individual flow passages are equal to one another.

5. The fluid discharge method according to claim 1, wherein the flow rate for each intermittent discharge of fluid is set by changing a rotating speed of the fluid supply device.

6. The fluid discharge method according to claim 1, wherein an axial drive device for relatively moving the opposed relatively moving surfaces is a resonant oscillator.

7. The fluid discharge method according to claim 1, wherein while a discharge nozzle serving as the discharge port and a discharge-target substrate are kept moving relative to each other, the fluid in an equal discharge amount per dot is intermittently discharged periodically taking advantage of the discharge-target surface's geometrical symmetry.

8. The fluid discharge method according to claim 1, wherein a discharge-target surface is a display panel.

9. The fluid discharge method according to claim 1, the method being a method for forming a fluorescent material layer of a plasma display panel, wherein while a dispenser having a discharge nozzle serving as the discharge port is kept moving relative to a discharge-target substrate on which independent ribs surrounded by barrier ribs are geometrically symmetrically formed so as to create independent cells, fluorescent material paste as the fluid is intermittently discharged from the discharge nozzle so that the fluorescent material paste is discharged into interiors of the independent cells successively, whereby a fluorescent material layer is formed.

10. The fluid discharge method according to claim 1, wherein if a volume of a flow passage that connects the fluid supply device and one of the n sets of the opposed relatively moving surfaces is $V_{2S}$, then it holds that $10<V_{2S}<80$ $mm^3$.

11. The fluid discharge method according to claim 1, wherein if a minimum value or mean value of the gap defined between the opposed relatively moving surfaces is $h_0$, then $h_0>0.05$ mm.

12. The fluid discharge method according to claim 1, wherein an axial drive device for relatively moving the opposed relatively moving surfaces is implemented by using an electro-magnetostriction element, and wherein T≦30 msec.

13. The fluid discharge method according to claim 12, wherein the fluid is intermittently flowed and discharged onto a substrate, which is a discharge target, with a cycle period $T_P$=0.1 to 30 msec in a state that viscosity μ of the of the discharge fluid is μ>100 mPa·s, diameter ϕd of powder material contained in the discharge fluid is ϕd<50 μm, flow passages between the relatively moving members keep mechanically completely contactless during discharge process, and that a gap H between a discharge nozzle serving as the discharge port and the discharge-target substrate is $H \geqq 0.5$ mm.

14. The fluid discharge method according to claim 1, wherein a continuous flow supplied from the fluid supply device is converted into an intermittent flow by utilizing the pressure change due to a change in the gap defined between the opposed relatively moving surfaces, and wherein an intermittent discharge amount per dot is controlled by setting of pressure and flow-rate characteristics of the fluid supply device.

15. The fluid discharge method according to claim 14, wherein the fluid supply device is a pump which allows the flow rate to be changed by its rotating speed.

16. The fluid discharge method according to claim 15, wherein the fluid supply device is a thread groove pump.

17. The fluid discharge method according to claim 1, wherein if $h_0$ is a minimum value or a mean value of the gap, and a setting range of $h_0$ over which a discharge amount per dot $Q_s$ is largely dependent on $h_0$ is $0<h_0<h_x$, and if a setting range of $h_0$ over which the discharge amount per dot $Q_s$ is approximately independent of $h_0$ is $h_0>h_x$, then the fluid is intermittently discharged with the gap set within a range of $h_0>h_x$, and wherein $h_x$ is based on a value of an intersection point between an envelope of the discharge amount per dot $Q_s$ curve against $h_0$ and a line defined by $Q_s=Q_{se}$, and $Q_{se}$ is a convergent value of the discharge amount per dot.

18. The fluid discharge method according to claim 17, wherein $Q_{se}$ is a convergent value of the discharge amount per dot such that $Q_s=Q_{se}$ as $h_0 \rightarrow \infty$.

19. A fluid discharge method for continuously discharging fluid, the fluid discharge method comprising:

feeding the fluid from a fluid supply device to a gap defined between opposed relatively moving surfaces of two members that move relative to each other along a direction of the gap so that the fluid is continuously discharged through a discharge port communicating with the gap, wherein the opposed relatively moving surfaces of the two members are provided in n sets, where n is an integer not less than 1, and wherein given a total volume $V_1$ ($mm^3$) of the n sets of the opposed relatively moving surfaces, a total volume $V_2$ ($mm^3$) of flow passages that connect the n sets of the opposed relatively moving surfaces and the fluid supply device to each other, an absolute value $X_{st}$ (mm) of a stroke of the n sets of the opposed relatively moving surfaces that move relative to each other, a time $T_{st}$ (sec) required for the n sets of the opposed relatively moving surfaces to move by the stroke $X_{st}$, a fluid internal resistance $R_S$ (kgsec/$mm^5$) of the fluid supply device, a fluid resistance $R_n$ (kgsec/$mm^5$) of the discharge port, a modulus of elasticity of volume K (kg/$mm^2$) of the fluid, an effective area $S_P$ ($mm^2$) of the opposed relatively moving surfaces, and a sum $P_{s0}$ (kg/$mm^2$) of a maximum pressure and an auxiliary pressure of the fluid supply device, wherein if it is defined that $V_S=V_1+V_2$ and that a time constant T and a continuous interception control parameter $CI_c$ are $$T = \frac{R_s R_n}{R_n + nR_S}\frac{V_s}{K} \text{ and } CI_c = \frac{R_s S_p X_{st}\left(1 - e^{-\frac{T_{st}}{T}}\right)}{P_{s0} T_{st}},$$

respectively, then it holds that $CI_c>1$.

20. A fluid discharge method for continuously or intermittently discharging fluid, the fluid discharge method comprising feeding the fluid from a fluid supply device to a gap defined between opposed relatively moving surfaces of two members that move relative to each other along a direction of the gap so that the fluid is continuously or intermittently discharged through a discharge port communicating with the gap, wherein the two members that move relative to each other in the gap direction are provided in n sets, where n is an integer not less than 1, wherein given a total volume $V_1$ ($mm^3$) of the n sets of the opposed relatively moving surfaces, a total volume $V_2$ ($mm^3$) of flow passages that connect the n sets of the opposed relatively moving surfaces and the fluid supply device to each other, a fluid internal resistance $R_S$ (kgsec/$mm^5$) of the fluid supply device, a fluid resistance $R_n$ (kgsec/$mm^5$) of the discharge port, a fluid resistance $R_P$ (kgsec/$mm^5$) of radial flow passages that connect the discharge port and outer peripheries of the opposed relatively moving surfaces to each other, and a modulus of elasticity of volume K (kg/$mm^2$) of the fluid, and wherein if it is defined that $V_S=V_1+V_2$ and that a time constant T is $$T = \frac{R_s R_n}{R_n + R_p + nR_S}\frac{V_s}{K},$$

then it holds that $T \leqq 30$ msec.

* * * * *